US007511687B2

(12) United States Patent
Kimura

(10) Patent No.: US 7,511,687 B2
(45) Date of Patent: Mar. 31, 2009

(54) DISPLAY DEVICE, ELECTRONIC APPARATUS AND NAVIGATION SYSTEM

(75) Inventor: Hajime Kimura, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 212 days.

(21) Appl. No.: 10/439,312

(22) Filed: May 16, 2003

(65) Prior Publication Data

US 2004/0041752 A1 Mar. 4, 2004

(30) Foreign Application Priority Data

May 17, 2002 (JP) ..... 2002-143887

(51) Int. Cl.
*G09G 3/30* (2006.01)

(52) U.S. Cl. ..... 345/76; 345/77; 345/81

(58) Field of Classification Search ..... 345/76, 345/75.1, 0.2, 55, 77, 81–84, 204, 100, 175, 345/4, 695, 92, 211, 74.1, 75.2, 89; 327/94; 315/291, 169, 169.3, 169.1; 396/661; 365/230.05, 365/200; 257/59, 72; 313/495, 496
See application file for complete search history.

(56) References Cited

U.S. PATENT DOCUMENTS

| | | | | |
|---|---|---|---|---|
| 4,685,794 | A | 8/1987 | Watanabe | |
| 4,996,523 | A | 2/1991 | Bell et al. | |
| 5,396,133 | A | 3/1995 | Zhang | |
| 5,504,444 | A | 4/1996 | Neugebauer | |
| 5,526,058 | A | 6/1996 | Sano et al. | |
| 5,548,238 | A | 8/1996 | Zhang et al. | |
| 5,561,548 | A | 10/1996 | Engle | |
| 5,708,327 | A * | 1/1998 | O'Boyle | 313/495 |
| 5,714,968 | A | 2/1998 | Ikeda | |
| 5,729,244 | A * | 3/1998 | Lockwood | 345/75.2 |
| 5,856,812 | A * | 1/1999 | Hush et al. | 345/74.1 |

(Continued)

FOREIGN PATENT DOCUMENTS

EP 1 049 360 11/2000

(Continued)

OTHER PUBLICATIONS

Johnson et al., Active Matrix PolyLED Displays, IDW '00, pp. 235-238.

(Continued)

*Primary Examiner*—Prabodh Dharia
(74) *Attorney, Agent, or Firm*—Eric J. Robinson; Robinson Intellectual Property Law Office, P.C.

(57) ABSTRACT

A plurality of pairs of switch parts and current source circuits are disposed in each pixel. Switching of each of a plurality of the switch parts is controlled by a digital video signal. When the switch part is turned on, by a current supplied from the current source circuit making a pair with the switch part, the light emitting element emits light. A current which is supplied from one current source circuit to the light emitting element is constant. A value of a current flowing through the light emitting element is comparable to a value of added currents which are supplied to the light emitting element from respective all current source circuits making pairs with the switch parts which are in the conductive states.

21 Claims, 44 Drawing Sheets

U.S. PATENT DOCUMENTS 5,894,201 A 4/1999 Wong
5,969,479 A 10/1999 Wong
6,011,529 A 1/2000 Ikeda
6,091,203 A 7/2000 Kawashima et al.
6,169,528 B1 * 1/2001 Oguchi et al. ..... 345/74.1
6,229,506 B1 5/2001 Dawson et al.
6,255,773 B1 * 7/2001 Powers et al. ..... 313/496
6,266,000 B1 7/2001 Jusuf et al.
6,339,414 B1 * 1/2002 Todokoro et al. ..... 345/75.1
6,341,275 B1 1/2002 Shi et al.
6,373,454 B1 4/2002 Knapp et al.
6,380,913 B1 * 4/2002 Hush et al. ..... 345/75.2
6,411,159 B1 6/2002 Callahan, Jr.
6,429,600 B1 8/2002 Fujita et al.
6,445,367 B1 * 9/2002 Suzuki et al. ..... 345/75.2
6,466,189 B1 10/2002 Albu et al.
6,486,607 B1 11/2002 Yeuan
6,498,596 B1 12/2002 Nakamura et al.
6,501,466 B1 12/2002 Yamagishi et al.
6,507,328 B1 * 1/2003 Lee ..... 315/169.1
6,522,061 B1 * 2/2003 Lockwood ..... 313/495
6,528,951 B2 3/2003 Yamazaki et al.
6,580,408 B1 6/2003 Bae et al.
6,580,657 B2 * 6/2003 Sanford et al. ..... 365/230.05
6,608,326 B1 8/2003 Shinagawa et al.
6,617,801 B2 9/2003 Ishizuka et al.
6,690,033 B2 2/2004 Yamazaki et al.
6,744,414 B2 6/2004 Lee et al.
6,747,638 B2 6/2004 Yamazaki et al.
6,753,654 B2 6/2004 Koyama
6,760,004 B2 7/2004 Koyama
6,777,712 B2 * 8/2004 Sanford et al. ..... 257/59
6,798,148 B2 9/2004 Inukai
6,853,370 B2 2/2005 Numao
6,859,193 B1 2/2005 Yumoto
6,864,863 B2 3/2005 Kasai
6,876,350 B2 4/2005 Koyama
6,919,868 B2 7/2005 Tam
6,919,870 B2 7/2005 Fukuda
6,960,889 B2 * 11/2005 Park et al. ..... 315/169.2
6,963,336 B2 11/2005 Kimura
7,050,024 B2 5/2006 LeChevalier
7,148,865 B2 12/2006 Tamaki
7,170,479 B2 1/2007 Kimura
7,176,912 B2 * 2/2007 Kota et al. ..... 345/211
2001/0038367 A1 * 11/2001 Inukai ..... 345/76
2002/0003507 A1 * 1/2002 Dodge ..... 345/3.1
2002/0011972 A1 1/2002 Yamazaki et al.
2002/0014628 A1 2/2002 Koyama
2002/0033718 A1 * 3/2002 Tam ..... 327/94
2002/0044782 A1 * 4/2002 Kota et al. ..... 396/661
2002/0089496 A1 7/2002 Numao
2002/0135309 A1 9/2002 Okuda
2002/0175634 A1 11/2002 Ishizuka et al.
2002/0180369 A1 12/2002 Koyama
2002/0180719 A1 12/2002 Nagai et al.
2003/0016191 A1 * 1/2003 Nakamura et al. ..... 345/55
2003/0016198 A1 1/2003 Nagai et al.
2003/0043090 A1 3/2003 Yazawa et al.
2003/0048669 A1 3/2003 Abe
2003/0063081 A1 4/2003 Kimura et al.
2003/0090447 A1 5/2003 Kimura
2003/0117352 A1 6/2003 Kimura
2003/0137474 A1 * 7/2003 Lee ..... 345/75.2
2003/0178948 A1 * 9/2003 Park et al. ..... 315/169.3
2003/0179626 A1 * 9/2003 Sanford et al. ..... 365/200
2003/0214465 A1 11/2003 Kimura
2003/0214466 A1 11/2003 Kimura
2003/0214522 A1 11/2003 Kageyama et al.
2003/0218584 A1 11/2003 Kimura
2004/0008166 A1 1/2004 Kimura
2004/0041752 A1 3/2004 Kimura
2004/0100202 A1 5/2004 Koyama
2004/0183769 A1 9/2004 Schreyer et al.
2004/0207615 A1 10/2004 Yumoto
2004/0222749 A1 11/2004 Koyama
2005/0024298 A1 * 2/2005 Tam ..... 345/76
2005/0099371 A1 5/2005 Koyama
2005/0190177 A1 9/2005 Yumoto
2007/0052635 A1 3/2007 Kimura
2007/0103409 A1 5/2007 Kimura
2007/0146250 A1 6/2007 Kimura

FOREIGN PATENT DOCUMENTS

EP 1 102 234 5/2001
JP 08-129359 5/1996
JP 11-212493 8/1999
JP 11-282419 10/1999
JP 2000-284751 10/2000
JP 2001-42822 2/2001
JP 2001-147659 5/2001
JP 2002-514320 5/2002
JP 2002-517806 6/2002
JP 2002-278497 9/2002
JP 2003-066909 3/2003
JP 2003-330416 11/2003
WO WO98/48403 10/1998
WO WO99/65011 12/1999
WO WO 01/73741 10/2001

OTHER PUBLICATIONS

Intellectual Property Office of Singapore Search Report dated Dec. 17, 2004, for Application No. SG 200302785-1.
International Preliminary Examination Report dated Jun. 17, 2004, for Application No. PCT/JP2002/009354.

* cited by examiner

Wco
W
Sa
Sb
Ga
RGa
Gb
RGb
Gai
RGai
Gbi
RGbi
Gai-1
Gbi-1
301
302
303
304
101a
101b
102a
102b
106
Terminal A
Terminal B
Terminal C
Terminal D W
Wco
Sa
Ga
RGa
Gb
RGb
102a
102b
terminal A
terminal B
terminal C
terminal D
301
302
303
304
101a
101b
106

W
Wco
Sb Sa
Ga
RGa
RGb
102a
102b
terminal A
terminal B
terminal C
terminal D
301
302
303
304
101a
101b
106

W
Wco
Sb Sa
Ga
Gb
RGa
102a
102b
terminal A
terminal B
terminal C
terminal D
301
302
303
304
101a
101b
106

Fig. 10A
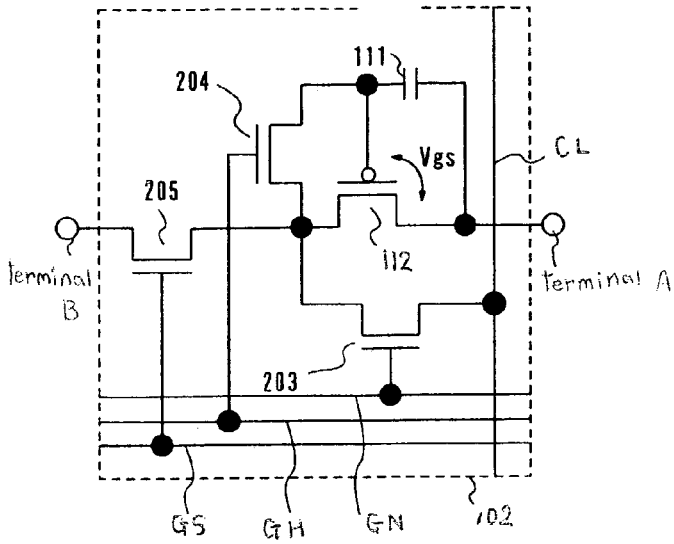
Fig. 10B (TD1)
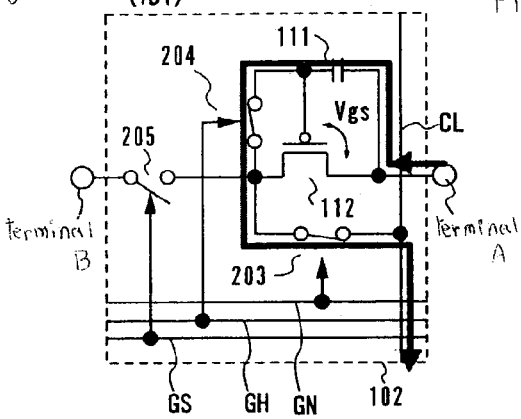
Fig. 10C (TD2)
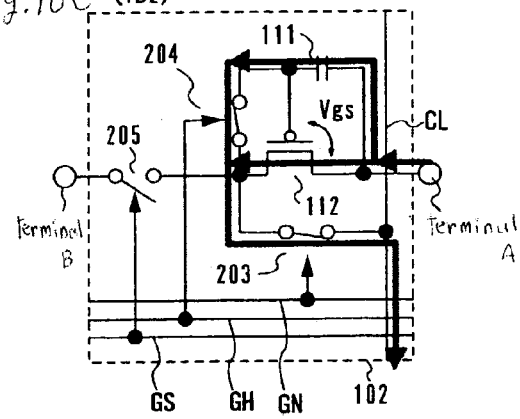
Fig. 10D (TD3)
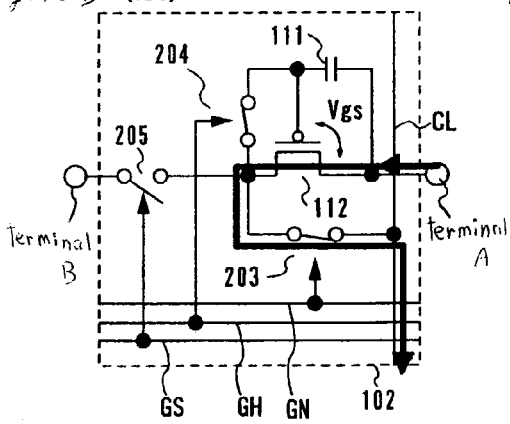
Fig. 10E (TD4)
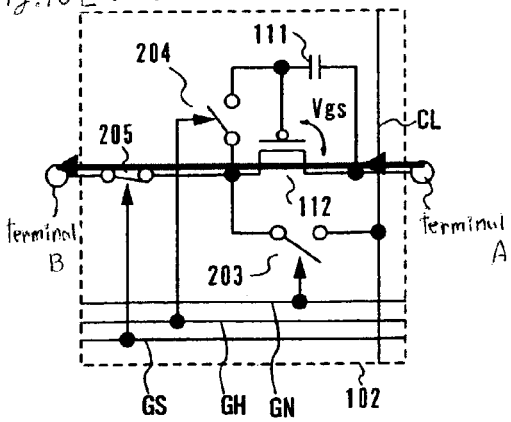

Fig. 11 A
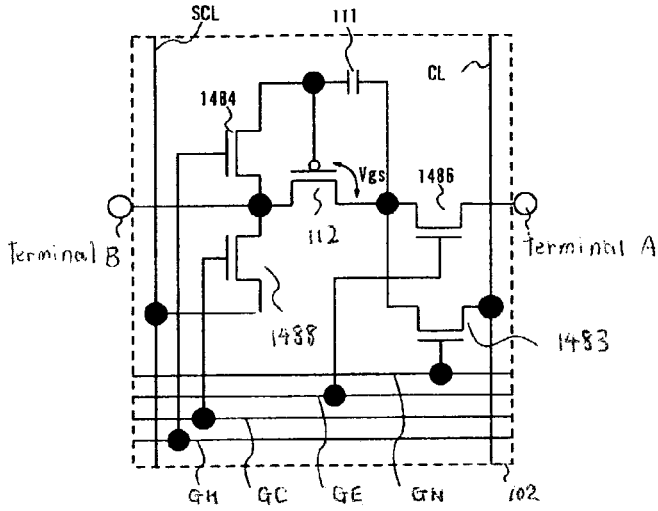
Fig. 11 B (TD1)
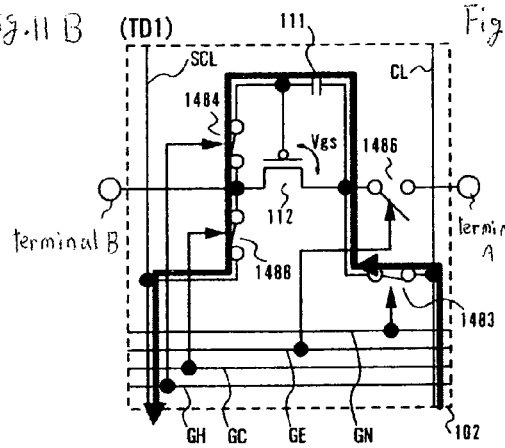
Fig. 11C (TD2)
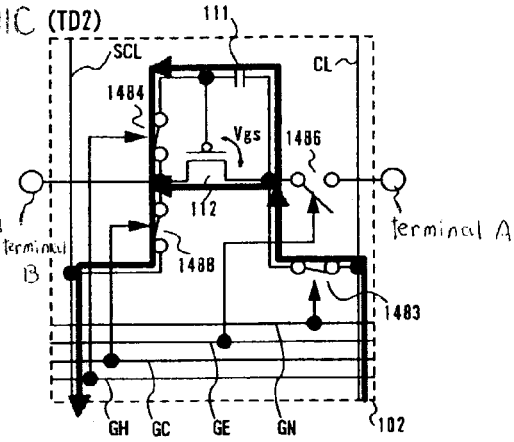
Fig. 11 D (TD3)
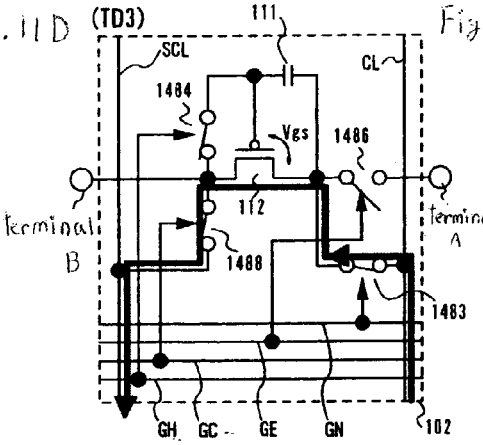
Fig. 11E (TD4)
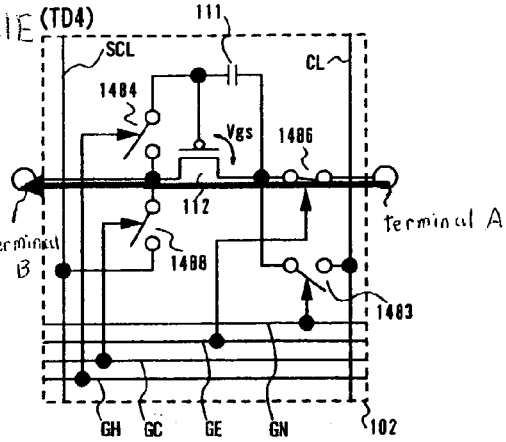

Fig. 13A
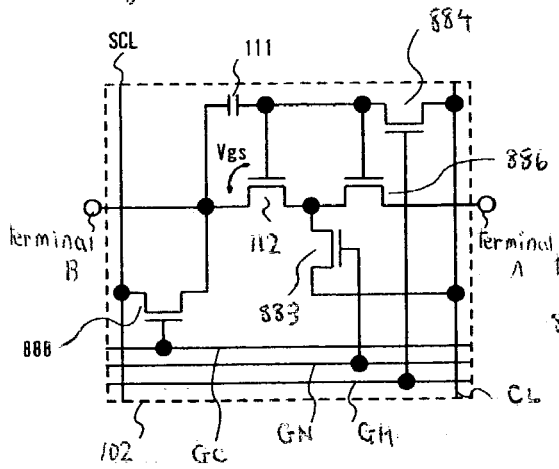
Fig. 13B
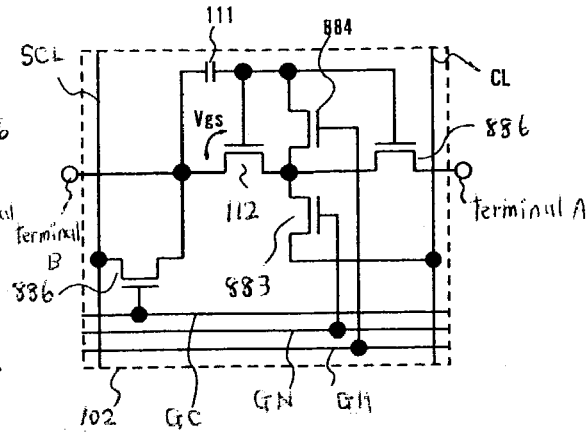
Fig. 13C (TD1)
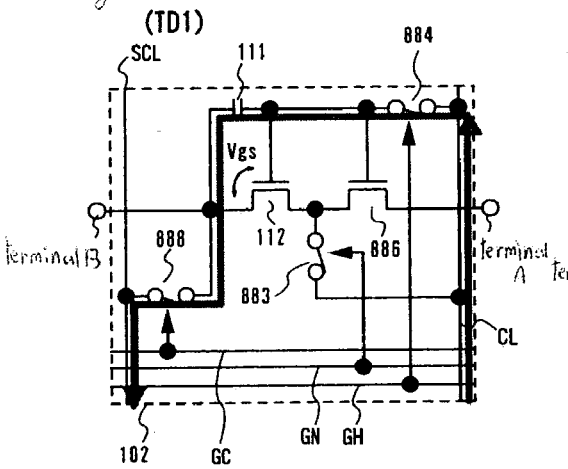
Fig. 13D (TD2)
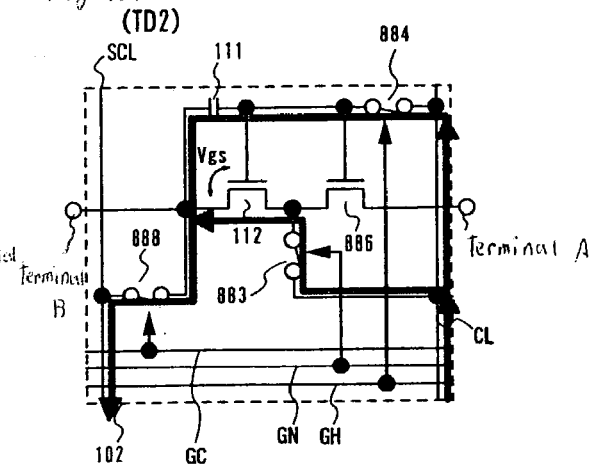
Fig. 13E (TD3)
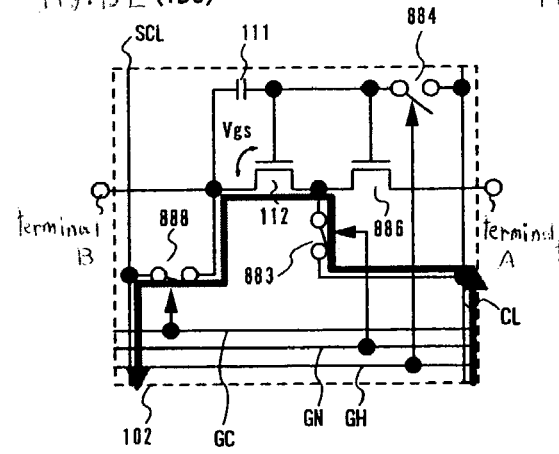
Fig. 13F (TD4)
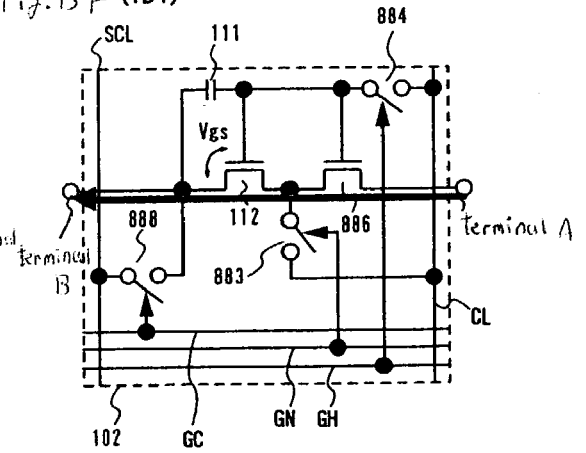

W
CLa
A
804a
111a
112a
102a
805a
803a
C
B
D
101a
Sa Sb
Ga
GNa
GHa
Gb
111b
112b
203b
204b
205b
106
101b
102b
GNb
GHb
GSb

W
CLa
A
804a
111a
112a
102a
805a
803a
C
B
D
101a
Sa Sb
Ga
GNa
GHa
Gb
111b
112b
203b
204b
205b
106
101b
102b
GNb
GHb
GSb

W
CLa CLb
A
804a
111a
112a
102a
805a
803a
C
B
D
101a
Sa Sb
Ga
Gb
111b
112b
203b
204b
205b
106
101b
102b
GNa
GHa
GSb

PRIOR ART

PRIOR ART

Fig. 29A
(TA1)
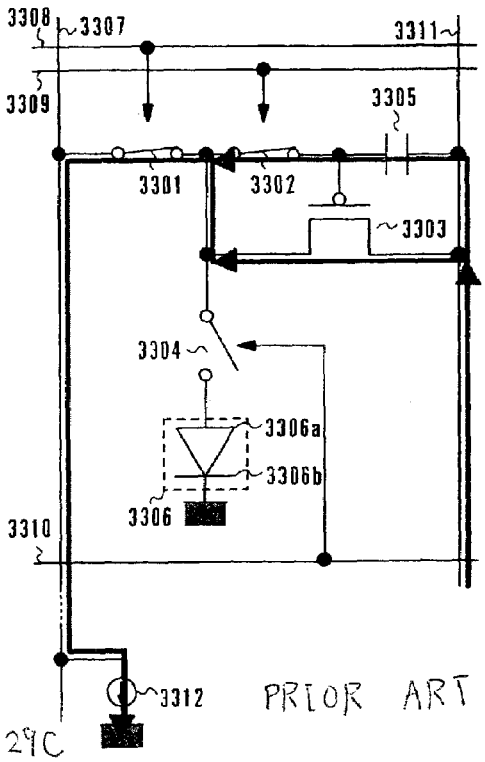
PRIOR ART
Fig. 29B
(TA2)
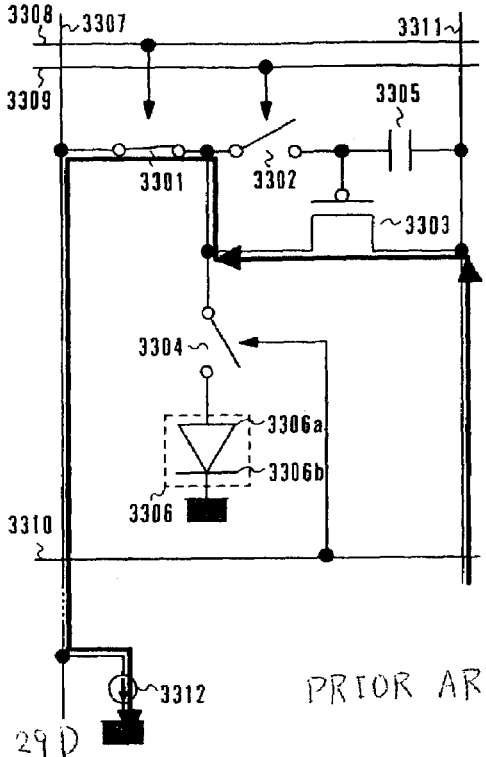
PRIOR ART
Fig. 29C
(TA3)
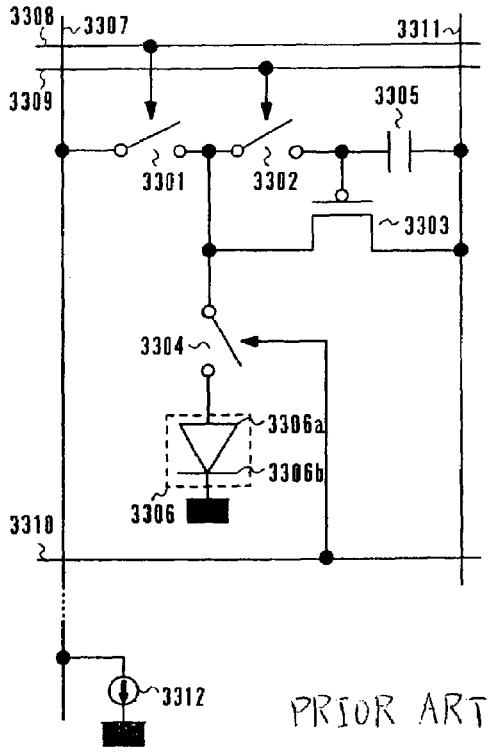
PRIOR ART
29D
(TA4)
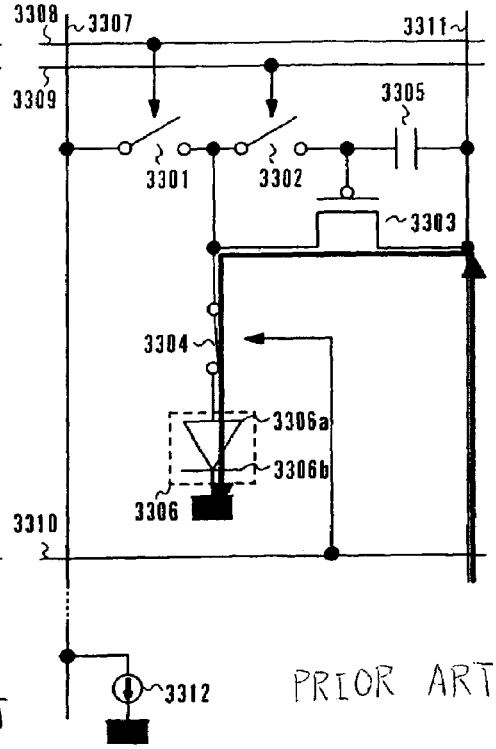
PRIOR ART

PRIOR ART

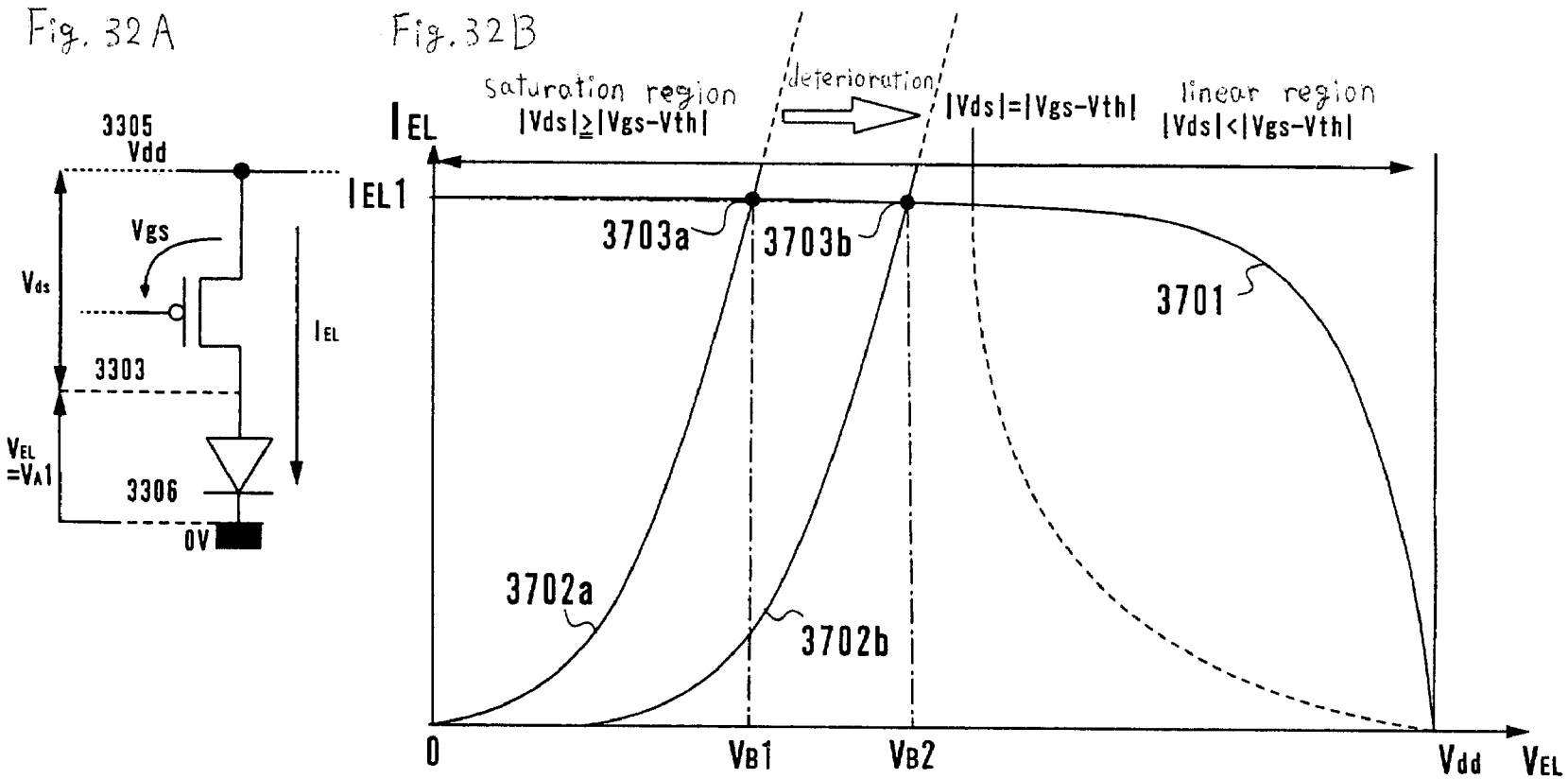
PRIOR ART

DISPLAY DEVICE, ELECTRONIC APPARATUS AND NAVIGATION SYSTEM

BACKGROUND OF THE INVENTION

1. Field of the Invention

This invention relates to a display apparatus which used a light emitting element and a driving method thereof. More particularly, it relates to an active matrix type display apparatus in which the light emitting element is placed with respect to each pixel and a transistor for controlling light emission of the light emitting element is provided and a driving method thereof.

2. Description of the Related Art

Development of a display apparatus having a light emitting element has been put forward in these years. In particular, development of an active matrix type display apparatus in which a light emitting element and a transistor for controlling light emission of the light emitting element are disposed with respect to each pixel has been put forward.

In the active matrix type display apparatus, either a technique in which an input of luminance information to each pixel is carried out by a voltage signal or a technique in which it is carried out by a current signal is mainly used. The former is called as a voltage writing type, and the latter is called as a current writing type. These structures and driving methods will be, hereinafter, described in detail.

Firstly, one example of a pixel of the voltage writing type is shown in FIG. 26, and its structure and driving method will be described. In each pixel, two TFT (a selection TFT 3001 and a drive TFT 3004) and a holding capacitance 3007 and an EL element 3006 are disposed. Here, a first electrode 3006*a* of the EL element 3006 is called as a pixel electrode, and a second electrode 3006*b* is called as an opposed electrode.

A driving method of the above-described pixel will be described. When the selection TFT 3001 is turned on by a signal which is inputted to a gate signal line 3002, electric charge is stored and held in the holding capacitance 3007 by a voltage of a video signal which is inputted to a source signal line 3003. A current which amount corresponds to the electric charge held in the holding capacitance 3007 flows from a power supply line 3005 to the EL element 3006 through the drive TFT 3004 so that the EL element 3006 emits light.

In pixels of the voltage writing type, the video signal which is inputted to the source signal line 3003 may be of an analog system or may be of a digital system. Driving in a case that the analog system video signal was used is called as the analog system, and driving in a case that the digital system video signal was used is called as the digital system.

In the voltage writing type analog system, a gate voltage (a voltage between a gate and a source) of each pixel of the drive TFT 3004 is controlled by the analog video signal. And, by the drain current with a value comparable to the gate voltage flowing through the EL element 3006, luminance is controlled and gray scale is displayed. On this account, generally in the voltage writing type analog system, in order to display halftone gray level, the drive TFT 3004 is made to operate in such an area that change of the drain current is larger than that of the gate voltage.

On one hand, in the voltage writing type digital system, whether the EL element 3006 is made to emit light or not is selected by the digital video signal so that a light emission period of the EL element is controlled and gray scale is displayed. In short, the drive TFT 3004 takes a function as a switch. On this account, generally in the voltage writing type digital system, on the occasion that the EL element 3006 is made to emit light, the drive TFT 3004 is made to operate in a linear region, more closely, particularly an area in which an absolute value of the gate voltage is large in the linear region.

The operation area of the drive TFT in the voltage writing type digital system and the voltage writing type analog system will be described by use of FIGS. 27A and 27B. FIG. 27A is a view, for the purpose of simplicity, showing only the drive TFT 3004, the power supply line 3005 and the EL element 3006 out of the pixel shown in FIG. 26. Curves 3101*a* and 3101*b* in FIG. 27B each shows a value of the drain Id current to the gate voltage Vgs of the drive TFT 3004. The curve 3101*b* to the curve 3101*a* shows a characteristic in a case that a threshold voltage of the drive TFT 3004 changed.

In the voltage writing analog system, the drive TFT 3004 operates in an operation area shown by (1) in the figure. In the operation area (1), when a gate voltage Vgs1 is applied, if a current characteristic of the drive TFT 3004 varies from 3101*a* to 3101*b*, the drain current changes from Id1 to Id2. In short, in the voltage writing type analog system, when the current characteristic of the drive TFT 3004 varies, the drain current varies and therefore, there is a problem that luminance of the EL element 3006 varies between pixels.

On one hand, the drive TFT in the voltage writing type digital system operates in an operation area shown by (2) in the figure. The operation area (2) is comparable to the linear region. The drive TFT 3004 which operates in the linear region, in case that the same gate voltage $V_{gs2}$ is applied, have substantially a constant current $I_{d3}$ flown since small is variation of the drain current resulting from variation of the characteristic such as mobility and threshold voltage. Thus, in the voltage writing type digital system in which the drive TFT 3004 operates in the operation area (2), even if the current characteristic of the drive TFT 3004 varies from 3101*a* to 3101*b*, it is hard for the current flowing through the EL element 3006 to vary, and it is possible to suppress variation of light emission luminance.

Thus, it can be said that as to the variation of luminance of the EL element resulting from the variation of the current characteristic of the drive TFT 3004, that of the voltage writing type digital system is smaller than that of the voltage writing type analog system.

Then, a structure and a driving method of the pixel of the current writing type will be described.

In a display apparatus of the current writing type, a current of the video signal (signal current) is inputted from the source signal line to each pixel. The signal current has a current value which linearly corresponds to luminance information. The signal line which was inputted becomes a drain current of TFT having a pixel. A gate voltage of the TFT is held in a capacitance part having a pixel. Even after input of the signal current is terminated, the drain current of TFT is maintained to be constant by the held gate voltage, and by inputting the drain current to the EL element, the EL element emits light. In this manner, in the current writing type display apparatus, a current flowing through the EL element is made to be changed by changing magnitude of the signal current so that the light emission luminance of the EL element is controlled and gray scale is displayed.

Hereinafter, a structure of the pixel of the current writing type is shown by way of two examples, and its structure and driving method will be described in detail.

FIG. 28 shows a structure of a pixel which is described in a patent document 1(JP-T-2002-517806) and a non patent document 1(1DW'00 p235–p238:Active Matrix PolyLED Displays). The pixel shown in FIG. 28 has an EL element 3306, a selection TFT 3301, a drive TFT 3303, a holding capacitance 3305, a holding TFT 3302, and a light emitting TFT 3304. Also, 3307 designates a source signal line, and

3308 designates a first gate signal line, and 3309 designates a second gate signal line, and 3310 designates a third gate signal line, and 3311 designates a power supply line. A current value of the signal current which is inputted to the source signal line 3307 is controlled by a video signal input current source 3312.

A driving method of the pixel of FIG. 28 will be described by use of FIGS. 29A–D. In addition, in FIGS. 29A–D, the selection TFT 3301, the holding TFT 3302 and the light emitting TFT 3304 are shown as switches.

In a period of TA1, the selection TFT 3301 and the holding TFT 3302 are turned on. In this moment, the power supply line 3311 is connected to the source signal line 3307 through the drive TFT 3303 and the holding capacitance 3305. Through the source signal line 3307, a current amount $I_{video}$ defined by a video signal input current source 3312 flows. On that account, when time passes and it becomes a stable state, the drain current of the drive TFT 3303 becomes $I_{video}$. Also, the gate voltage corresponding to the drain current $I_{video}$ is held in the holding capacitance 3305. After the drain current of the drive TFT 3303 was settled to be $I_{video}$, a period of TA2 is initiated, and the holding TFT 3302 is turned off.

Next, a period of TA3 is initiated, the selection TFT 3301 is turned off. Further, in a period of TA4, when the light emitting TFT 3304 is turned on, the signal current $I_{video}$ is inputted from the power supply line 3311 to the EL element 3306 through the drive TFT 3303. By this means, the EL element 3306 emits light with luminance corresponding to the signal current $I_{video}$. In the pixel shown in FIG. 28, by analogously changing the signal current $I_{video}$, it is possible to express the gray scale.

In the above-described current writing type display apparatus, the drain current of the drive TFT 3303 is determined by the signal current which is inputted from the source signal line 3307, and still further, the drive TFT 3303 operates in a saturation region. On that account, even if there is variation of the characteristic of the drive TFT 3303, the gate voltage of the drive TFT 3303 automatically changes in such a manner that a constant drain current is made to flow through the light emitting element. In this manner, in the current writing type display apparatus, even if the characteristic of TFT varies, it is possible to suppress variation of a current flowing through the EL element. As a result, it is possible to suppress the variation of the light emission luminance.

Next, another example of the current writing type pixel which is different from FIG. 28 will be described. FIG. 30A shows a pixel which is described in a patent document 2(JP-A-2001-147659).

A pixel shown in FIG. 30A is configured by an EL element 2906, a selection TFT 2901, a drive TFT 2903, a current TFT 2904, a holding capacitance 2905, a holding TFT 2902, a source signal line 2907, a first gate signal line 2908, a second gate signal line 2909, and a power supply line 2911. It is necessary for the drive TFT 2903 and the current TFT 2904 to have the same polarity. Here, for the purpose of simplicity, it is assumed that a Id-Vgs characteristic (a relation of the drain current and the voltage between gate and drain) of the drive TFT 2903 is the same as that of the current TFT 2904. Also, a current value of the signal current which is inputted to the source signal line 2907 is controlled by the video signal input current source 2912.

A driving method of the pixel shown in FIG. 30A will be described by use of FIGS. 30B to 30D. In addition, in FIGS. 30B to 30D, the selection TFT 2901 and the holding TFT 2902 are shown as switches.

In the period of TA1, when the selection TFT 2901 and the holding TFT 2902 are turned on, the power supply line 2911 is connected to the source signal lien 2907 through the current TFT 2904, the selection TFT 2901, the holding TFT 2902 and the holding capacitance 2905. Through the source signal line 2907, the current amount $I_{video}$ which was defined by the video signal input current source 2912 flows. On that account, when sufficient time passes and it becomes a stable state, the drain current of the current TFT 2904 becomes $I_{video}$, and the gate voltage corresponding to the drain current $I_{video}$ is held in the holding capacitance 2905.

After the drain current of the current TFT 2904 was settled to be $I_{video}$, the period of TA2 is initiated, and the holding TFT 2902 is turned off. In this moment, through the drive TFT 2903, the drain current of $I_{video}$ flows. In this manner, the signal current $I_{video}$ is inputted from the power supply line 2911 to the EL element 2906 through the drive TFT 2903. The EL element 2906 emits light with luminance in response to the signal current $I_{video}$.

Next, when the period of TA3 is initiated, the selection TFT 2901 is turned off. Even after the selection TFT 2901 was turned off, the signal current Ivideo continues to be inputted from the power supply line 2911 to the EL element 2906 through the drive TFT 2903, and the EL element 2906 continues to emit light. The pixel shown in FIG. 30A can express gray scale by analogously changing the signal current Ivideo.

In the pixel shown in FIG. 30A, the drive TFT 2903 operates in the saturation region. The drain current of the drive TFT 2903 is determined by the signal current which is inputted to the source signal line 2907. On that account, if the current characteristics of the drive TFT 2903 and the current TFT 2904 in the same pixel are equivalent, even if there is variation of the characteristic of the drive TFT 2903, the gate voltage of the drive TFT 3303 automatically changes in such a manner that a constant drain current is made to flow through the light emitting element.

In the EL element, a relation of a voltage between both electrodes thereof and a flowing current amount (I-V characteristic) changes due to influence of ambient temperature, deterioration over time and so on. On that account, in a display device in which the drive TFT is operated in the linear region like the above-described voltage writing type digital system, even if a voltage value between both electrodes of the EL element is the same, the current amount flowing between both electrodes of the EL element is changed.

In the voltage writing type digital system, FIG. 31A and FIG. 31B are views showing a change of an operating point in a case that the I-V characteristic of the EL element was changed due to deterioration etc. In addition, in FIG. 31A and FIG. 31B, same reference numerals are given to those portions which are the same as the corresponding portions of FIG. 27A and FIG. 27B.

FIG. 31A is a view that shows only the drive TFT 3004 and the EL element 3006 extracted from FIG. 26. A voltage between a source and a drain of the drive TFT 3004 is represented by $V_{ds}$. A voltage between both electrode of the EL element 3006 is shown by $V_{EL}$. A current flowing through the EL element 3006 is shown by IEL. The current IEL equals to the drain current Id of the drive TFT 3004. An electric potential of the power supply line 3005 is shown by $V_{dd}$. Also, an electric potential of an opposed electrode of the EL element 3006 is assumed to be 0(V).

In FIG. 31B, 3202*a* designates a curve which shows the relation of the voltage VEL and the current amount IEL of the EL element 3006 before deterioration (I-V characteristic). On one hand, 3202*b* designates a curve which shows I-V characteristic of the EL element 3006 after deterioration. 3201 designates a curve which shows the relation of the voltage between source and drain Vds and the drain current Id($I_{EL}$) of the drive TFT 3004 in a case that the gate voltage in FIG. 27B is Vgs2. Operating conditions (operating points) of the drive TFT 3004 and the EL element 3006 are determined by an intersection point of these two curves. In short, by the intersection point 3203*a* of the curve 3202*a* and the curve 3201 in the linear region shown in the figure, the operating conditions of the drive TFT 3004 and the EL element 3006 before deterioration of the EL element 3006 are determined. Also, by the intersection point 3203*b* of the curve 3202*b* and the curve 3201 in the linear region shown in the figure, the operating conditions of the drive TFT 3004 and the EL element 3006 after deterioration of the EL element 3006 are determined. The operating points 3203*a* and 3203*b* will be compared to each other.

In the pixel which was selected to be in a light emitting state, the drive TFT 3004 is in a state of on. In this moment, a voltage between both electrodes of the EL element 3006 is $V_{A1}$. When the EL element 3006 is deteriorated and its I-V characteristic is changed, even if the voltage between both electrodes of the EL element 3006 is substantially the same as VA1, a flowing current is changed from IEL1 to IEL2. In short, since the current flowing through the EL element 3006 is changed from IEL1 to IEL2 by a level of deterioration of the EL element 3006 of each pixel, the light emission luminance is varied.

As a result, in a display apparatus having a pixel of such a type that the drive TFT is made to be operated in the linear region, burn-in of an image tends to occur.

On one hand, in the pixel of the current writing type shown in FIGS. 28 and 30A–D, the above-described burn-in of the image is reduced. This is because, in the pixel of the current writing type, the drive TFT operates so as to always flow substantially a constant current.

In the pixel of the current writing type, change of the operating point in a case that the I-V characteristic of the EL element, in the current writing type, was changed due to deterioration etc. will be described by use of the pixel of FIG. 28 as an example. FIG. 32A and FIG. 32B are views showing the change of the operating point in the case that the I-V characteristic of the EL element was changed due to deterioration etc. In addition, in FIG. 32A and FIG. 32B, same reference numerals are given to those portions which are the same as the corresponding portions of FIG. 28.

FIG. 32A is a view that shows only the drive TFT 3303 and the EL element 3306 extracted from FIG. 28. A voltage between a source and a drain of the drive TFT 3303 is shown by Vds. A voltage between a cathode and an anode of the EL element 3306 is shown by VEL. A current flowing through the EL element 3306 is shown by IEL. The current IEL equals to the drain current Id of the drive TFT 3303. An electric potential of the power supply line 3305 is shown by Vdd. Also, an electric potential of an opposed electrode of the EL element 3306 is assumed to be 0(V).

In FIG. 32B, 3701 designates a curve which shows the relation of the voltage between source and drain and the drain current of the drive TFT 3303. 3702*a* designates a curve which shows the I-V characteristic of the EL element 3306 before deterioration. On one hand, 3702*b* designates a curve which shows the I-V characteristic of the EL element 3306 after deterioration. Operating conditions of the drive TFT 3004 and the EL element 3006 before deterioration of the EL element 3306 are determined by an intersection point 3703*a* of the curves 3702*a* and 3701. Operating conditions of the drive TFT 3303 and the EL element 3306 after deterioration of the EL element 3306 are determined by an intersection point 3703*b* of the curves 3702*b* and 3701. Here, the operating points 3703*a* and 3703*b* will be compared to each other.

In the pixel of the current writing type, the drive TFT 3303 operates in the saturation region. Before and after the EL element 3006 is deteriorated, the voltage between both electrodes of the EL element 3006 is changed from $V_{B1}$ to $V_{B2}$ but, the current flowing through the EL element 3006 is maintained to be $I_{EL1}$ which is substantially constant. In this manner, even if the EL element 3006 is deteriorated, the current flowing through the EL element 3006 is maintained to be substantially constant. Thus, the problem of the burn-in of the image is reduced.

However, in the conventional driving method of the current writing type, there is a necessity that electric potentials corresponding to the signal current are held in the holding capacity of each pixel. The operation for retaining a predetermined electric potential in the holding capacitance needs longer time as the signal current becomes smaller, because of an intersection capacitance etc. of a wiring through which the signal current flows. On that account, it is difficult to quickly write the signal current. Also, in case that the signal current is small, large is influence of a noise of a leak current etc. which occurs from a plurality of pixels connected to the same source signal line as that of the pixel to which writing of the signal current is carried out. On that account, there is such a high risk that it is impossible to have the pixel emitted light with accurate luminance.

Also, in the pixel having a current mirror circuit represented by the pixel shown in FIGS. 30A–D, it is desirable to have same current characteristics of a pair of TFTs which configures the current mirror circuit. However, in reality, it is hard to have completely the same current characteristics of the pair of these TFTs, and there occurs variation.

In the pixel shown in FIGS. 30A–D, threshold values of the drive TFT 2903 and the current TFT 2904 are $V_{tha}$, $V_{thb}$, respectively. When the threshold values $V_{tha}$, $V_{thb}$ of both transistors vary and an absolute value $|V_{tha}|$ of $V_{tha}$ has become smaller than an absolute value $|V_{thb}|$ of $V_{thb}$, a case of carrying out a black display will be studied. The drain current flowing through the current TFT 2903 is comparable to the current value $I_{video}$ which was determined by the video signal input current source 2912, and assumed to be 0. However, even if the drain current does not flow through the current TFT 2904, there is a possibility that a voltage of a level of slightly smaller than $|V_{thb}|$ is held in the holding capacitance 2905. Here, because of $|V_{thb}|>|V_{tha}|$, there is a possibility that the drain current of the drive TFT 2903 is not 0. Even in case that the black display is carried out, there is such a possibility that the drain current flows through the drive TFT 2903 and the EL element 2906 emits light, and there occurs a problem that contrast comes down.

Further, in the conventional display apparatus of the current writing type, the video signal input current source for inputting the signal current to each pixel is disposed with respect to each row (with respect to each pixel line). There is a necessity that current characteristics of those all video signal input current sources are made to be the same and a current value to be outputted is analogously changed with accuracy. However, in a transistor which used polycrystalline semiconductors etc., since variation of characteristics of transistors is large, it is difficult to make the video signal input current source in which current characteristics are uniform. Thus, in the conventional display apparatus of the current writing type, the video signal input current source is fabricated on a single crystalline IC substrate. On one hand, it is general that as to a substrate on which the pixel is formed, it is fabricated on an insulation substrate such as glass etc. from the aspect of cost etc. Then, there is a necessity that a single crystalline IC substrate on which the video signal input current source was fabricated is attached on a substrate on which the pixel was formed. The display apparatus of such structure has such problems that cost is high, and an area of a picture frame can not be reduced since large is an area which is required on the occasion of attachment of the single crystalline IC substrate.

In view of the above-described actual condition, the invention has a task to provide a display apparatus in which a light emitting element can be made to emit light with constant luminance without coming under the influence of deterioration over time and a driving method thereof. Also, the invention provides a display apparatus in which it is possible to carry out accurate gray scale expression, and also, it is possible to speed up writing of a video signal to each pixel, and influence of noise such as a leak current etc. is suppressed and a driving method thereof. Furthermore, the invention has a task to provide a display apparatus which reduces an area of a picture frame and realizes miniaturization and a driving method thereof.

SUMMARY OF THE INVENTION

The invention took the following steps in order to solve the above-described tasks or problems.

Each pixel which is included in a display apparatus of the invention has a plurality of switch parts and a plurality of current source circuits. One switch part and one current source circuit operates as a pair. A plurality of pairs of one switch part and one current source circuit exist in one pixel.

As to each of a plurality of the switch parts, on or off thereof is selected by a digital video signal. When the switch part is turned on (conductive), a current flows from the current source circuit which corresponds to the switch part to the light emitting element so that the light emitting element emits lights. A current which is supplied from one current source circuit to the light emitting element is constant. According to the current rule of Kirchhoff, a value of a current which flows through the light emitting element is comparable to an added value of currents which are supplied from all current source circuits corresponding to the switch part of a conductive state to the light emitting element. In the pixel of the invention, the value of the current which flows through the light emitting element is changed by which switch part out of a plurality of the switch parts is turned conductive so that it is possible to express gray scale. On one hand, the current source circuit is set to always output a constant current of a certain level. On that account, it is possible to prevent variation of the current which flows through the light emitting element.

A structure of the pixel of the invention and its operation will be described by use of FIG. 1 which typically showed the structure of the pixel of the display apparatus of the invention. In FIG. 1, the pixel has two current source circuits (in FIG. 1, a current source circuit a, a current source circuit b), two switch parts (in FIG. 1, a switch part, a switch part b) and the light emitting element. In addition, FIG. 1 illustrated the example of the pixel in which there are two pairs of the switch part and the current source circuit in one pixel though, the number of pairs of a switch part a current source circuit in one pixel may be the arbitrary number.

The switch part (switch part a, switch part b) has an input terminal and an output terminal. To be conductive or non conductive between the input terminal and the output terminal of the switch part is controlled by the digital video signal. A matter that the input terminal and the output terminal of the switch part are in a conductive state is called as that the switch part is turned on. Also, a matter that the input terminal and the output terminal of the switch part are in non conductive state is called as that the switch part is turned off. Each switch part is on-off controlled by the corresponding digital video signal.

The current source circuit (current source circuit a, current source circuit b) has an input terminal and an output terminal, and has a function for having a constant current flowed between the input terminal and the output terminal. The current source circuit a is controlled to have the constant current Ia flowed by a control signal a. Also, the current source circuit b is controlled to have the constant current Ib flowed by a control signal b. The control signal may be a signal which is different from the video signal. Also, the control signal may be a current signal or may be a voltage signal. In this manner, an operation for determining a current which flows through the current source circuit by the control signal is called as a setting operation of the current source circuit or a setting operation of the pixel. Timing of carrying out the setting operation of the current source circuit may be synchronous with or may be asynchronous with the operation of the switch part, and can be set at arbitrary timing. Also, the setting operation may be carried out only to one current source circuit and information of the current source circuit to which the setting operation was carried out may be shared with other current source circuit. By the setting operation of the current source circuit, it is possible to suppress variation of a current which the current source circuit outputs.

For example, the pixel of a display device in the case that a current signal inputted to a current source circuit is a current signal is exemplified. Pixels each have plural current source circuits to each of which a constant control current is supplied and in each of which a constant current corresponding to the control current is made into an output current, and plural switch parts each selecting an input of the output current from each of the plural current source circuits to a light emitting element by a digital picture signal.

Here, each of the plural current source circuits has: a 1st transistor and a 2nd transistor connected in series with the 1st transistor, 1st means for selectively inputting the control current as a drain current of the 1st transistor, 2nd means for holding a gate voltage of the 1st transistor, 3rd means for selecting a connection between a gate and a drain of the 1st transistor, and 4th means for making a drain current of the 2nd transistor, in which a part of the held gate voltage of the 1st transistor is made into a gate voltage, into the output current.

Or, one of the plural current source circuits has: a 1st transistor and a 2nd transistor connected in series with the 1st transistor, 1st means for selectively inputting the control current as a drain current of the 1st transistor, 2nd means for holding a gate voltage of the 1st transistor, 3rd means for selecting a connection between a gate and a drain of the 1st transistor, and 4th means for making a drain current of the 2nd transistor, in which a part of the held gate voltage of the 1st transistor is made into a gate voltage, into the output current, and wherein another one of the plural current source circuits has: a 3rd transistor and a 4th transistor, 5th means for selectively inputting the control current as a drain current of the 3rd transistor, 6th means for holding a gate voltage of the 3rd transistor, 7th means for selecting a connection between a gate and a drain of the 3rd transistor, and 8th means for making a drain current of the 4th transistor, in which the held gate voltage of the 3rd transistor is made into a gate voltage, into the output current.

The light emitting element means an element which luminance is changed by current amount flowing between both electrodes thereof. As the light emitting element, cited are an EL (Electro-Luminescence) element, a FE (Field Emission) element and so on. But, even in case of using an arbitrary element which controls its state by a current, a voltage and so on, in lieu of the light emitting element, it is possible to apply the invention.

Out of two electrodes (anode and cathode) of the light emitting element gray scale electrode (first electrode) is electrically connected to the power supply line through the switch part a and the current source circuit a in sequence. Further, the first electrode is electrically connected to the power supply line through the switch part b and the current source circuit b in sequence. In addition, if it is such a circuit structure that a current defined by the current source circuit a is designed not to flow between the light emitting elements, on the occasion that the switch part a was turned off, and a current defined by the current source circuit b is designed not to flow between the light emitting elements, on the occasion of that the switch part b was turned off, there is no restriction to the circuit structure of FIG. 1.

In the invention, one current source circuit and one switch part are paired up, and they are connected serially. In the pixel of FIG. 1, there are two sets of such pairs of a switch part and a current source circuit, and two sets of pairs are connected in parallel with each other.

Then, an operation of the pixel shown in FIG. 1 will be described.

As shown in FIG. 1, in the pixel having two switch parts and two current source circuits, there exist three ways in total of paths of the current which is inputted to the light emitting element. A first path is a path through which a current supplied from either of two current source circuits is inputted to the light emitting element. A second path is a path through which a current supplied from another current source circuit being different from the current source circuit which supplied the current in the first path is inputted to the light emitting element. A third path is a path through which both currents supplied from two current source circuits are inputted to the light emitting element. In case of the third path, an added current of currents which are supplied from the respective current source circuits is to be inputted to the light emitting element.

Explaining more concretely, the first path is a path through which only the current Ia flowing through the current source circuit a is inputted to the light emitting element. This part is selected in case that the switch part a was turned on and the switch part b was turned off by the digital video a and the digital video signal b. The second path is a path through which only the current Ib flowing through the current source circuit b is inputted to the light emitting element. This path is selected in case that the switch part a was turned off and the switch part b was turned on by the digital video signal a and the digital video signal b. The third path is a path thorough which the added current Ia+Ib of the current Ia flowing through the current source circuit a and the current Ib flowing through the current source circuit b is inputted to the light emitting element. This path is selected in case that both of the switch part a and the switch part b were turned on by the digital video signal a and the digital video signal b. That is, since the current Ia+Ib are made to flow through the light emitting element by the digital video signal a and the digital video signal b, it turns out that the pixel carries out the same operation as digital/analog conversion.

Subsequently, a basic technique for gray scale expression in the display apparatus of the invention will be described. Firstly, properly defined is a constant current which flows through each current source circuit by the setting operation of the current source circuit. As to a plurality of the current source circuits that each pixel has, it is possible to set at a different current value with respect to each current source circuit. Since the light emitting element emits light with luminance corresponding to a flowing current amount (current density), it is possible to set the luminance of the light emitting element by controlling which current source circuit the current is supplied from. Therefore, by selecting the path of the current which is inputted to the light emitting element, it is possible to select the luminance of the light emitting element from a plurality of luminance levels. In this manner, it is possible to select the luminance of the light emitting element of each pixel from a plurality of the luminance levels by the digital video signal. When all of the switch parat were turned off by the degital video signal, the luminance way be set to be 0 because of no inputting a current to the light emitting element (which is hereinafter called as to select the respective light emitting state). In this manner, it is possible to express gray scale by changing the luminance of the light emitting element of each pixel.

However, only by the above-described method, there is a case that the number of gray scale is few. Then, in order to realize multiple gray scale, it is possible to combine it with other gray scale system. As to the system, there are two systems, roughly categorized.

A first one is a technique of combining with a temporal gray scale system. The temporal gray scale system is a method for expressing gray scale by controlling a period of light emission within a one frame period. The one frame period is comparable to a period for displaying one screen image. Concretely, one frame period is divided into a plurality of sub frame periods, and with respect to each sub frame period, a light emitting state or a non light emitting state of each pixel is selected. In this manner, by the combination of the period in which the pixel emitted light and the light emission luminance, the gray scale is expressed. A second one is a technique of combining with an area gray scale system. The area gray scale system is a method for expressing gray scale by changing an area of a light emitting portion in one pixel. For example, each pixel is configured by a plurality of sub pixels. Here, a structure of each sub pixel is the same as the pixel structure of the display apparatus of the invention. In each sub pixel, the light emitting state or the non light emitting state is selected. In this manner, by the combination of the area of the light emitting portion of the pixel and the light emission luminance, the gray scale is expressed. In addition, the technique of combining with the temporal gray scale system and the technique of combining with the area gray scale system may be combined.

Then, an effective technique for further reducing the luminance variation in the above-described gray scale display technique will be shown. This is an effective technique in case that the luminance is varied due to for example, noise etc. even when the same gray scale is expressed between the pixels.

Each of more than two current source circuits out of a plurality of current source circuits that each pixel has is set so as to output the same constant current each other. And, on the occasion of expressing the same gray scale, the current source circuits which output the same constant current are selectively used. If this is realized, even if the output current of the current source circuit is fluctuated, the current flowing through the light emitting element is temporarily averaged. On that account, it is possible to visually reduce the variation of the luminance due to the variation of the output currents of the current source circuits between respective pixels.

In the invention, since the current flowing through the light emitting element on the occasion of carrying out image display is maintained at a predetermined constant current, regardless of change of the current characteristic due to deterioration etc., it is possible to have the light emitting element emitted light with constant luminance. Since on or off state of the switch part is selected by the digital video signal and thereby, the light emitting state or the non light emitting state of each pixel is selected, it is possible to quicken the writing of the video signal to the pixel. In the pixel in which the non light emitting state was selected by the video signal, since the current to be inputted to the light emitting element is completely blocked by the switch part, it is possible to express accurate gray scale. In short, it is possible to solve the problem of contrast deterioration on the occasion of black display which occurs due to the leak current. Also, in the invention, since it is possible to set the current value of the constant current flowing through the current source circuit large on some level, it is possible to reduce the influence of noise which occurs on the occasion of writing a small signal current. Further, since the display apparatus of the invention does not need a drive circuit for changing the value of the current flowing through the current source circuit which was placed in each pixel and there is no necessity of an external drive circuit which was fabricated on separate substrate such as a single crystalline IC substrate etc., it is possible to realize a lower cost and a smaller size.

BRIEF DESCRIPTION OF THE DRAWINGS

The invention, together with advantages thereof, may best be understood by reference to the following description taken in conjunction with the accompanying drawings in which:

FIGS. 10A–10E are views showing structures and a driving method of the current source circuit of the pixel of the display apparatus of the invention;

FIGS. 11A–11E are views showing structures and a driving method of the current source circuit of the pixel of the display apparatus of the invention;

FIGS. 13A–13F are views showing structures and a driving method of the current source circuit of the pixel of the display apparatus of the invention;

FIGS. 29A–29D are views showing an operation of the pixel of the conventional display apparatus;

FIG. 32A and FIG. 32B are views showing the operation region of the drive TFT of the conventional display apparatus;

DETAILED DESCRIPTION OF THE EMBODIMENTS

Embodiment 1

An embodiment of the invention will be described by use of FIGS. 2A–C. In this embodiment, a case that there are two pairs in one pixel will be described.

Figure 1:
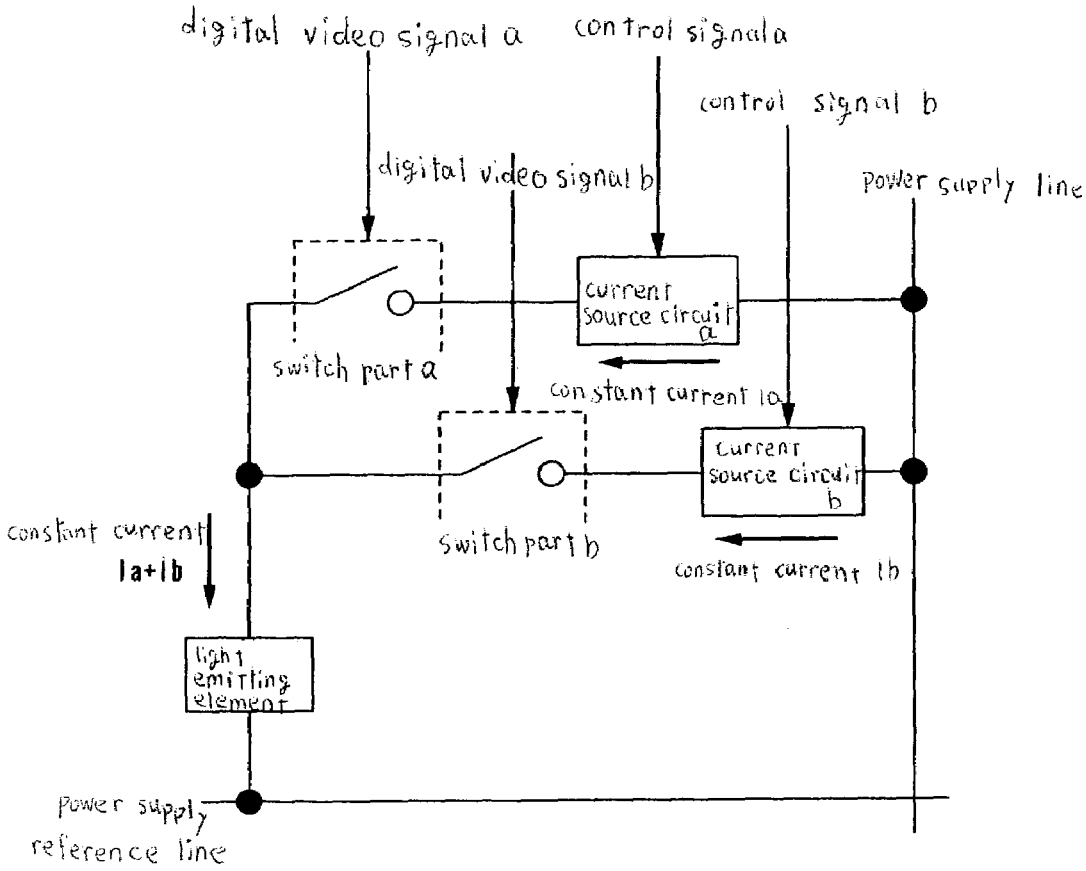
FIG. 1 is a schematic diagram showing a structure of a pixel of a display apparatus of the invention.
Figure 2A:
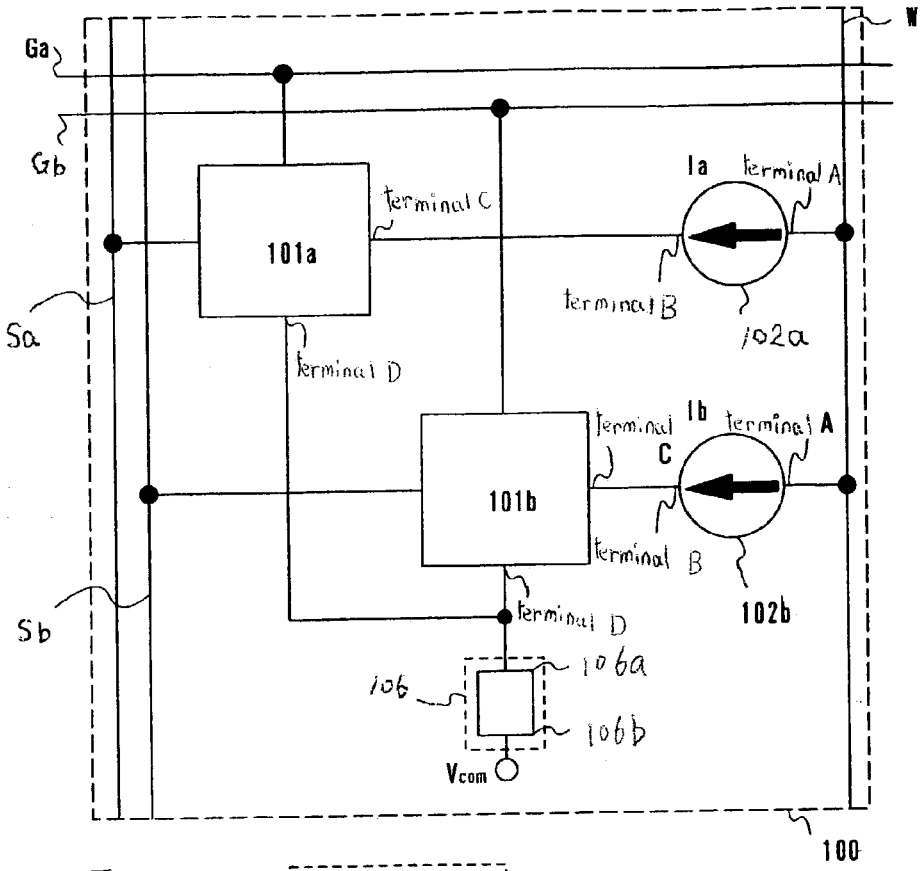
FIGS. 2A–C are schematic diagrams showing structures of the pixel of the display apparatus of the invention.
Figure 2B:
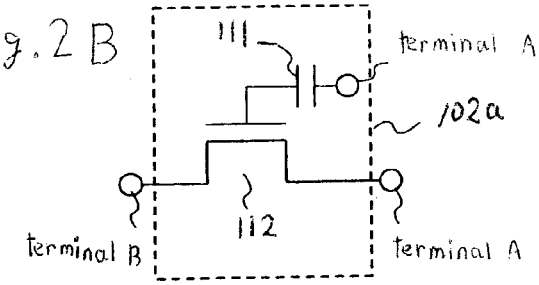

In FIG. 2A, each pixel 100 has switch parts 101*a* and 101*b*, current source circuits 102*a* and 102*b*, a light emitting element 106, video signal input lines Sa and Sb, scanning lines Ga and Gb, and a power supply line W. The switch part 101*a* and the current source circuit 102*a* are connected serially to form one pair. The switch part 102*b* and the current source circuit 102*b* are connected serially to form one pair. These two pairs are connected in parallel. Also, these two parallel circuits are serially connected to the light emitting element 106.

In the pixel shown in FIGS. 2A–C, two pairs are disposed but, hereinafter, paying attention to the pair of the switch part 101*a* and the current source circuit 102*a*, a structure of the current source circuit 102*a* and the switch part 101*a* will be described by use of FIGS. 2A–C.

Firstly, the current source circuit 102*a* will be described by use of FIG. 2A. In FIG. 2A, the current source circuit 102*a* is shown by a circle and an arrow in the circle. It is defined that a positive current flows in a direction of the arrow. Also, it is defined that an electric potential of a terminal A is higher than that of a terminal B. Then, a detail structure of the current source circuit 102*a* will be described by use of FIG. 2B. The current source circuit 102*a* has a current source transistor 112 and a current source capacitance 111. In addition, it is possible to omit the current source capacitance 111 by use of a gate capacitance etc. of the current source transistor 112. The gate capacitance is assumed to be a capacitance which is formed between a gate and a channel of a transistor. A drain current of the current source transistor 112 becomes an output current of the current source circuit 102*a*. The current source capacitance 111 retains a gate electric potential of the current source transistor 112.

One of a source terminal and a drain terminal of the current source transistor 112 is electrically connected to a terminal A, and other is electrically connected to a terminal B. Also, a gate electrode of the current source transistor 112 is electrically connected to one electrode of the current source capacitance 111. Other electrode of the current source capacitance 111 is electrically connected to a terminal A'. In addition, the current source transistor 112 which configures the current source circuit 102*a* may be of N channel type or of P channel type.

In case that a P channel type transistor is used as the current source transistor 112, its source terminal is electrically connected to the terminal A, and its drain terminal is electrically connected to the terminal B. Also, in order to maintain a voltage between a gate and a source of the current source transistor 112, it is desirable that the terminal A' is electrically connected to the source terminal of the current source transistor 112. Thus, it is desirable that the terminal A' is electrically connected to the terminal A.

On one hand, in case that an N channel type transistor is used as the current source transistor 112, the drain terminal of the current source terminal 112 is electrically connected to the terminal A, and the source terminal is electrically connected to the terminal B. Also, in order to maintain the voltage between the gate and the source of the current source transistor 112, it is desirable that the terminal A' is electrically connected to the source terminal of the current source transistor 112. Thus, it is desirable that the terminal A' is electrically connected to the terminal B.

In addition, in case that the P channel type transistor is used as the current source transistor 112, and again, in case that the N channel type transistor is used as the same, it is fine if the terminal A' is connected so that the electric potential of the gate electrode of the current source transistor 112 can be maintained. Thus, it may be fine even if the terminal A' is connected to a wiring which is maintained at a constant electric potential at least during a predetermined period. The predetermined period here means a period in which the current source circuit outputs a current, and a period in which the control current defining the current which is outputted by the current source circuit is inputted to the current source circuit.

In addition, in the embodiment 1, a case that the P channel type transistor is used as the current source transistor 112 will be described.

Subsequently, the switch part 101*a* will be described by use of FIG. 2A. The switch part 101*a* has a terminal C and a terminal D. The conductive state or the non conductive state between the terminal C and the terminal D is selected by the digital video signal. By selecting the conductive state or the non conductive state between the terminal C and the terminal D by the digital video signal, the current flowing through the light emitting element 106 is made to be changed. Here, to turn on the switch part 101*a* means to select the conductive state between the terminal C and the terminal D. To turn off the switch part 101*a* means to select the non conductive state between the terminal C and the terminal D. Then, a detail structure of the switch part 101*a* will be described by use of FIG. 2C. The switch part 101*a* has a first switch 181, a second switch 182 and a holding unit 183.

Figure 2C:
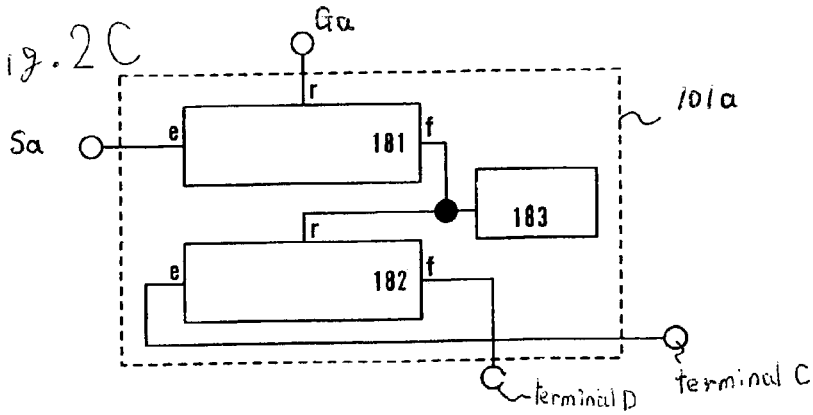

In FIG. 2C, the first switch 181 has a control terminal r, a terminal e, and a terminal f. In the first switch 181, by a signal which is inputted to the control terminal r, the conductive state of the non conductive state between the terminal e and the terminal f is selected. Here, a case that the terminal e and the terminal f are turned in the conductive state is called as that the first switch 181 is turned on. Also, a case that the terminal e and the terminal f are turned in the non conductive state is called as that the first switch 181 is turned off. The same is applied to the second switch 182.

The first switch 181 controls an input of the digital video signal to the pixel. In short, by inputting a signal on the scanning line Ga to the control terminal r of the first switch 181, on or off of the first switch 181 is selected.

When the first switch 181 is turned on, the digital video signal is inputted from a video signal input line Sa to the pixel. The digital video signal inputted to the pixel is held in the holding unit 183. In addition, it is possible to omit the holding unit 183 by utilizing a gate capacitance etc. of a transistor which configures the second switch 182. Also, the digital video signal inputted to the pixel is inputted to the control terminal r of the second switch 182. In this manner, on or off of the second switch 182 is selected. When the second switch 182 is turned on, the terminal C and the terminal D are turned in the conductive state, and a current is supplied from the current source circuit 102*a* to the light emitting element 106. Even after the first switch 181 was turned off, the digital video signal continues to be held in the holding unit 183, and the on state of the second switch 182 is maintained.

Then, a structure of the light emitting element 106 will be described. The light emitting element 106 has two electrodes (anode and cathode). The light emitting element 106 emits light with luminance corresponding to a current flowing between the two electrodes. Out of the two electrodes of the light emitting element 106, one is electrically connected to a power supply reference line (not shown). An electrode to which an electric potential $V_{com}$ is given by the power supply reference line is called as an opposed electrode 106*b*, and other electrode is called as a pixel electrode 106*a*.

As the light emitting element, an EL element which utilized Electro-Luminescence has been watched. The EL element is of a structure having an anode, a cathode, and an EL layer sandwiched between the anode and the cathode. By applying a voltage between the anode and the cathode, the EL element emits light. The EL layer may be formed by an organic material, or may be formed by an inorganic material. Also, it may be formed by both of the organic material and the inorganic material. Also, it is assumed that the EL element includes one or both of an element utilizing light emission (fluorescence) from a singlet excitation and an element utilizing light emission (phosphorescence) from a triplet excitation.

Subsequently, a connecting relation of structural components of the pixel will be described by use of FIG. 2A. Again, the pair of the switch part 101*a* and the current source circuit 102*a* will be watched. The terminal A is electrically connected to the power supply line W, and the terminal B is electrically connected to the terminal C, and the terminal D is electrically connected to the pixel electrode 106*a* of the light emitting element 106. Through the light emitting element, a current flows in a direction from the pixel electrode 106*a* to the opposed electrode 106*b*. The pixel electrode 106*a* is the anode, and the opposed electrode 106*b* is the cathode. An electric potential of the power supply line W is set to be higher than the electric potential $V_{com}$.

In addition, the connecting relation of the structural components of the pixel is not limited to the structure shown in FIG. 2A. It is fine if the switch part 101*a* and the current source circuit 102*a* are serially connected. Also, it is fine even if it is configured that the anode and the cathode of the light emitting element 106 are reversed. In short, it is fine even if it is configured that the pixel electrode 106*a* becomes the cathode and the opposed electrode 106*b* becomes the anode. In addition, since it was defined that the positive current flows from the terminal A to the terminal B, in such the structure that the pixel electrode 106*a* becomes the cathode and the opposed electrode 106*b* becomes the anode, realized is such a structure that the terminal A is counterchanged with the terminal B. That is, realized is such a structure that the terminal A is electrically connected to the terminal C of the switch part 101*a* and the terminal B is electrically connected to the power supply line W. An electric potential of the power supply line W is set to be lower than the electric potential $V_{com}$.

In addition, in this embodiment, two pairs of a switch part and a current source circuit are disposed in each pixel. A structure of each pair of a switch part and a current source circuit is as described above though, there is a necessity of considering the following point as to a connection of these pairs. It is a point that summation of currents supplied from the respective current source circuits of the current source circuit 102*a* and the current source circuit 102*b* is made to be inputted to the light emitting element, in short, a point that the two pairs of a switch part and a current source circuit are connected in parallel with each other and further serially connected to the light emitting element. In addition, it is desirable that a direction of current flow of the current source circuit 102*a* is the same as a direction of current flow of the current source circuit 102*b*. In short, it is desirable that addition of a positive current flowing through the current source circuit 102*a* and a positive current flowing through the current source circuit 102*b* flows through the light emitting element. By doing this, it is possible to carry out the same operation as a digital/analog conversion in the pixel.

Then, an outline of the operation of the pixel will be described. The conductive state or the non conductive state between the terminal C and the terminal D is selected by the digital video signal. The current source circuit is set to have a constant current flowed. A current supplied from the current source circuit is inputted to the light emitting element through the switch part in which the terminal C and the terminal D are turned in the conductive state. In addition, one digital video signal controls one switch part. Accordingly, since plural pairs have plural switch parts, plural the switch parts are controlled by the corresponding digital video signals. A value of the current flowing through the light emitting element differs depending upon which switch part out of a plurality of the switch parts is turned on. In this manner, by changing the current flowing through the light emitting element, gray scale is expressed and the image display is carried out.

Subsequently, the above-described operation of the pixel will be described in more detail. In the description, the pair of the switch part 101*a* and the current source circuit 102*a* is picked up as an example, and its operation will be described.

Firstly, an operation of the switch part 101*a* will be described. To the switch part 101*a*, a row selection signal is inputted from the scanning line Ga. A row selection signal is a signal for controlling a timing that the digital video signal is inputted to the pixel. Also, when the scanning line Ga is selected, the digital video signal is inputted to the pixel from the video signal input line Sa. In short, through the first switch 181 which was turned in the on state, the digital video signal is inputted to the second switch 182. The on state or the off state of the second switch 182 is selected by the digital video signal. Also, since the digital video signal is held in the holding unit 183, the on state or the off state of the second switch 182 is maintained.

The, an operation of the current source circuit 102*a* will be described. In particular, the operation of the current source circuit 102*a* on the occasion that the control signal was inputted will be described. By the control signal, a drain current of the current source transistor 112 is determined. A gate voltage of the current source transistor 112 is held by the current source capacitance 111. The current source transistor 112 operates in the saturation region. A drain current of a transistor which operates in the saturation region is maintained to be constant even if a voltage between a drain and a source is changed, provided that a gate voltage is the same. Accordingly, the current source transistor 112 outputs a constant current. In this manner, the current source circuit 102*a* has a constant current determined by the control signal flowed. A constant output current of the current source 102*a* is inputted to the light emitting element. After the setting operation of the pixel was once carried out, the setting operation of the pixel is repeated in response to discharge of the current source capacitance 111.

An operation of each plural pairs of a switch part and a current source circuit is as described above. In addition, in the display apparatus of the invention, the digital video signal inputted to the switch part of each plural pairs of a switch part and a current source circuit that the pixel has may be the same, or may be different. Also, the control signal inputted to the current source circuit of each plural pairs of a switch part and a current source circuit that the pixel has may be the same, or may be different.

Embodiment 2

This embodiment shows a concrete structural example of the switch part of each plural pairs of a switch part and a current source circuit that the pixel has in the display apparatus of the invention. Also, an operation of the pixel which has the switch part will be described.

Figure 3:
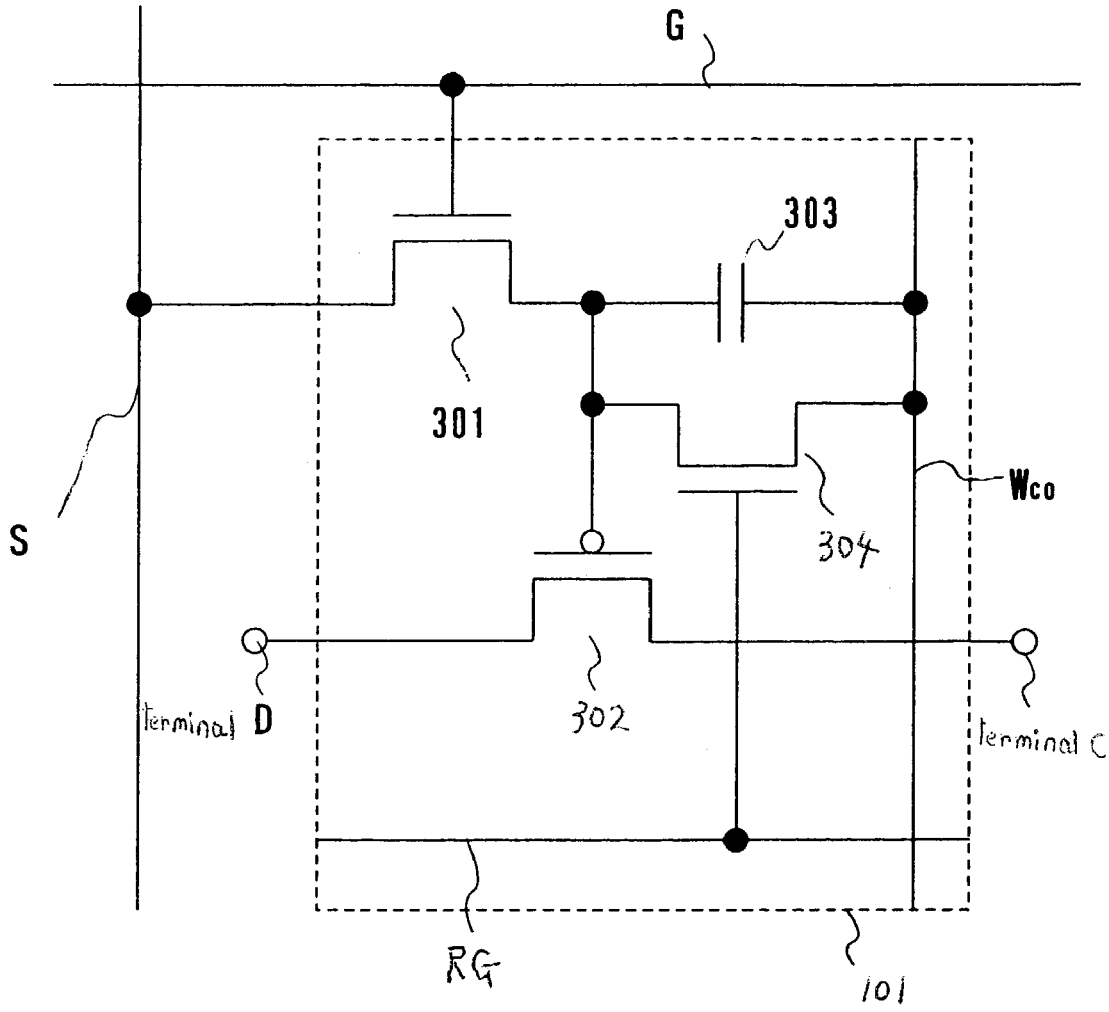
FIG. 3 is a view showing a structure of a switch part of the pixel of the display apparatus of the invention.

A structural example of the switch part is shown in FIG. 3. A switch part 101 has a selection transistor 301, a drive transistor 302, a deletion transistor 304, and a holding capacitance 303. In addition, it is possible to omit the holding capacitance 303 by using a gate capacitance etc. of the drive transistor 302. A transistor which configures the switch part 101 may be a single crystalline transistor, or a polycrystalline transistor, or an amorphous transistor. Also, it may be a SOI transistor. It may be a bipolar transistor. It may be a transistor which used an organic material, for example, a carbon nanotube.

A gate electrode of the selection transistor 301 is connected to a scanning line G. One of a source terminal and a drain terminal of the selection transistor 301 is connected to a video signal input line S, and the other is connected to a gate electrode of the drive transistor 302. One of a source terminal and a drain terminal of the drive transistor 302 is connected to the terminal C. The other is connected to the terminal D. One electrode of the holding capacitance 303 is connected to the gate electrode of the drive transistor 302, and the other electrode is connected to a wiring $W_{co}$. In addition, it is fine if the holding capacitance 303 can keep a gate electric potential of the drive transistor 302. Thus, an electrode which was connected to the wiring $W_{co}$ out of the electrodes of the holding capacitance 303 in FIG. 3 may be connected to other wiring in which a voltage is constant for at least a certain period than the wiring $W_{co}$. A gate electrode of the deletion transistor 304 is connected to a deletion use signal line RG. One of a source terminal and a drain terminal of the deletion transistor 304 is connected to the gate electrode of the drive transistor 302, and the other is connected to the wiring $W_{co}$. In addition, since it is fine if, by having the deletion transistor 304 turned on, the drive transistor 302 is turned off, there is no problem when connected to one other than the wiring $W_{co}$.

Then, a basic operation of this switch part 101 will be described with reference to FIG. 3. When the selection transistor 301 is turned in the on state by the row selection signal inputted to the scanning line G in a state that the deletion transistor 304 is not conductive, the digital video signal is inputted from the video signal input line S to the gate electrode of the drive transistor 302. The voltage of the inputted digital video signal is held capacitance 303. By the inputted digital video signal, the one state or the off state of the drive transistor 302 is selected, and the conductive state or the non conductive state between the terminal C and the terminal D of the switch part 101 is selected. Next, when the deletion transistor 304 is turned on, electric charges held in the holding in the holding capacitance 303 are discharged, and the drive transistor 302 is turned in the off state, and the terminal C and the terminal D of the switch part 101 are turned in the non conductive state. In addition, in the above-described operation, the selection transistor 301, the drive transistor 302 and the deletion transistor 304 work as simple switches. Thus, these transistors operate in the linear region in their on states.

In addition, the drive transistor 302 may be operated in the saturation region. By operating the drive transistor 302 in the saturation region, it is possible to compensate a saturation region characteristic of the current source transistor 112. Here, the saturation region characteristic is assumed to indicate a characteristic in which a drain current is maintained to be constant to a voltage between a source and a drain. Also, to compensate the saturation region characteristic means to suppress increase of the drain current as the voltage between the source and the drain increases, in the current source transistor 112 which operates in the saturation region. In addition, in order to obtain the above-described advantages, the drive transistor 302 and the current source transistor 112 have to be of the same polarity.

The above-described advantages for compensating the saturation region characteristic will be hereinafter described. For example, a case that the voltage between the source and the drain of the current source transistor 112 increases will be watched. The current source transistor 112 and the drive transistor 302 are serially connected. Thus, by change of the voltage between the source and the drain of the current source transistor 112, an electric potential of the source terminal of the drive transistor 302 changes. By this means, an absolute value of the voltage between the source and the drain of the drive transistor 302 gets smaller. Then, the I-V curve of the drive transistor 302 changes. A direction of this change is such a direction that the drain current decreases. By this means, reduced is the drain current of the current source transistor 112 which was serially connected to the drive transistor 302. In the same manner, when the voltage between the source and the drain of the current source transistor decreases, the drain current of the current source transistor increases. By this means, it is possible to obtain the advantage that a current flowing through the current source transistor is maintained to be constant.

In addition, watching one pair of a switch part and a current source circuit of the switch part, its basic operation was described though, the same is true on an operation of other switch part. In case that each pixel has a plurality of pairs of a switch part and a current source circuit, the scanning line and the video signal input line are disposed depending on respective pairs.

Next, a technique of gray scale display will be described. In the display apparatus of the invention, expression of gray scale is carried out by on-off control of the switch part. For example, by setting a ratio of magnitude of the currents to be outputted by a plurality of the current source circuit that each pixel has at $2^0:2^1:2^2:2^3:\ldots$, it is possible to have the pixel had a role of D/A conversion, and it becomes possible to express multiple gray scale. Here, if enough number of the pair of the switch part and the current source circuit is provided in one pixel, it is possible to sufficiently express the gray scale by only control by them. In that case, since there is no necessity that an operation combined with the temporal gray scale system which will be described later is carried out, it is fine even if the deletion transistor is not disposed in each switch part.

Then, combining the above-described gray scale display technique with the temporal gray scale system, a technique for further making the multiple gray scale will be described by use of FIGS. 3 and 4.

Figure 4:
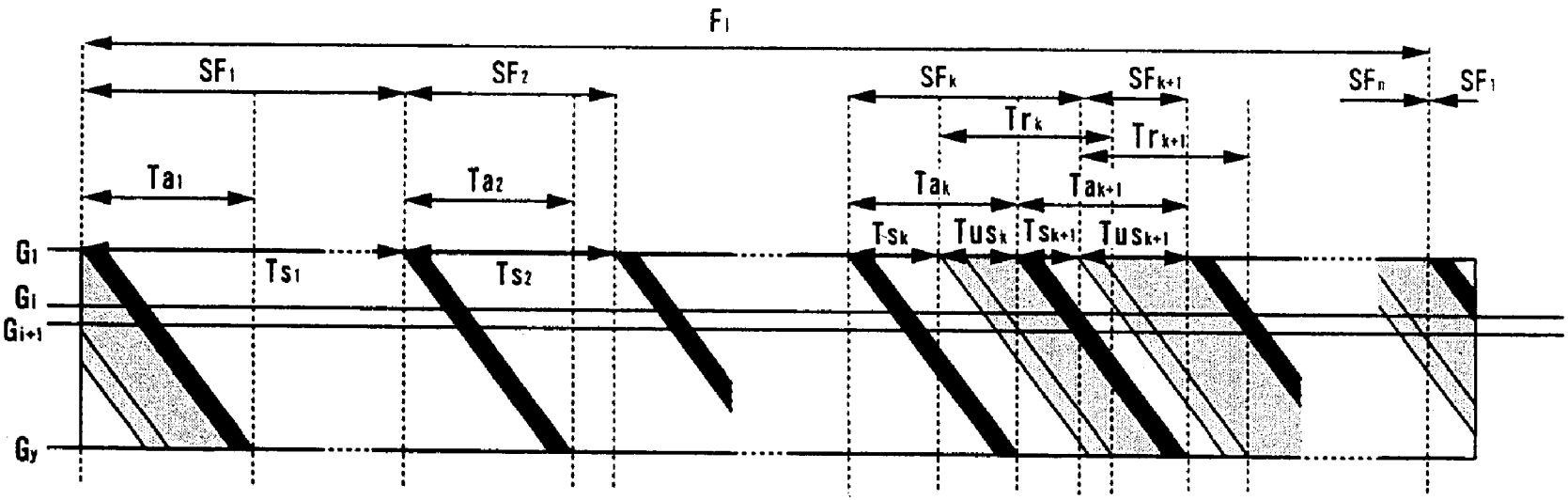
FIG. 4 is a view showing a driving method of the display apparatus of the invention.

As shown in FIG. 4, one frame period F is divided into a first sub frame period $SF_1$ to a n-th sub frame period $SF_n$. In each sub frame period, the scanning line G of each pixel is selected in sequence. In the pixel corresponding to the selected scanning line G, the digital video signal is inputted from the video signal input line S. Here, a period in which the digital video signal is inputted to all pixels that the display apparatus has is represented as an address period Ta. In particular, an address period which corresponds to a k-th (k is a natural number less than n) sub frame period is represented as $Ta_k$. By the digital video signal inputted in the address period, each pixel is turned in the light emission state or the non light emission state. This period is represented as a display period Ts. In particular, a display period which corresponds to the k-th sub frame period is represented as $Ts_k$. In FIG. 4, in each of the first sub frame period $SF_1$ to the (k−1)-th sub frame period $SF_{k-1}$, the address period and the display period are provided.

Since it is impossible to select the scanning lines G of different pixel rows simultaneously and to input the digital video signal thereto, it is impossible to geminate the address periods. Then, by using the following technique, it becomes possible to make the display period shorter than the address period without geminating the address periods.

After the digital video signal was written into each pixel and a predetermined display period passed off, the deletion use signal line RG is selected in sequence. A signal for selecting the deletion use signal line is called as a deletion use signal. When the deletion transistor 304 is turned on by the deletion use signal, it is possible to have each pixel row turned in the non light emission state in sequence. By this means, all deletion use signal lines RG are selected, and a period up to time when all pixels are turned in the non light emission state is represented as a reset period Tr. In particular, a reset period which corresponds to the k-th sub frame period is represented as $Tr_k$. Also, a period in which the pixels are uniformly turned in non light emission after the reset period Tr is represented as a non display period Tus. In particular, the non display period which corresponds to the k-th sub frame period is represented as $Tus_k$. By disposing the reset period and the non display period, it is possible to have the pixel turned in the non light emission state before a next sub frame period starts. By this means, it is possible to set the display period which is shorter than the address period. In FIG. 4, in the k-th sub frame period $SF_k$ to the n-th sub frame period $SF_n$, the reset period and the non display period are disposed, and the display periods $Ts_k$ to $Ts_n$ which are shorter than the address periods are set. Here, a length of the display period of each sub frame period can be determined properly.

By this means, set is the length of the display period in each sub frame period which configures one frame period. In this manner, the display apparatus of the invention can realize the multiple gray scale by the combination with the temporal gray scale system.

Then, as compared to the switch part shown in FIG. 3, a structure that a way of allocating the deletion transistor 304 is different, and a structure that the deletion transistor 304 is not disposed will be described. The same reference numerals and signs are given to the same portion as in FIG. 3, and the description thereof will be omitted.

Figure 5A:
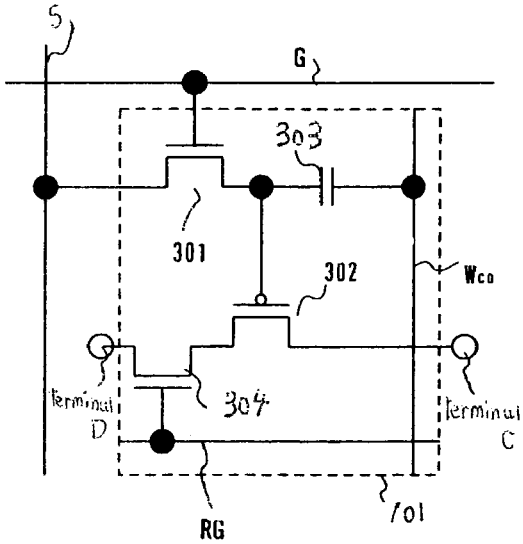
FIGS. 5A–D are views showing structures of the switch part of the pixel of the display apparatus of the invention.
Figure 35:
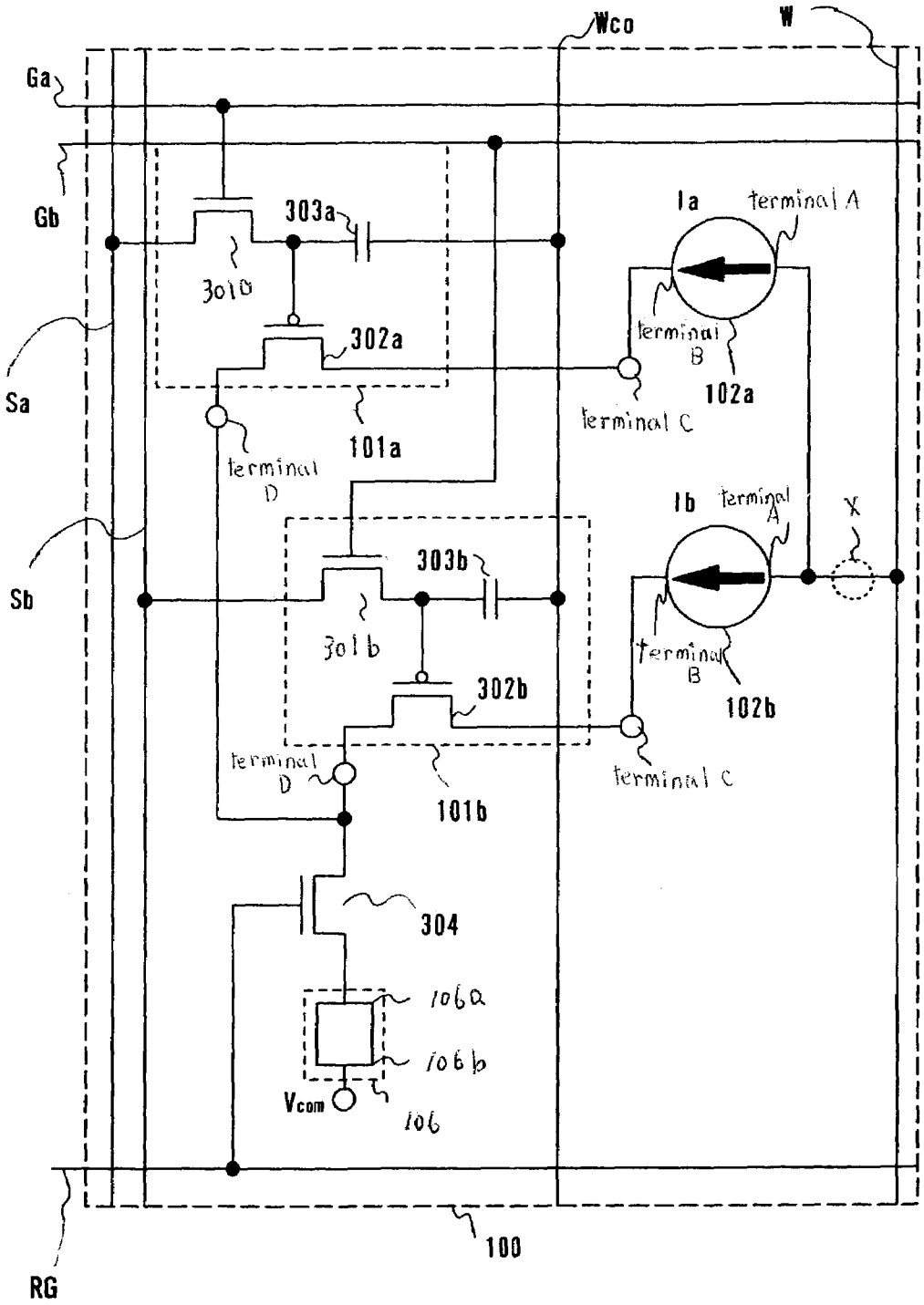
FIG. 35 is a view showing a structure of the pixel of the display apparatus of the invention.

FIG. 5A shows one example of the switch part. In FIG. 5A, it is designed such that the deletion transistor 304 is serially placed on a path through which a current is inputted to the light emitting element, and by turning off the deletion transistor 304, the current is prevented from flowing through the light emitting element. In addition, if the deletion transistor 304 is serially placed on the path through which the current is inputted to the light emitting element, the deletion transistor 304 may be placed anywhere. By turning the deletion transistor in the off state, it is possible to have the pixels turned uniformly in the non light emission state. By this means, it is possible to set the reset period and the non display period. In addition, in case of the switch part of the structure shown in FIG. 5A, without disposing the deletion transistor 304 to respective switch parts of a plurality of the pairs of a switch part and a current source circuit that the pixel has, it is possible to dispose them in a lump. By this means, it is possible to suppress the number of transistors in the pixel. FIG. 35 shows a structure of the pixel in case that the deletion transistor 304 is shared with a plurality of the pairs of a switch part and a current source circuit. In addition, here, an example of the pixel which has two pairs of a switch part and a current source circuit will be described but the invention is not limited to this. In FIG. 35, the same reference numerals and signs are given to the same portions as in FIGS. 2A and 3. In addition, a portion which corresponds to the switch portion 101*a* is represented by adding a after the reference numerals of FIG. 3. Also, a portion which corresponds to the switch portion 101*b* is represented by adding b after the reference numerals of FIG. 3. In FIG. 35, by turning off the deletion transistor 304, it is possible to simultaneously shut off both of the currents which are outputted from the current source circuit 102*a* and the current source circuit 102*b*.

In addition, the deletion transistor 304 which was shared with a plurality of the switch parts may be placed on a path for connecting the power supply line W and the current source circuits 102*a* and 102*b*. In short, the power supply line W and the current source circuits 102*a* and 102*b* may be connected through the deletion transistor 304 which was shared with a plurality of the switch parts. The deletion transistor 304 which was shared with a plurality of the switch parts may be disposed anywhere, if it is a position where both of the currents which are outputted from the current source circuit 102*a* and the current source circuit 102*b* are simultaneously shut off. For example, the deletion transistor 304 may be placed at a portion of a path X in FIG. 35. In short, it is fine if it is configured such that the power supply line W and the terminal A of the current source circuit 102*a* and the terminal A of the current source circuit 102*b* are connected by the deletion transistor 304.

Figure 5B:
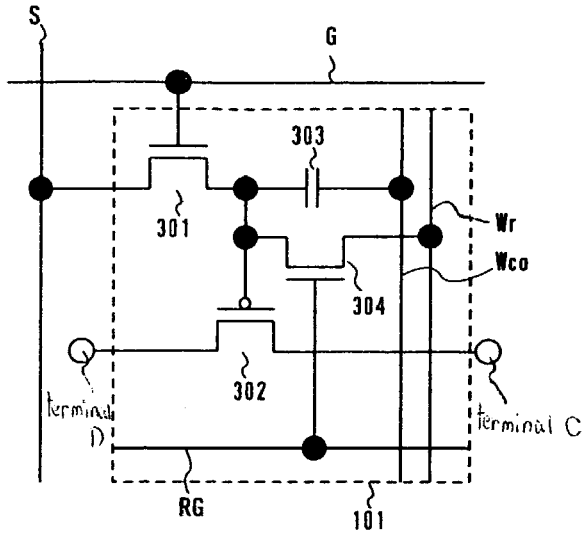

FIG. 5B shows another structure of the switch part. In FIG. 5B shows a technique in which, through between the source and drain terminals of the deletion transistor 304, a predetermined voltage is applied to the gate electrode of the drive transistor 302 so that the drive transistor is turned in the off state. In this example, one of the source terminal and the drain terminal of the deletion transistor 304 is connected to the gate electrode of the drive transistor, and the other is connected to the wiring Wr. The electric potential of the wiring Wr is determined properly. By this means, it is designed that the drive transistor, to the gate electrode of which the electric potential of the wiring Wr is inputted through the deletion transistor, is turned in the off state.

Figure 5C:
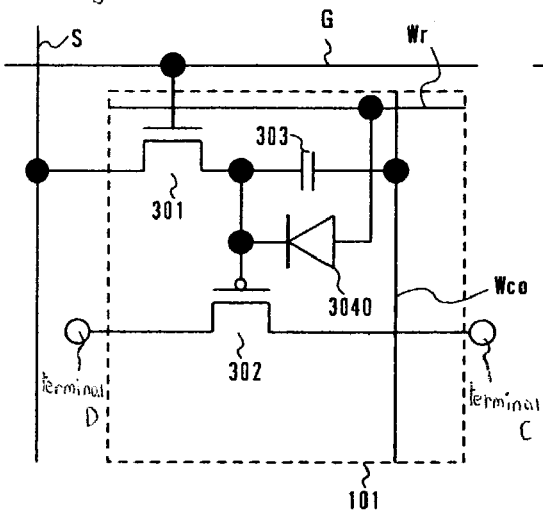

Also, in the structure shown in FIG. 5B, in lieu of the deletion transistor 304, a diode may be used. This structure is shown in FIG. 5C. The electric potential of the wiring Wr is changed. By this means, an electric potential of the electrode at the side which is not connected to the gate electrode of the drive transistor 302 out of the two electrode of a diode 3040, is changed. By this means, the gate voltage of the drive transistor is changed and it is possible to have the drive transistor turned in the off state. In addition, the diode 3040 may be substituted with a diode-connected (a gate electrode and a drain terminal are electrically connected) transistor. On this occasion, the transistor may be an N-channel type transistor or a P-channel type transistor.

Figure 5D:
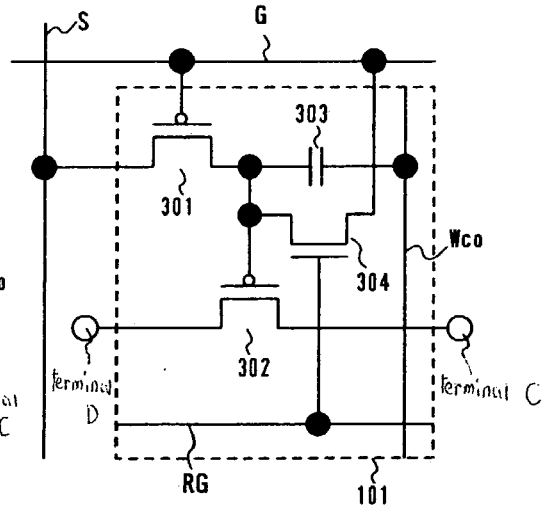

In addition, in lieu of the wiring Wr, the scanning line G may be used. FIG. 5D shows a structure that the scanning line G is used in lieu of the wiring Wr shown in FIG. 5B. But, in this case, there is a necessity to pay attention to a polarity of the selection transistor 301, taking the electric potential of the scanning line G into consideration.

Then, a technique in which the reset period and the non display period are disposed without disposing the deletion transistor will be described.

Figure 6A:
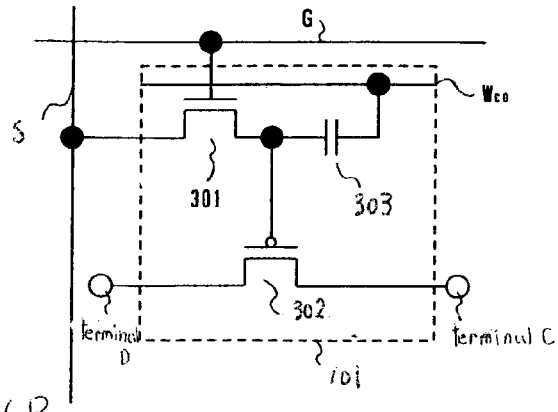
FIGS. 6A–C are views showing the structures of the switch part of the pixel and a driving method of the display apparatus of the invention.

A first technique is a technique in which, by changing an electric potential of an electrode of the holding capacitance 303 at the side which is not connected to the gate electrode of the drive transistor 302, the drive transistor 302 is turned in the non conductive state. This structure is shown in FIG. 6A. The electrode of the holding capacitance 303 at the side which is not connected to the gate electrode of the drive transistor 302 is connected to the wiring $W_{co}$. By changing a signal of the wiring $W_{co}$, the electric potential of one electrode of the holding capacitance 303 is changed. Then, since electric charges held in the holding capacitance is stored, an electric potential of the other electrode of the holding capacitance 303 is also changed. By this means, by changing the electric potential of the gate electrode of the drive transistor 302, it is possible to have the drive transistor 302 turned in the off state.

A second technique will be described. A period, in which one scanning line G is selected, is divided into a first half and a second half. It is characterized in that, in the first half (represented as a gate selection period first half), the digital video signal is inputted to the video signal input line S, and in the second half (represented as a gate selection period second half), the deletion use signal is inputted to the video signal input line S. The deletion use signal in this technique is assumed to be a signal for having the drive transistor 302 turned in the off state, on the occasion of being inputted to the gate electrode of the drive transistor 302. By this means, it becomes possible to set the display period which is shorter than a writing period. Hereinafter, this second technique will be described in detail.

Figure 6B:
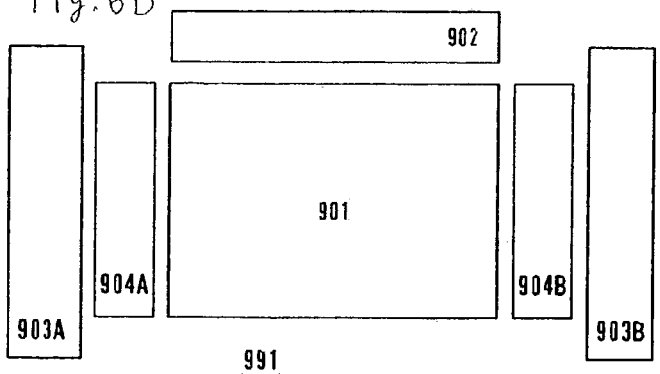

Firstly, a structure of the entire display apparatus on the occasion of using the above-described technique will be described. FIG. 6B is used for the description. The display apparatus has a pixel part 901 which has a plurality of pixels arranged in a matrix shape, a video signal input line drive circuit 902 which inputs a signal to the pixel part 901, a first scanning line drive circuit 903A, a second scanning line drive circuit 903B, a switching circuit 904A and a switching circuit 904B. Each pixel, which the pixel part 901 has, has a plurality of the switch parts 101 and the current source circuits as shown in FIG. 6A. Here, the first scanning line drive circuit 903A is assumed to be a circuit which outputs a signal to each scanning line G in the gate selection period first half. Also, the second scanning line drive circuit 903B is assumed to be a circuit which outputs a signal to each scanning line G in the gate selection period second half. By the switching circuit 904A and the switching circuit 904B, a connection of the first scanning line drive circuit 903A and the scanning line G of each pixel, or a connection of the second scanning line drive circuit 903B and the scanning line G of each pixel is selected. The video signal input line drive circuit 902 outputs the video signal in the gate selection period first half. On one hand, it outputs the deletion use signal in the gate selection period second half.

Figure 6C:
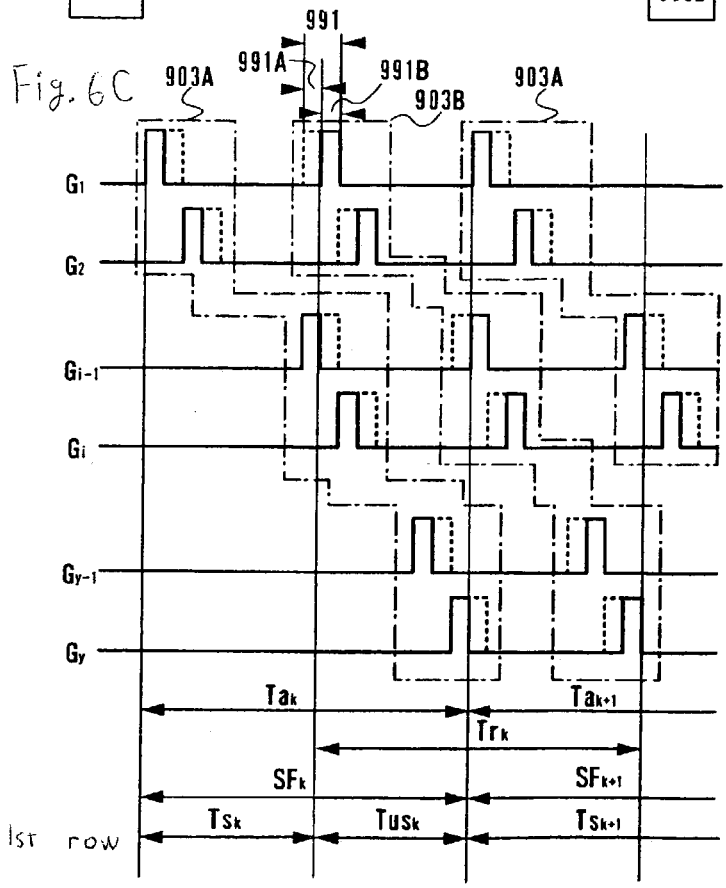

Then, a driving method of the display apparatus of the above-described structure will be described. A timing chart of FIG. 6C is used for the description. In addition, the same reference numerals and signs are given to the same portions as FIG. 4, and descriptions thereof will be omitted. In FIG. 6C, a gate selection period 991 is divided into a gate selection period first half 991A and a gate selection period second half 991B. In 903A which is comparable to the writing period Ta, each scanning line is selected by the first scanning line drive circuit, and the digital video signal is inputted. In 903B which is comparable to the reset period Tr, each scanning line is selected by the second scanning line drive circuit, and the deletion use signal is inputted. By this means, it is possible to set the display period Ts which is shorter than the address period Ta.

In addition, in FIG. 6C, the deletion use signal was inputted in the gate selection period second half but, instead of it, the digital video signal in the next sub frame period may be inputted.

A third technique will be described. The third technique is a technique in which, by changing an electric potential of the opposed electrode of the light emitting element, a non display period is disposed. In short, the display period is set in such a manner that the electric potential of the opposed electrode has a predetermined deference of electric potentials between it and the electric potential of the power supply line. On one hand, in the non display period, the electric potential of the opposed electrode is set to be substantially the same as the electric potential of the power supply line. By this means, in the non display period, regardless of the digital video signal held in the pixel, it is possible to have the pixels turned uniformly in the non light emission state. In addition, in this technique, in the non display period, the digital video signal is inputted to all pixels. That is, the address period is disposed in the non display period.

In the pixel having the switch parts of the above-described structure, each wiring can be shared. By this means, it is possible to simplify the structure of the pixel, and also to enlarge an open area ratio of the pixel. Hereinafter, an example of sharing each wiring will be described. In the description, used will be such an example that, in the structure in which the switch part having the structure shown in FIG. 3 was applied to the pixel shown in FIG. 2, the wiring was shared. In addition, the following structure can be freely applied to a switch part having the structure shown in FIGS. 5A–D and FIGS. 6A–C.

Hereinafter, the sharing of the wiring will be described. Six examples of sharing the wiring will be cited. In addition, FIGS. 7A–C and FIGS. 8A–C are used for the description. In FIGS. 7A–C and FIGS. 8A–C, the same reference numerals and signs are given to the same portions as in FIGS. 2A–C and FIG. 3, and the descriptions thereof will be omitted.

Figures 7A, 7B, 7C:
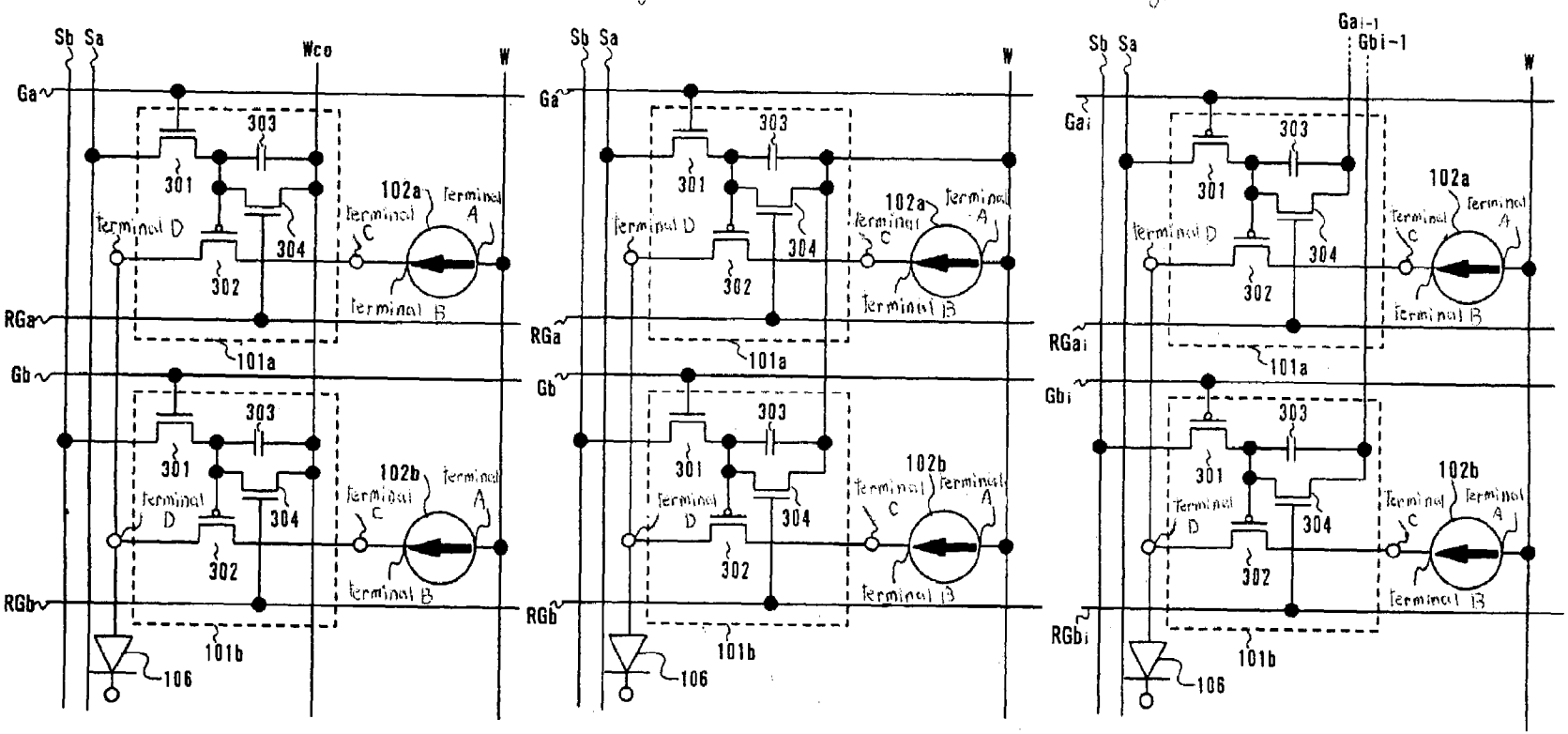
FIGS. 7A–C are views showing structures of the pixel of the display apparatus of the invention.
Figure 8C:
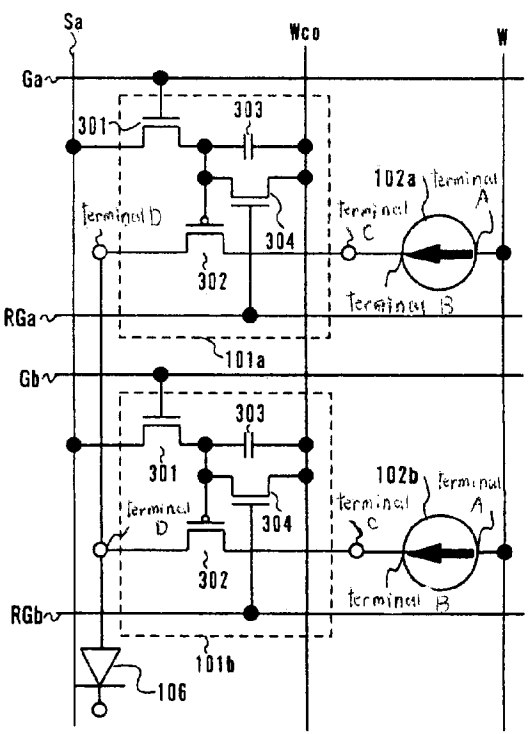
FIGS. 8A–C are views showing structures of the pixel of the display apparatus of the invention.
Figure 8B:
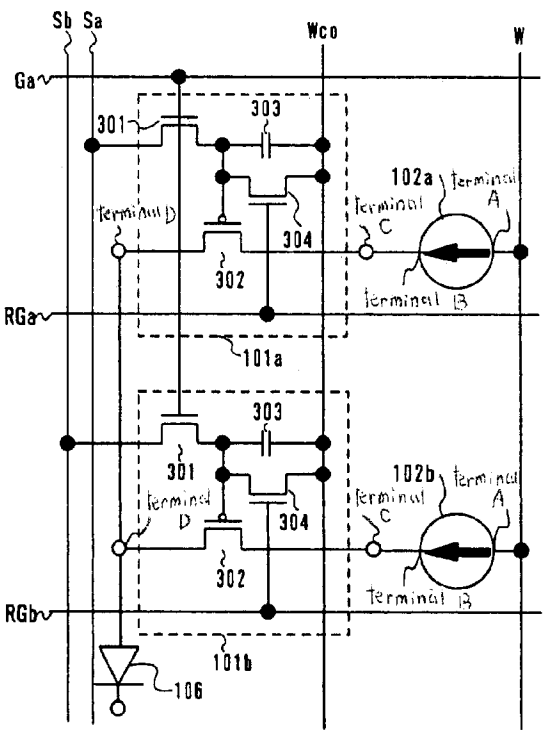
Figure 8A:
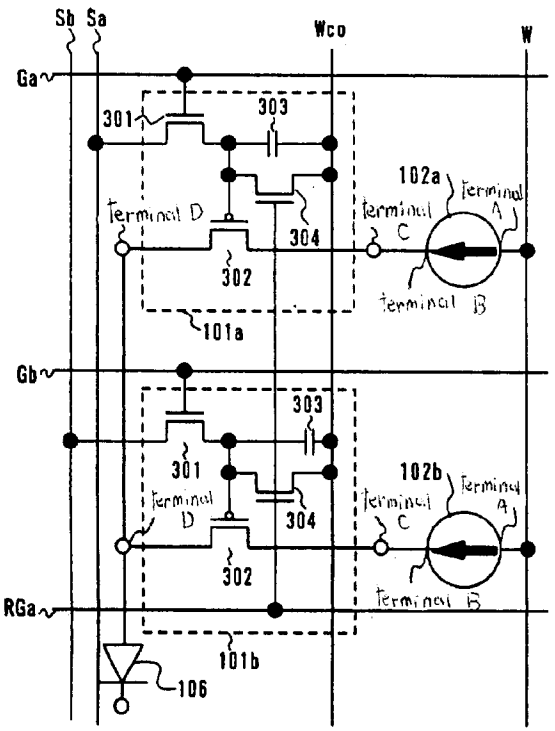

FIG. 7A shows an example of a structure of the pixel which shared the wiring $W_{co}$ of a plurality of the switch parts. FIG. 7B shows an example of a structure of the pixel which shared the wiring $W_{co}$ and the power supply line W. FIG. 7C shows an example of a structure of the pixel which used the scanning line in other pixel row in lieu of the wiring $W_{co}$. The structure of FIG. 7C utilizes a fact that the electric potentials of the scanning lines Ga, Gb are maintained to be constant electric potential, during a period that the writing of the video signal is not carried out. In FIG. 7C, in lieu of the wiring $W_{co}$, the scanning lines $Ga_{i-1}$ in the one previous pixel row are used. But, in this case, there is a necessity to pay attention on the polarity of the selection transistor 301, taking the electric potentials of the scanning lines Ga, Gb into consideration. FIG. 8A shows an example of a structure of the pixel which shared a signal line RGa and a signal line RGb. This is because the first switch part and the second switch part may be turned off at the same time. The shared signal lines are represented by RGa all together. FIG. 8B shows an example of a structure of the pixel which shared the scanning line Ga and the scanning line Gb. The shared scanning lines are represented by Ga all together. FIG. 8C shows an example of a structure of the pixel which shared the video signal input line Sa and the video signal input line Sb. The shared video signal input lines are represented by Sa all togehter.

It is possible to combine FIGS. 7A to 7C with FIGS. 8A to 8C. In addition, the invention is not limited to this, and it is possible to properly share each wiring which configures the pixel. Also, it is possible to properly share each wiring between the pixels.

In addition, it is possible to freely combine this embodiment with the embodiment 1 to be carried out.

Embodiment 3

In this embodiment, a structure and an operation of the current source circuit that each pixel of the display apparatus of the invention has will be described in detail.

The current source circuit of one pair out of a plurality of pairs of a switch part and a current source circuit that each pixel has will be watched, and a structure thereof will be described in detail. In this embodiment, five structural examples of the current source circuit will be cited but, another structural example may be fine if it is a circuit which operates as a current source. In addition, a transistor which configure the current source circuit may be a single crystalline transistor, or a polycrystalline transistor, or an amorphous transistor. Also, it may be a SOI transistor. It may be a bi-polar transistor. It may be a transistor which used an organic material, for example, a carbon nanotube.

Firstly, a current source circuit of a first structure will be described by use of FIG. 9A. In addition, in FIG. 9A, the same reference numerals and signs are given to the same portions as in FIGS. 2A–C.

Figure 9A:
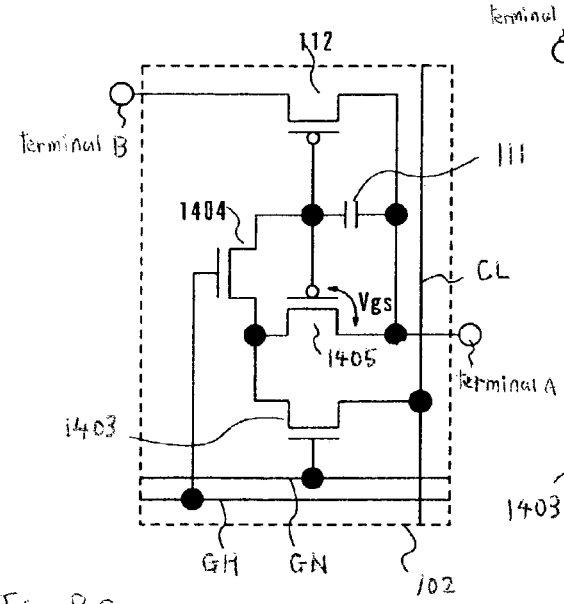
FIGS. 9A–9F are views showing structures and a driving method of a current source circuit of the pixel of the display apparatus of the invention.

The current source circuit of the first structure shown in FIG. 9A has the current source transistor 112, and a current transistor 1405 which is paired with the current source transistor 112 to configures a current mirror circuit. It has a current input transistor 1403 and a current holding transistor 1404 which function as switches. Here, the current source transistor 112, the current transistor 1405, the current input transistor 1403, and the current holding transistor 1404 may be of the P-channel type or of the N-channel type. However, it is desirable that polarities of the current source transistor 112 and the current transistor 1405 are the same. Here, shown is an example that the current source transistor 112 and the current transistor 1405 are P-channel type transistors. Also, it is desirable that current characteristics of the current source transistor 112 and the current transistor 1405 are the same. It has the current source capacitance 111 which holds the gate voltages of the current source transistor 112 and the current transistor 1405. In addition, by positively using a gate capacitance etc. of a transistor, it is possible to omit the current source capacitance 111. Further, it has a signal line GN which inputs a signal to a gate electrode of the current input transistor 1403 and a signal line GH which inputs a signal to a gate electrode of the current holding transistor 1404. Also, it has a current line CL to which the control signal is inputted.

Figure 36:
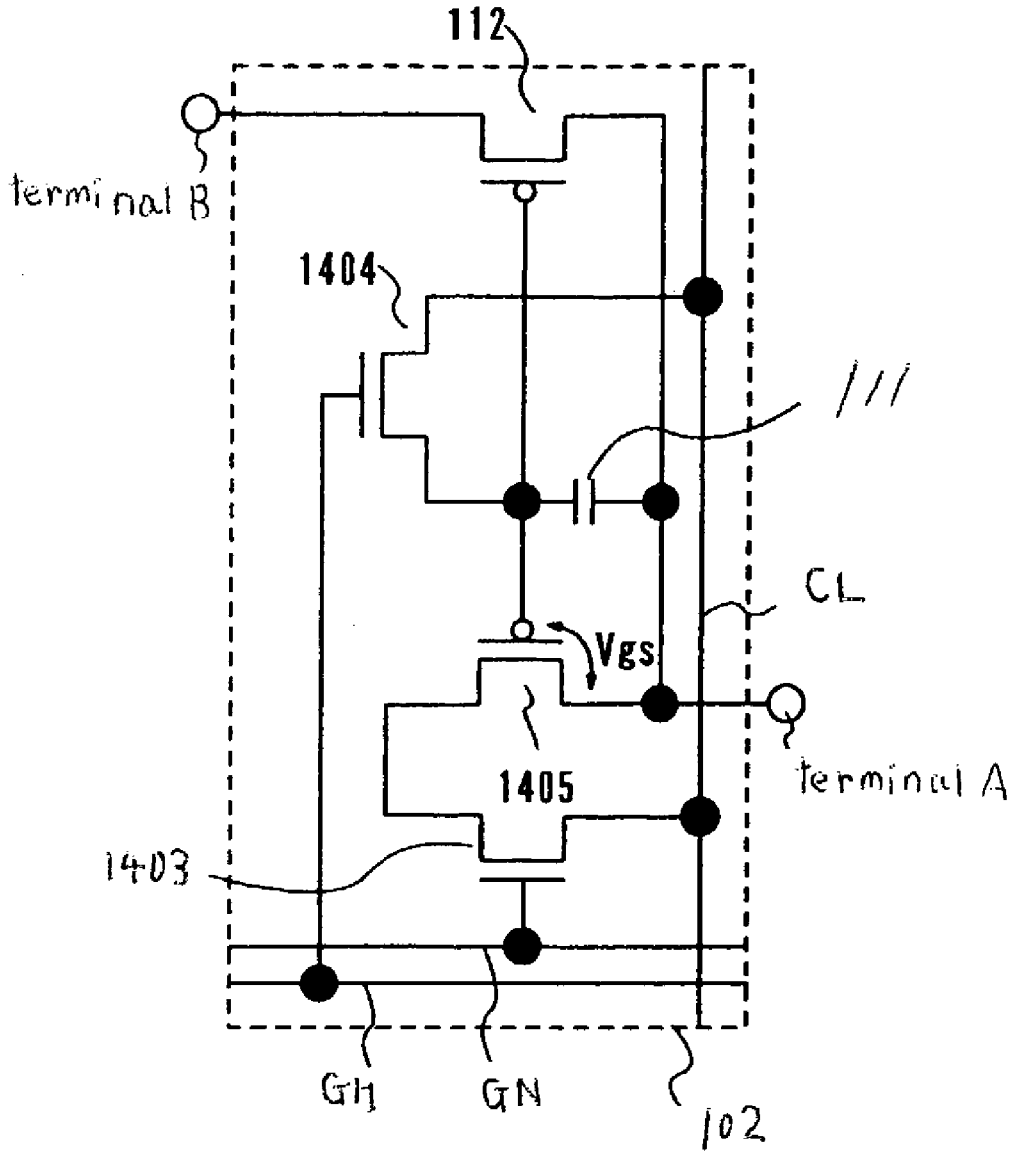
FIG. 36 is a view showing a structure of the current source circuit of the pixel of the display apparatus of the invention.

A connecting relation of these structural components will be described. The gate electrodes of the current source transistor 112 and the current transistor 1405 are connected. The source terminal of the current source transistor 112 is connected to the terminal A and the drain terminal is connected to the terminal B. One electrode of the current source capacitance 111 is connected to the gate electrode of the current source transistor 112, and the other electrode is connected to the terminal A. A source terminal of the current transistor 1405 is connected to the terminal A, and a drain terminal is connected to the current line CL through the current input transistor 1403. Also, a gate electrode and a drain terminal of the current transistor 1405 are connected through the current holding transistor 1404. A source terminal or a drain terminal of the current holding transistor 1404 is connected to the current source capacitance 111 and the drain terminal of the current transistor 1405. However, it may be configured that a side which is one of the source terminal and the drain terminal of the current holding transistor 1404 and is not connected to the current source capacitance 111 is connected to the current line CL. This structure is shown in FIG. 36. In addition, in FIG. 36, the same reference numerals and signs are given to the same portions as in FIG. 9A. With this structure, by adjusting an electric potential of the current line CL when the current holding transistor 1404 is in the off state, it is possible to lessen the voltage between the source and drain terminals of the current holding transistor 1404. As a result, it is possible to lessen a off current of the current holding transistor 1404. By this means, it is possible to lessen a leakage of an electric charge from the current source capacitance 111.

Figure 33A:
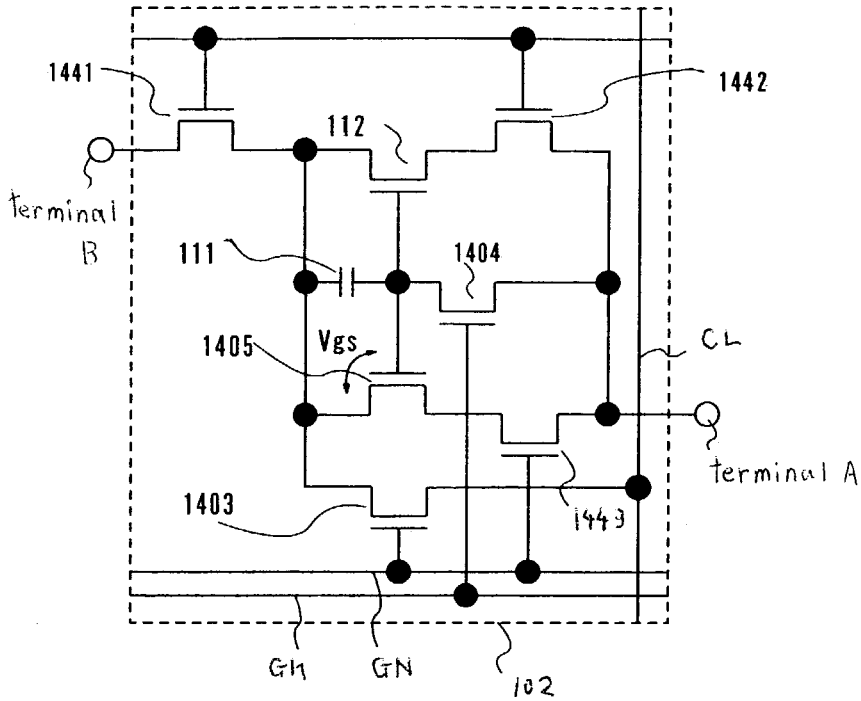
FIG. 33A and FIG. 33B are views showing structures of a current source circuit of the pixel of the display apparatus of the invention.

Also, an example in case that the current source transistor 112 and the current transistor 1405 are set to be N-channel type transistors in the structure of the current source circuit shown in FIG. 9A is shown in FIG. 33A. In addition, in contrast to the current source circuit of the structure shown in FIG. 9A, in the current source circuit of the structure shown in FIG. 33A, there is a necessity to dispose transistors 1441 and 1442, in order to prevent the current flowing between the current line CL and the terminal A through the source and the drain of the current transistor 1405 on the occasion of the setting operation of the current source circuit 102 from flowing between the source and the drain of the current source transistor 112 and through the terminal B. Also, there is a necessity to dispose a transistor 1443, in order to prevent a current from flowing between the source and the drain of the current transistor 1405 on the occasion that a constant current is made to flow between the terminal A and the terminal B in the display operation. By this means, the current source circuit 102 can output a current of a predetermined current value accurately.

Figure 9B:
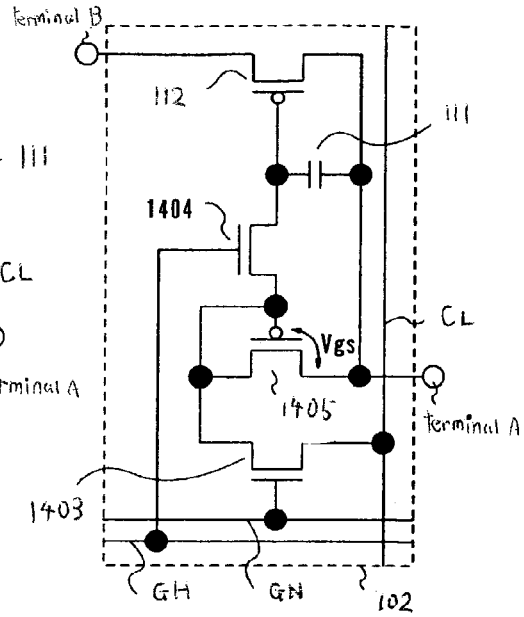

Also, in the circuit of the structure shown in FIG. 9A, it is possible to configure the circuit structure as shown in FIG. 9B, by changing a location of the current holding transistor 1404. In FIG. 9B, the gate electrode of the current transistor 1405 and one electrode of the current source capacitance 111 are connected through the current holding transistor 1404. In this moment, the gate electrode and the drain terminal of the current transistor 1405 are connected by wiring.

Then, the setting operation of the current source circuit of the above-described first structure will be described. In addition, the setting operation in FIG. 9A is the same as that in FIG. 9B. Here, the circuit shown in FIG. 9A is picked up as an example, and its setting operation will be described. FIGS. 9C to 9F are used for the description. In the current source circuit of the first structure, the setting operation is carried out by going through states of FIGS. 9C to 9F in sequence. In the description, for the purpose of simplicity, the current input transistor 1403 and the current holding transistor 1404 are represented as switches. Here, shown is a case that a control signal for setting the current source circuit 102 is the control current. Also, in the figure, a path through which a current flows is shown by a heavy-line arrow.

Figure 9C:
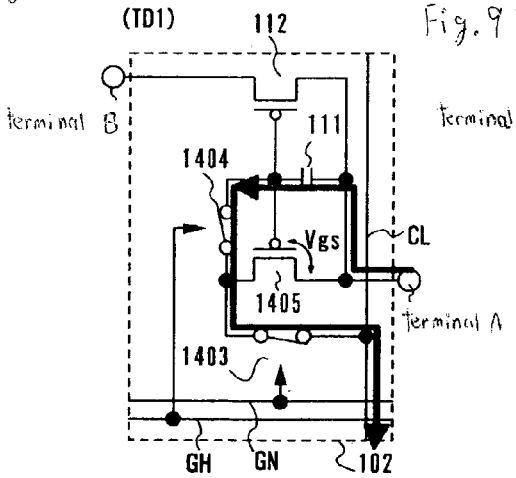

In a period TD1 shown in FIG. 9C, the current input transistor 1403 and the current holding transistor 1404 are turned in the on state. In this stage, the voltage between the source and the gate of the current transistor 1405 is small, and the current transistor 1405 is off, and therefore, a current flows from the current line CL through the path shown and electric charges are held in the current source capacitance 111.

Figure 9D:
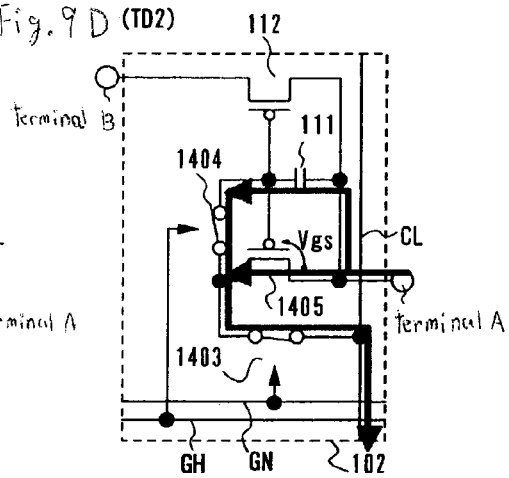

In a period TD2 shown in FIG. 9D, by the electric charges held in the current source capacitance 111, the voltage between the gate and the source of the current transistor 1405 becomes more than a threshold voltage. Then, a current flows through between the source and the drain of the current transistor 1405.

Figure 9E:
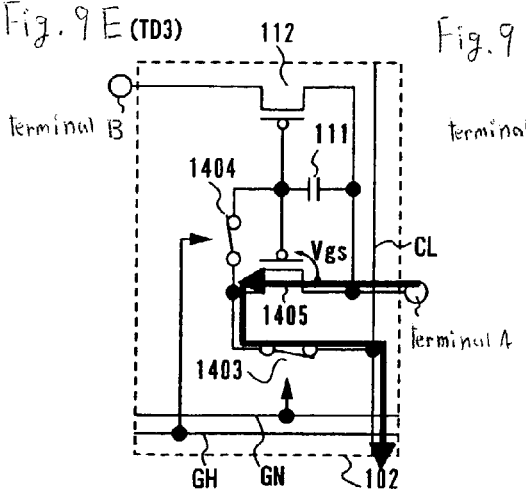

When sufficient time passes and a steady state is realized, as in a period TD3 shown in FIG. 9E, a current flowing between the source and the drain of the current transistor 1405 is determined as the control current. By this means, the gate voltage on the occasion that the drain current is set at the control current is held in the current source capacitance 111.

Figure 9F:
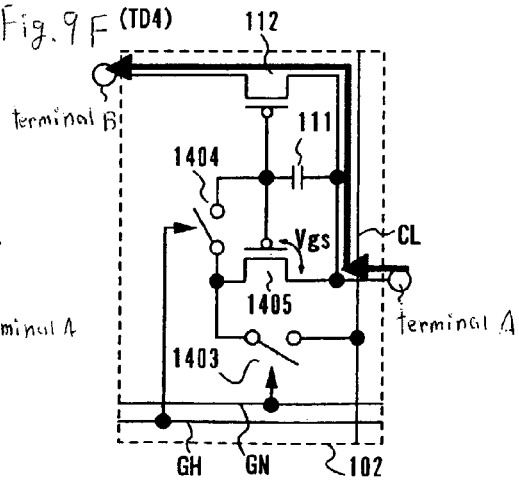

In a period TD4 shown in FIG. 9F, the current holding transistor 1404 and the current input transistor 1403 are turned off. By this means, the control current is prevented from flowing through the pixel. In addition, it is desirable that a timing that the current holding transistor 1404 is turned off, as compared to a timing that the current input transistor 1403 is turned off, is earlier or simultaneous. This is because of preventing the electric charges held in the current source capacitance 111 from being discharged. After the period TD4, when a voltage is applied between the source and drain terminals of the current source transistor 112, the drain current corresponding to the control current flows. In short, when a voltage is applied between the terminal A and the terminal B, the current source circuit 102 outputs a current which corresponds to the control current.

Here, a ratio W1/L1 of a channel width and a channel length of the current source transistor 112 may be changed to a ratio W2/L2 of a channel width and a channel length of the current transistor 1405. By this means, it is possible to change a current value of a current that the current source circuit 102 outputs, to the control current which is inputted to the pixel. For example, each transistor is designed in such a manner that the control current to be inputted to the pixel becomes larger than the current that the current source circuit 102 outputs. By this means, by use of the control current of large current value, the setting operation of the current source circuit 102 is carried out. As a result, it is possible to speed up the setting operation of the current source circuit. Also, it is effected to reduction of influence of noise.

By this means, the current source circuit 102 outputs a predetermined current.

In addition, in the current source circuit of the above-described structure, in case that a signal is inputted to the signal line GH and the current holding transistor is in the on state, the current line CL has to be set in such a manner that a constant current always flow through it. This is because, in a period in which a current is not inputted to the current line CL, when both of the current holding transistor 1404 and the current input transistor 1403 are turned in the on state, the electric charges held in the current source capacitance 111 are discharged. On that account, in case that a constant current is selectively inputted to a plurality of the current lines CL corresponding to all pixels and the setting operation of the pixel is carried out, in short, in case that the constant current is not always inputted to the current line CL, the current source circuit of the following structure will be used.

Figure 33B:
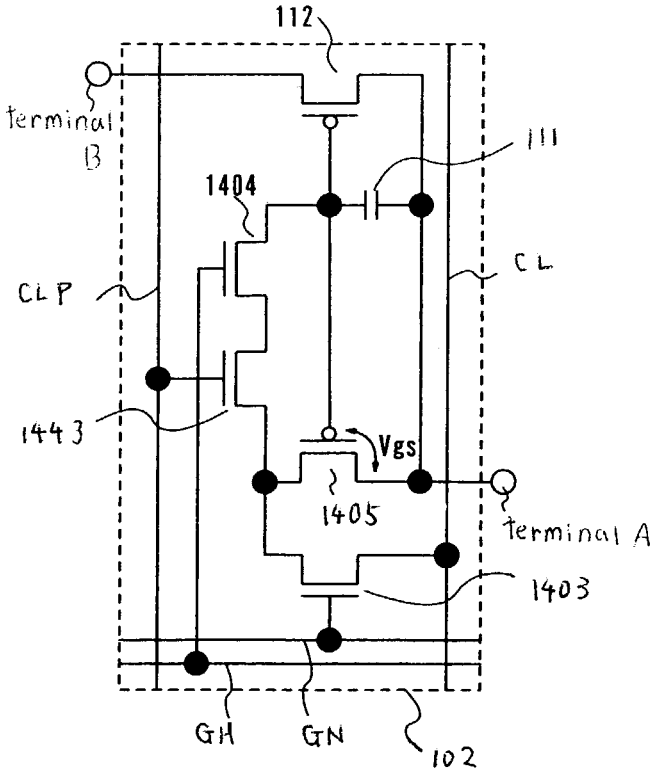

In the current source circuit shown in FIG. 9A and FIG. 9B, added is a switching element for selecting a connection of the gate electrode and the drain terminal of the current source transistor 112. On or off of this switching element is selected by a signal which is different from a signal to be inputted to the signal line GH. FIG. 33B shows one example of the above-described structure. In FIG. 33B, a point sequential transistor 1443 and a point sequential line CLP are disposed. By this means, an arbitrary pixel is selected one by one, and a constant current is made to be inputted at least to the current line CL of the selected pixel, and thereby, the setting operation of the pixel is carried out.

Each signal line of the current source circuit of the first structure can be shared. For example, in the structure shown in FIG. 9A, FIG. 9B and FIG. 33, there is no problem in operation if the current input transistor 1403 and the current holding transistor 1404 are switched to be on or off at the same timing. On that account, polarities of the current input transistor 1403 and the current holding transistor 1404 are made to be the same, and the signal line GH and the signal line GN can be shared.

Then, a current source circuit of a second structure will be described. In addition, FIGS. 10A–E are referred for the description. In FIG. 10A, the same reference numerals and signs are given to the same portions as in FIGS. 2A–C.

Structural components of the current source circuit of the second structure will be described. The current source circuit of the second structure has the current source transistor 112. Also, it has a current input transistor 203 and a current holding transistor 204, and a current stop transistor 205 which function as switches. Here, the current source transistor 112, the current input transistor 203, the current holding transistor 204, and the current stop transistor 205 may be of the P-channel type or of the N-channel type. Here is shown an example that the current source transistor 112 is a P channel type transistor. Further, it has the current source capacitance 111 for holding the gate electrode of the current source transistor 112. In addition, by positively using a gate capacitance etc. of a transistor, it is possible to omit the current source capacitance 111. Further, it has a signal line GS which inputs a signal to a gate electrode of the current stop transistor 205 and a signal line GH which inputs a signal to a gate electrode of the current holding transistor 204 and a signal line GN which inputs a signal to the gate electrode of the current input transistor 203. Also, it has a current line CL to which the control signal is inputted.

A connecting relation of these structural components will be described. The gate electrodes of the current source transistor 112 are connected to one of the electrodes of the current source capacitance 111. The other electrode of the current source capacitance 111 is connected to the terminal A. The source terminal of the current source transistor 112 is connected to the terminal A. The drain terminal of the current source transistor 112 is connected to the terminal B through the current stop transistor 205, and also, connected to the current line CL through the current input transistor 203. The gate electrode and the drain terminal of the current source transistor 112 are connected through the current holding transistor 204.

Figure 34A:
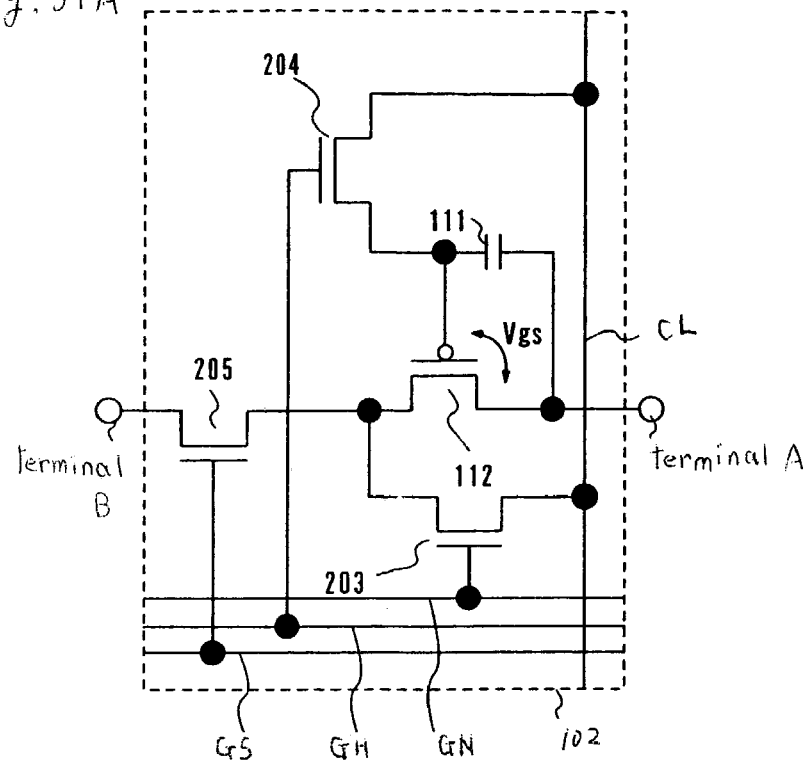
FIG. 34A and FIG. 34B are views showing the structure of the current source circuit of the pixel of the display apparatus of the invention.

In addition, in the structure shown in FIG. 10A, the source terminal or the drain terminal of the current holding transistor 204 is connected to the current source capacitance 111 and the drain terminal of the current source transistor 112. However, it may be configured that a side of the current holding transistor 204 which is not connected to the current source capacitance 111 is connected to the current line CL. The above-described structure is shown in FIG. 34A. With this structure, by adjusting an electric potential of the current line CL when the current holding transistor 204 is in the off state, it is possible to lessen the voltage between the source and drain terminals of the current holding transistor 204. As a result, it is possible to lessen the off current of the current holding transistor 204. By this means, it is possible to lessen the leakage of the electric charges from the current source capacitance 111.

Then, the setting operation of the current source circuit of the second structure shown in FIG. 10A will be described.

FIGS. 10B to 10E are used for the description. In the current source circuit of the second structure, the setting operation is carried out by going through states of FIGS. 10B to 10E in sequence. In the description, for the purpose of simplicity, the current input transistor 203, the current holding transistor 204 and the current stop transistor 205 are represented as switches. Here, shown is a case that a control signal for setting the current source circuit 102 is the control current. Also, in the figure, a path through which a current flows is shown by a heavy-line arrow.

In a period TD1 shown in FIG. 10B, the current input transistor 203 and the current holding transistor 204 are turned in the on state. Also, the current stop transistor 205 is in the off state. By this means, a current flows from the current line CL through the path shown and electric charges are held in the current source capacitance 111.

In a period TD2 shown in FIG. 10C, by the electric charges held, the voltage between the gate and the source of the current source transistor 112 becomes more than a threshold voltage. Then, the drain current flows through the current source transistor 112.

When sufficient time passes and a steady state is realized, as in a period TD3 shown in FIG. 10D, the drain current of the current source transistor 112 is determined as the control current. By this means, the gate voltage of the current source transistor 112 on the occasion that the drain current is set at the control current is held in the current source capacitance 111.

In a period TD4 shown in FIG. 10E, the current input transistor 203 and the current holding transistor 204 are turned in the off state. By this means, the control current is prevented from flowing through the pixel. In addition, it is desirable that a timing that the current holding transistor 204 is turned off, as compared to a timing that the current input transistor 203 is turned off, is earlier or simultaneous. This is because of preventing the electric charges held in the current source capacitance 111 from being discharged. Furthermore, the current stop transistor 205 is turned in the on state. After the period TD4, when a voltage is applied between the source and drain terminals of the current source transistor 112, the drain current corresponding to the control current flows. In short, when a voltage is applied between the terminal A and the terminal B, the current source circuit 102 has the drain current corresponding to the control circuit flowed. By this means, the current source circuit 102 outputs a predetermined current.

In addition, the current stop transistor 205 is not indispensable. For example, in case that the setting operation is carried out only when at least one of the terminal A and the terminal B is in an opened state, the current stop transistor 205 is not necessary. Concretely, in the current source circuit which carries out the setting operation only in case that the switch part making the pair is in the off state, the current stop transistor 205 is not necessary.

Also, in the current source circuit of the above-described structure, in case that a signal is inputted to the signal line GH and the current holding transistor 204 is in the on state, the current line CL has to be set in such a manner that a constant current always flows through it. This is because, in a period in which a current is not inputted to the current line CL, when both of the current holding transistor 204 and the current input transistor 203 are turned in the on state, the electric charges held in the current source capacitance 111 are discharged. On that account, in case that a constant current is selectively inputted to a plurality of the current lines CL corresponding to all pixels and the setting operation of the pixel is carried out, in short, in case that the constant current is not always inputted to the current line CL, the current source circuit of the following structure will be used.

Figure 34B:
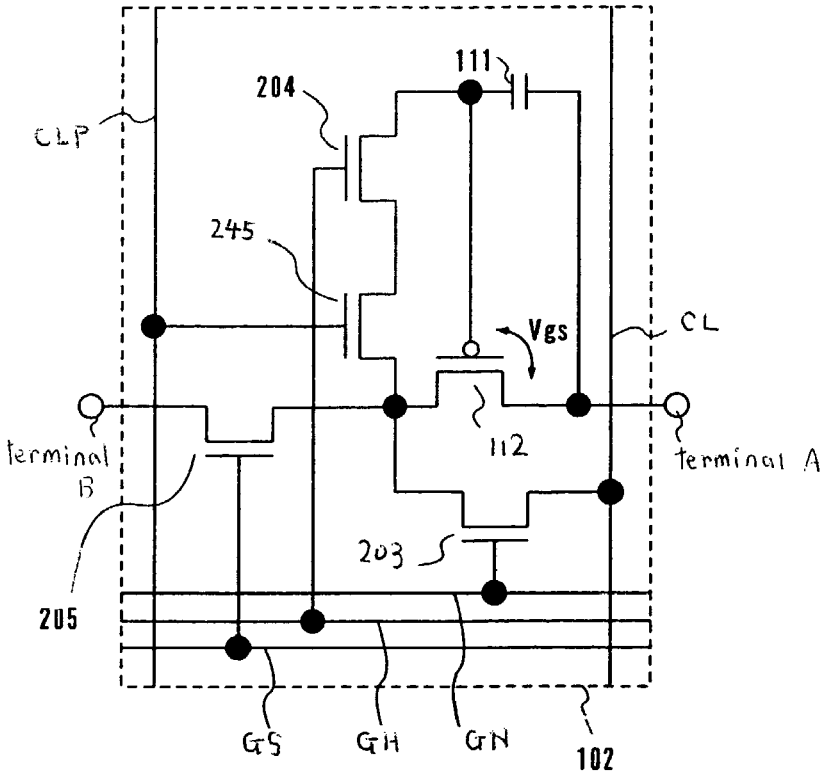

Added is a switching element for selecting a connection of the gate electrode and the drain terminal of the current source transistor 112. On or off of this switching element is selected by a signal which is different from a signal to be inputted to the signal line GH. FIG. 34B shows one example of the above-described structure. In FIG. 34B, a point sequential transistor 245 and a point sequential line CLP are disposed. By this means, an arbitrary pixel is selected one by one, and a constant current is made to be inputted at least to the current line CL of the selected pixel, and thereby, the setting operation of the pixel is carried out.

Each signal line of the current source circuit of the second structure can be shared. For example, there is no problem in operation if the current input transistor 203 and the current holding transistor 204 are switched to be on or off at the same timing. On that account, polarities of the current input transistor 203 and the current holding transistor 204 are made to be the same, and the signal line GH and the signal line GN can be shared. Also, there is no problem in operation if the current stop transistor 205 is turned on at the same time when the current input transistor 203 is turned off. On that account, polarities of the current input transistor 203 and the current stop transistor 205 are made to differ, and the signal line GN and the signal line GS can be shared.

Figure 37:
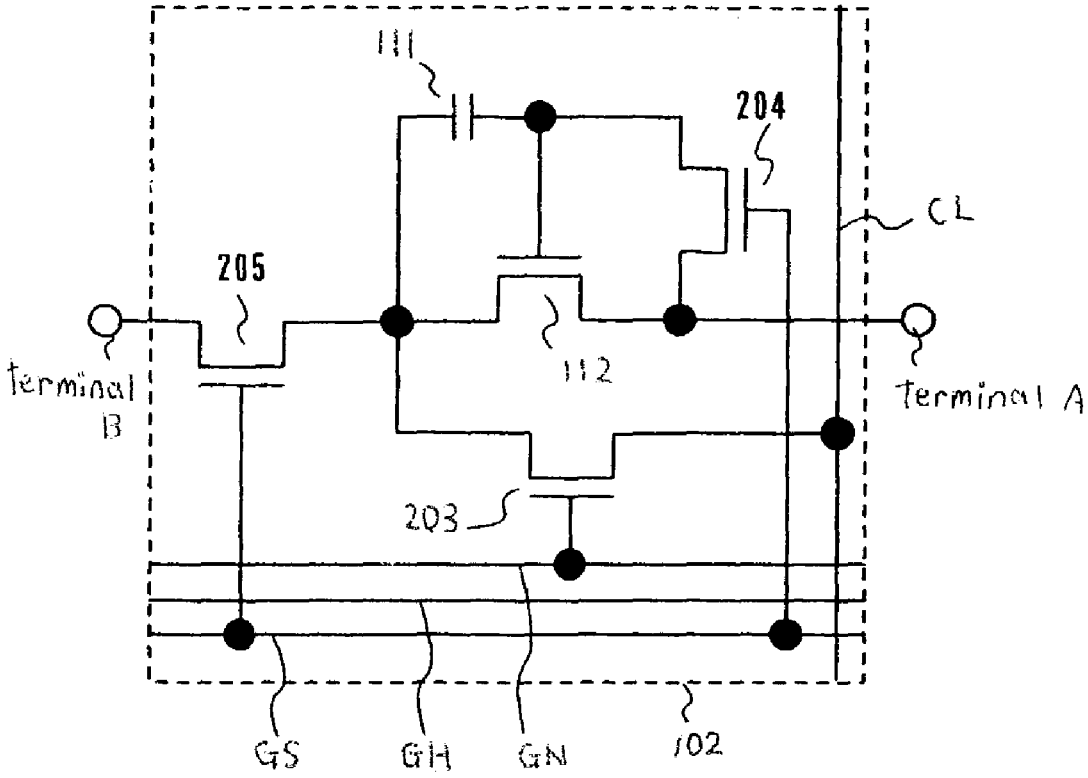
FIG. 37 is a view showing a structure of the current source circuit of the pixel of the display apparatus of the invention.

Also, a structural example in case that the current source transistor 123 is the N channel type transistor is shown in FIG. 37. In addition, the same reference numerals and signs are given to the same portion as in FIGS. 10A–E.

Then, a current source circuit of a third structure will be described. In addition, FIGS. 11 A–E is referred for the description. In FIG. 11A, the same reference numerals and signs are given to the same portions as in FIGS. 2A–C.

Structural components of the current source circuit of the third structure will be described. The current source circuit of the third structure has the current source transistor 112. Also, it has a current input transistor 1483, a current holding transistor 1484, a light emitting transistor 1486, and a current reference transistor 1488 which function as switches. Here, the current source transistor 112, the current input transistor 1483, the current holding transistor 1484, the light emitting transistor 1486, and the current reference transistor 1488 may be of the P-channel type or of the N-channel type. Here is shown an example that the current source transistor 112 is a P channel type transistor. Further, it has the current source capacitance 111 for holding the gate electrode of the current source transistor 112. In addition, by positively using a gate capacitance etc. of a transistor, it is possible to omit the current source capacitance 111. Also, it has a signal line GN which inputs a signal to a gate electrode of the current input transistor 1483, a signal line GH which inputs a signal to a gate electrode of the current holding transistor 1484, a signal line GE which inputs a signal to a gate electrode of the light emitting transistor 1486, and a signal line GC which inputs a signal to a gate electrode of the current reference transistor 1488. Further, it has a current line CL to which the control signal is inputted and a current reference line SCL which is held at a constant electric potential.

A connecting relation of these structural components will be described. The gate electrodes and the source terminal of the current source transistor 112 are connected through the current source capacitance 111. The source terminal of the current source transistor 112 is connected to the terminal A through the light emitting transistor 1486, and also, connected to the current line CL through the current input transistor 1483. The gate electrode and the drain terminal of the current source transistor 112 are connected through the current holding transistor 1484. The drain terminal of the current source transistor 112 is connected to the terminal B, and also, connected to the current reference line SCL through the current reference transistor 1488.

Figure 38:
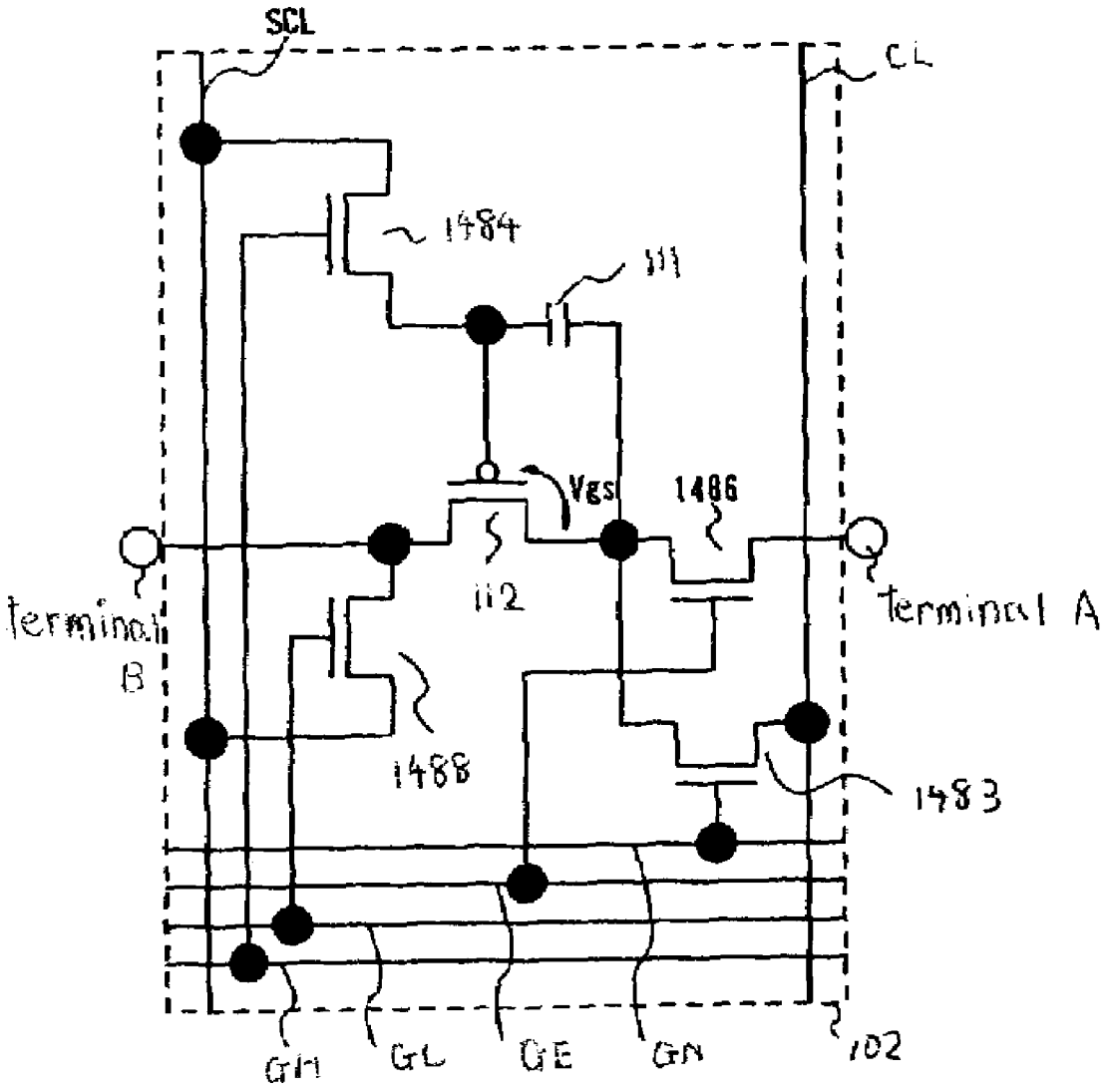
FIG. 38 is a view showing a structure of the current source circuit of the pixel of the display apparatus of the invention.

In addition, a side of the source terminal or the drain terminal of the current holding transistor 1484 which is not connected to the current source capacitance 111 is connected to the drain terminal of the current source transistor 112 but, it may be connected to the current reference line SCL. The above-described structure is shown in FIG. 38. With this structure, by adjusting an electric potential of the current reference line SCL when the current holding transistor 1484 is in the off state, it is possible to lessen the voltage between the source and drain terminals of the current holding transistor 1484. As a result, it is possible to lessen the off current of the current holding transistor 1484. By this means, it is possible to lessen the leakage of the electric charges from the current source capacitance 111.

Then, the setting operation of the current source circuit of the above-described third structure will be described. FIGS. 11B to 11E are used for the description. In the current source circuit of the third structure, the setting operation is carried out by going through states of FIGS. 11B to 11E in sequence. In the description, for the purpose of simplicity, the current input transistor 1483, the current holding transistor 1484, the light emitting transistor 1486 and the current reference transistor 1488 are represented as switches. Here, shown is a case that a control signal for setting the current source circuit 102 is the control current. Also, in the figure, a path through which a current flows is shown by a heavy-line arrow.

In a period TD1 shown in FIG. 11B, the current input transistor 1483, the current holding transistor 1484 and the current reference transistor 1488 are turned in the on state. By this means, a current flows from the path shown and electric charges are held in the current source capacitance 111.

In a period TD2 shown in FIG. 11C, by the electric charges held in the current source capacitance 111, the voltage between the gate and the source of the current source transistor 112 becomes more than a threshold voltage. Then, the drain current flows through the current source transistor 112.

When sufficient time passes and a steady state is realized, as in a period TD3 shown in FIG. 11D, the drain current of the current source transistor 112 is determined as the control current. By this means, the gate voltage on the occasion that the drain current is set at the control current is held in the current source capacitance 111.

In a period TD4 shown in FIG. 11E, the current input transistor 1483 and the current holding transistor 1484 are turned off. By this means, the control current is prevented from flowing through the pixel. In addition, it is desirable that a timing that the current holding transistor 1484 is turned off, as compared to a timing that the current input transistor 1483 is turned off, is earlier or simultaneous. This is because of preventing the electric charges held in the current source capacitance 111 from being discharged. Further, the current reference transistor 1488 are turned in the off state. After that, the light emitting transistor 1486 is turned in the on state. After the period TD4, when a voltage is applied between the source and drain terminals of the current source transistor 112, the drain current corresponding to the control current flows through the current source transistor 112. In short, when a voltage is applied between the terminal A and the terminal B, the current source circuit 102 has the drain current corresponding to the control current flown. By this means, the current source circuit 102 outputs a predetermined current.

In addition, the current reference transistor 1488 and the current reference line SCL are not indispensable. For example, in the current source circuit which carries out the setting operation only in case that the switch part making the pair is in the on state, the current reference transistor 1488 and the current reference line SCL are not necessary, since a current does not flow through the current reference line SCL in the periods TD1 to TD3 but simply flows through the terminal B.

Each signal line of the current source circuit of the third structure can be shared. For example, there is no problem in operation if the current input transistor 1483 and the current holding transistor 1484 are switched to be on or off at the same timing. On that account, polarities of the current input transistor 1483 and the current holding transistor 1484 are made to be the same, and the signal line GH and the signal line GN can be shared. Also, there is no problem in operation if the current reference transistor 1488 and the current input transistor 1483 are turned on or off at the same timing. On that account, polarities of the current reference transistor 1488 and the current input transistor 1483 are made to be the same, and the signal line GN and the signal line GC can be shared. Further, there is no problem in operation if, at the same time when the light emitting transistor 1486 is turned in the on state, the current input transistor 1483 is turned in the off state. Then, polarities of the light emitting transistor 1486 and the current input transistor 1483 are made to differ, and the signal line GE and the signal line GN can be shared.

Figure 39A:
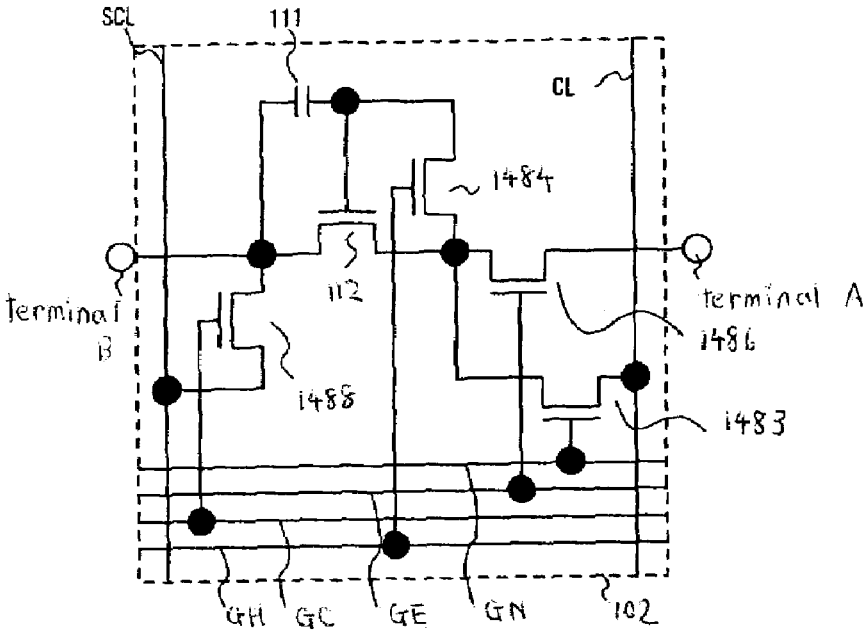
FIG. 39A and FIG. 39B are views showing a structure of the current source circuit of the pixel of the display apparatus of the invention.
Figure 39B:
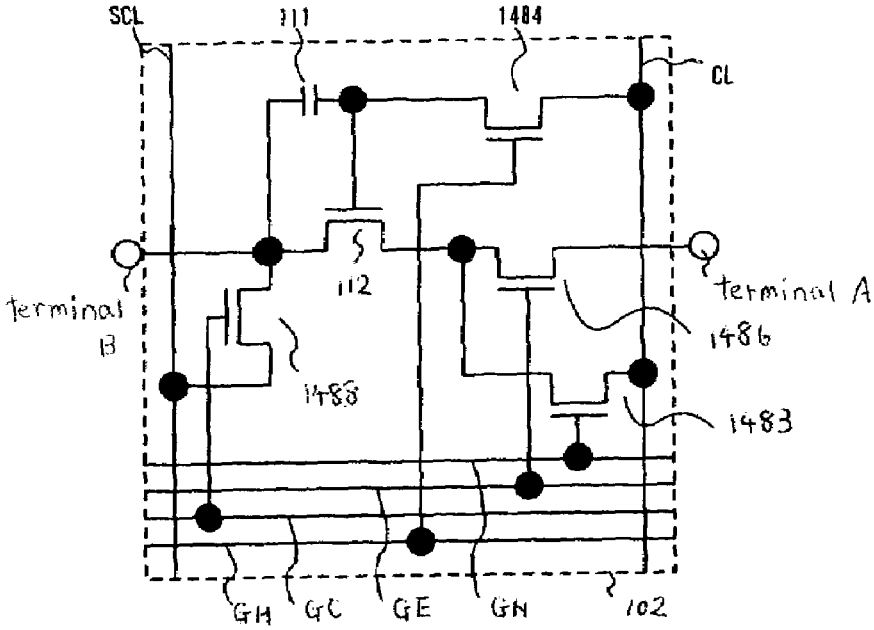

Also, a structural example in case that the current source transistor 112 is the N channel type transistor is shown in FIG. 39A. In addition, the same reference numerals and signs are given to the same portion as in FIGS. 11A–E. In addition, in the structure of FIG. 39A, a side of the source terminal or the drain terminal of the current holding transistor 1484 which is not connected to the current source capacitance 111 is connected to the drain terminal of the current source transistor 112 but, it may be connected to the current line CL. The above-described structure is shown in FIG. 39B. With this structure, by adjusting an electric potential of the current line CL when the current holding transistor 1484 is in the off state, it is possible to lessen the voltage between the source and drain terminals of the current holding transistor 1484. As a result, it is possible to lessen the off current of the current holding transistor 1484. By this means, it is possible to lessen the leakage of the electric charges from the current holding capacitance 111.

Figure 12A:
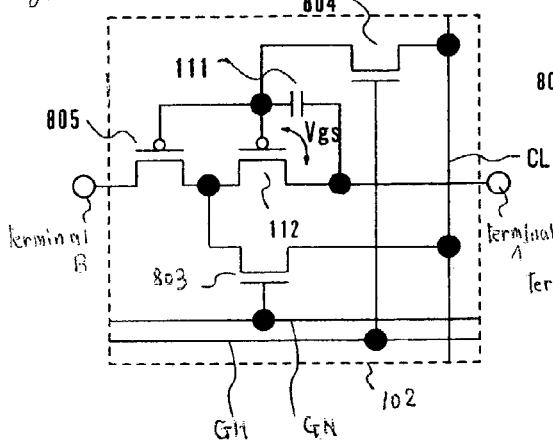
FIGS. 12A–12F are views showing structures and a driving method of the current source circuit of the pixel of the display apparatus of the invention.

Then, the setting operation of the current source circuit of a fourth structure will be described. In addition, FIGS. 12A–F are referred for the description. In FIG. 12A, the same reference numerals and signs are given to the same portions as in FIGS. 2A–C.

Structural components of the current source circuit of the fourth structure will be described. The current source circuit of the fourth structure has the current source transistor 112 and a current stop transistor 805. Also, it has a current input transistor 803 and a current holding transistor 804 which function as switches. Here, the current source transistor 112, a current stop transistor 805, the current input transistor 803, and the current holding transistor 804 may be of the P-channel type or of the N-channel type. But, there is a necessity to make the current source transistor 112 and the current stop transistor 805 the same polarity. Here is shown an example that the current source transistor 112 and the current stop transistor 805 are P channel type transistors. Also, it is desirable that current characteristics of the current source transistor 112 and the current stop transistor 805 are the same. Further, it has the current source capacitance 111 for holding the gate electrode of the current source transistor 112. In addition, by positively using a gate capacitance etc. of a transistor, it is possible to omit the current source capacitance 111. Further, it has a signal line GN which inputs a signal to a gate electrode of the current input transistor 803, a signal line GH which inputs a signal to a gate electrode of the current holding transistor 804. Furthermore, it has a current line CL to which the control current is inputted.

A connecting relation of these structural components will be described. The source electrode of the current source transistor 112 is connected to one of the electrodes of the current source capacitance 111. The other electrode of the current source capacitance 111 is connected to the terminal A. The gate electrode and the source terminal of the current source transistor 112 are connected through the current source capacitance 111. The gate electrode of the current source transistor 112 is connected to a gate electrode of the current stop transistor 805, and also, connected to the current line CL through the current holding transistor 804. The drain terminal of the current source transistor 112 is connected to a source terminal of the current stop transistor 805, and also, connected to the current line CL through the current input transistor 803. The drain terminal of the current stop transistor 805 is connected to the terminal B.

Figure 12B:
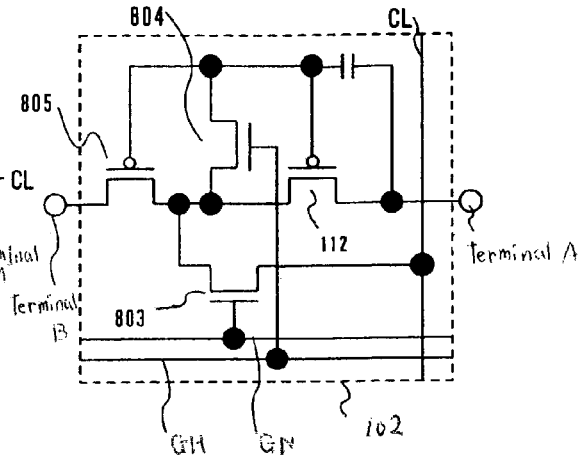

In addition, in the structure shown in FIG. 12A, it is possible to configure the circuit structure as shown in FIG. 12B, by changing a location of the current holding transistor 804. In FIG. 12B, the current holding transistor 804 is connected between the gate electrode and the drain terminal of the current source transistor 112.

Then, the setting operation of the current source circuit of the above-described fourth structure will be described. In addition, the setting operation in FIG. 12A is the same as that in FIG. 12B. Here, the circuit shown in FIG. 12A is picked up as an example, and its setting operation will be described. FIGS. 12C to 12F are used for the description. In the current source circuit of the fourth structure, the setting operation is carried out by going through states of FIGS. 12C to 12F in sequence. In the description, for the purpose of simplicity, the current input transistor 803 and the current holding transistor 804 are represented as switches. Here, shown is a case that a control signal for setting the current source circuit is the control current. Also, in the figure, a path through which a current flows is shown by a heavy-line arrow.

Figure 12C:
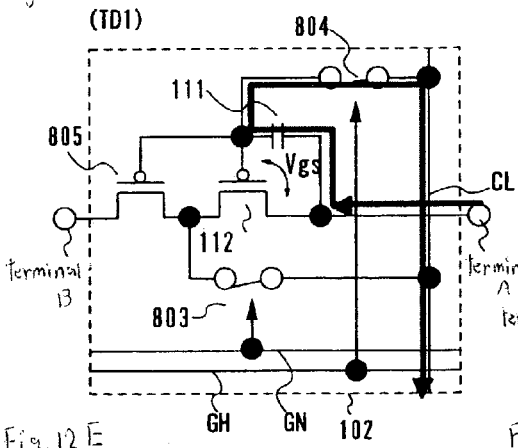

In a period TD1 shown in FIG. 12C, the current input transistor 803 and the current holding transistor 804 are turned in the on state. In addition, on this occasion, the current stop transistor 805 is in the off state. This is because, by the current holding transistor 804 and the current input transistor 803 which were turned in the on state, the electric potentials of the source terminal and the gate electrode of the current stop transistor 805 are maintained to be the same. In short, by using a transistor which is turned in the off state when the voltage between the source and the gate is zero as the current stop transistor 805, in the period TD1, the current stop transistor 805 is turned in the off state. By this means, a current flows from the path shown and electric charges are held in the current source capacitance 111.

Figure 12D:
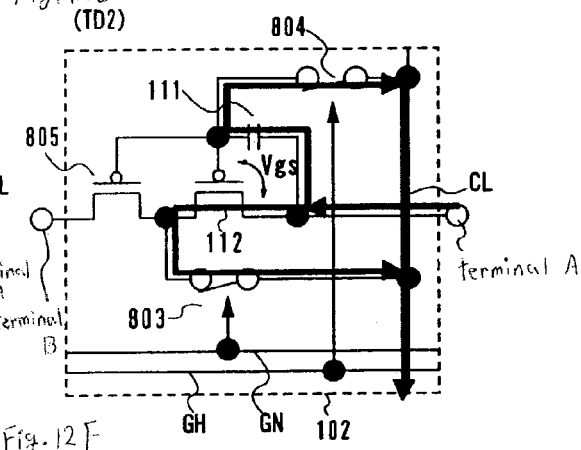

In a period TD2 shown in FIG. 12D, by the electric charges held, the voltage between the gate and the source of the current source transistor 112 becomes more than a threshold voltage. Then, the drain current flows through the current source transistor 112.

Figure 12E:
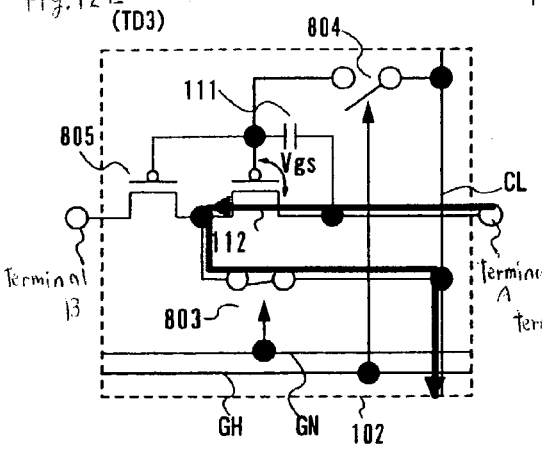

When sufficient time passes and a steady state is realized, as in a period TD3 shown in FIG. 12E, the drain current of the current source transistor 112 is determined as the control current. By this means, the gate voltage of the current source transistor 112 on the occasion that the drain current is set at the control current is held in the current source capacitance 111. After that, the current holding transistor 804 is turned in the off state. Then, the electric charges held in the current source capacitance 111 are distributed also to the gate electrode of the current stop transistor 805. By this means, at the same time when the current holding transistor 804 is turned in the off state, the current stop transistor 805 is automatically turned in the on state.

Figure 12F:
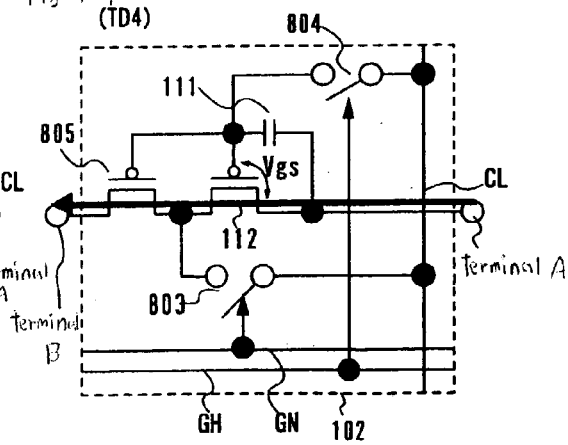

In a period TD4 shown in FIG. 12F, the current input transistor 803 are turned off. By this means, the control current is prevented from flowing through the pixel. In addition, it is desirable that a timing that the current holding transistor 804 is turned off, as compared to a timing that the current input transistor 803 is turned off, is earlier or simultaneous. This is because of preventing the electric charges held in the current source capacitance 111 from being discharged. After the period TD4, in case that a voltage is applied between the terminal A and the terminal B, through the current source transistor 112 and the current stop transistor 805, a constant current is outputted. In short, on the occasion that the current source circuit 102 outputs the constant current, the current source transistor 112 and the current stop transistor 805 function like one multi-gate type transistor. On that account, it is possible to lessen a value of the constant current to be outputted, to the control current to be inputted. Accordingly, it is possible to speed up the setting operation of the current source circuit. In addition, there is a necessity that polarities of the current stop transistor 805 and the current source transistor 112 are made to be the same. Also, it is desirable that current characteristics of the current stop transistor 805 and the current source transistor 112 are made to be the same. This is because, in each current source circuit 102 having the fourth structure, in case that the current characteristics of the current stop transistor 805 and the current source transistor 112 are not the same, there occurs variation of the output current of the current source circuit.

In addition, in the current source circuit of the fourth structure, by using not only the current stop transistor 805 but also a transistor which converts the control current, which is inputted, into the corresponding gate voltage (current source transistor 112), a current is outputted from the current source circuit 102. On one hand, in the current source circuit of the first structure, the control current is inputted, and the transistor which converts the inputted control current into the corresponding gate voltage (current transistor) is completely different from the transistor which converts the gate voltage into the drain current (current source transistor). Thus, the fourth structure can more reduce influence which is given to the output current of the current source circuit 102 by variation of a current characteristic of a transistor, than the first structure.

Each signal line of the current source circuit of the fourth structure can be shared. There is no problem in operation if the current input transistor 803 and the current holding transistor 804 are switched to be on or off at the same timing. On that account, polarities of the current input transistor 803 and the current holding transistor 804 are made to be the same, and the signal line GH and the signal line GN can be shared.

Then, a current source circuit of a fifth structure will be described. In addition, FIGS. 13A–F are referred for the description. In FIG. 13A, the same reference numerals and signs are given to the same portions as in FIG. 2.

Structural components of the current source circuit of the fifth structure will be described. The current source circuit of the fifth structure has the current source transistor 112 and a light emitting transistor 886. Also, it has a current input transistor 883, a current holding transistor 884, and a current reference transistor 888 which function as switches. Here, the current source transistor 112, a light emitting transistor 886, the current input transistor 883, the current holding transistor 884, and the current reference transistor 888 may be of the P-channel type or of the N-channel type. But, there is a necessity that polarities of the current source transistor 112 and the light emitting transistor 886 are the same. Here is shown an example that the current source transistor 112 and the light emitting transistor 886 are P channel type transistors. Also, it is desirable that current characteristics of the current source transistor 112 and the light emitting transistor 886 are the same. Further, it has the current source capacitance 111 for holding the gate electrode of the current source transistor 112. In addition, by positively using a gate capacitance etc. of a transistor, it is possible to omit the current source capacitance 111. Also, it has a signal line GN which inputs a signal to a gate electrode of the current input transistor 883, and a signal line GH which inputs a signal to a gate electrode of the current holding transistor 884. Further, it has a current line CL to which the control signal is inputted, and a current reference line SCL which is maintained to be a constant electric potential.

A connecting relation of these structural components will be described. The source terminal of the current source transistor 112 is connected to the terminal B, and also, connected to the current reference line SCL through the current reference transistor 888. The drain terminal of the current source transistor 112 is connected to a source terminal of the light emitting transistor 886, and also, connected to the current line CL through the current input transistor 883. The gate electrode and the source terminal of the current source transistor 112 are connected through the current source capacitance 111. The gate electrode of the current source transistor 112 is connected to a gate electrode of the light emitting transistor 886, and connected to the current line CL through the current holding transistor 884. The drain terminal of the light emitting transistor 886 is connected to the terminal A.

In addition, in the structure shown in FIG. 13A, it is possible to configure the circuit structure as shown in FIG. 13B, by changing a location of the current holding transistor 884. In FIG. 13B, the current holding transistor 884 is connected between the gate electrode and the drain terminal of the current source transistor 112.

Then, the setting operation of the current source circuit of the above-described fifth structure will be described. In addition, the setting operation in FIG. 13A is the same as that in FIG. 13B. Here, the circuit shown in FIG. 13A is picked up as an example, and its setting operation will be described. FIGS. 13C to 13F are used for the description. In the current source circuit of the fifth structure, the setting operation is carried out by going through states of FIGS. 13C to 13F in sequence. In the description, for the purpose of simplicity, the current input transistor 883, the current holding transistor 884, and the current reference transistor 888 are represented as switches. Here, shown is a case that a control signal for setting the current source circuit is the control current. Also, in the figure, a path through which a current flows is shown by a heavy-line arrow.

In a period TD1 shown in FIG. 13C, the current input transistor 883, the current holding transistor 884, and the current reference transistor 888 are in the on state. In addition, on this occasion, the light emitting transistor 886 is in the off state. This is because, by the current holding transistor 884 and the current input transistor 883 which were turned in the on state, the electric potentials of the source terminal and the gate electrode of the light emitting transistor 886 are maintained to be the same. In short, by using a transistor which is turned in the off state when a voltage between a source and a gate is zero as the light emitting transistor 886, in the period TD1, the light emitting transistor 886 is turned in the off state. By this means, a current flows from the path shown and electric charges are held in the current source capacitance 111.

In a period TD2 shown in FIG. 13D, by the electric charges held in the current source capacitance 111, the voltage between the gate and the source of the current source transistor 112 becomes more than a threshold voltage. Then, the drain current flows through the current source transistor 112.

When sufficient time passes and a steady state is realized, as in a period TD3 shown in FIG. 13E, the drain current of the current source transistor 112 is determined as the control current. By this means, the gate voltage of the current source transistor 112 on the occasion that the drain current is set at the control current is held in the current source capacitance 111. After that, the current holding transistor 884 is turned in the off state. Then, the electric charges held in the current source capacitance 111 are distributed also to the gate electrode of the light emitting transistor 886. By this means, at the same time when the current holding transistor 884 is turned in the off state, the light emitting transistor 886 is automatically turned in the on state.

In a period TD4 shown in FIG. 13F, the current reference transistor 888 and the current input transistor 883 are turned off. By this means, the control current is prevented from flowing through the pixel. In addition, it is desirable that a timing that the current holding transistor 884 is turned off, as compared to a timing that the current input transistor 883 is turned off, is earlier or simultaneous. This is because of preventing the electric charges held in the current source capacitance 111 from being discharged. After the period TD4, in case that a voltage is applied between the terminal A and the terminal B, through the current source transistor 112 and the light emitting transistor 886, a constant current is outputted. In short, on the occasion that the current source circuit 102 outputs the constant current, the current source transistor 112 and the light emitting transistor 886 function like one multi-gate type transistor. On that account, it is possible to lessen a value of the constant current to be outputted, to the control current to be inputted. By this means, it is possible to speed up the setting operation of the current source circuit. In addition, there is a necessity that the current characteristics of the light emitting transistor 886 and the current source transistor 112 are made to be the same. Also, it is desirable that current characteristics of the light emitting transistor 886 and the current source transistor 112 are made to be the same. This is because, in each current source circuit 102 having the fifth structure, in case that polarities of the light emitting transistor 886 and the current source transistor 112 are not the same, there occurs variation of the output current of the current source circuit.

In addition, in the current source circuit of the fifth structure, by a transistor which converts the control current, which is inputted, into the corresponding gate voltage (current source transistor 112), a current is outputted from the current source circuit 102. On one hand, in the current source circuit of the first structure, the control current is inputted, and the transistor which converts the inputted control current into the corresponding gate voltage (current transistor) is completely different from the transistor which converts the gate voltage into the drain current (current source transistor). Thus, it is possible to more reduce influence which is given to the output current of the current source circuit 102 by variation of a current characteristic of a transistor, than in the first structure.

In addition, in case that a current is made to flow through the terminal B in the periods TD1 to TD3 on the occasion of the setting operation, the current reference line SCL and the current reference transistor 888 are not necessary.

Each signal line of the current source circuit of the fifth structure can be shared. For example, there is no problem in operation if the current input transistor 883 and the current holding transistor 884 are switched to be on or off at the same timing. On that account, polarities of the current input transistor 883 and the current holding transistor 884 are made to be the same, and the signal line GH and the signal line GN can be shared. Also, there is no problem in operation if the current reference transistor 888 and the current input transistor 883 are switched to be on or off at the same timing. On that account, polarities of the current reference transistor 888 and the current input transistor 883 are made to be the same, and the signal line GN and the signal line GC can be shared.

Then, the current source circuits of the above-described first structure to the fifth structure will be organized with respect to each feature and with slightly larger framework.

The above-described five current source circuits are, roughly divided, classified into a current mirror type current source circuit, a same transistor type current source circuit, and a multi-gate type current source circuit. These will be described hereinafter.

As the current mirror type current source circuit, cited is the current source circuit of the first structure. In the current mirror type current source circuit, the signal which is inputted to the light emitting element is a current which is formed by increasing or decreasing the control current which is inputted to the pixel, by a predetermined scaling factor. On that account, it is possible to set the control current larger to some extent. Thus, it is possible to speed up the setting operation of the current source circuit of each pixel. However, if current characteristics of a pair of transistors, which configure a current mirror circuit that the current source circuit has, differ, there is a problem that image display is varied.

As the same transistor type current source circuit, cited are the current source circuits of the second structure and the third structure. In the same transistor type current source circuit, the signal which is inputted to the light emitting element is the same as the current value of the control current which is inputted to the pixel. Here, in the same transistor type current source circuit, the transistor to which the control current is inputted is the same as the transistor which outputs a current to the light emitting element. On that account, reduced is image irregularity due to variation of current characteristics of transistors.

As the multi-gate type current source circuit, cited are the current source circuits of the fourth structure and the fifth structure. In the multi-gate type current source circuit, the signal which is inputted to the light emitting element is a current which is formed by increasing or decreasing the control current which is inputted to the pixel, by a predetermined scaling factor. On that account, it is possible to set the control current larger to some extent. Thus, it is possible to speed up the setting operation of the current source circuit of each pixel. Also, a portion of the transistor to which the control current is inputted and the transistor which outputs a current to the light emitting element is shared with each other. On that account, reduced is image irregularity due to variation of current characteristics of transistors, as compared with the current mirror type current source circuit.

Then, in each of the above-described current source circuits in three classifications, a relation of its setting operation and an operation of the switch part which makes the pair will be described.

A relation of the setting operation in case of the current mirror type current source circuit and the operation of the corresponding switch part will be shown hereinafter. In case of the current mirror type current source circuit, even during a period that the control current is inputted, it is possible to output the predetermined constant current. On that account, there is no necessity to carry out the operation of the switch part which makes the pair and the setting operation of the current source circuit in synchronous with each other.

A relation of the setting operation in case of the same transistor type current source circuit and the operation of the corresponding switch part will be shown hereinafter. In case the same transistor type current source circuit, during a period that the control current is inputted, it is not possible to output the constant current. On that account, there occurs a necessity to carry out the operation of the switch part which makes the pair and the setting operation of the current source circuit in synchronous with each other. For example, only when the switch part is in the off state, it is possible to carry out the setting operation of the current source circuit.

A relation of the setting operation in case of the multi-gate type current source circuit and the operation of the corresponding switch part will be shown hereinafter. In case of the multi-gate type current source circuit, during a period that the control current is inputted, it is not possible to output the constant current. On that account, there occurs a necessity to carry out the operation of the switch part which makes the pair and the setting operation of the current source circuit in synchronous with each other. For example, only when the switch part is in the off state, it is possible to carry out the setting operation of the current source circuit.

Then, an operation on the occasion of combining with the temporal gray scale system, in case that the setting operation of the current source circuit is made to be synchronous with the operation of the switch part which makes the pair, will be described in detail.

Here, a case that the setting operation of the current source circuit is carried out only in case that the switch part is in the off state will be watched. In addition, since detail explanation of the temporal gray scale system is the same as the technique shown in the embodiment 2, it will be omitted here. In case of using the temporal gray scale system, it is the non display period that the switch part is always turned in the off state. Thus, in the non display period, it is possible to carry out the setting operation of the current source circuit.

The non display period is initiated by selecting each pixel row in sequence in the reset period. Here, it is possible to carry out the setting operation of each pixel row with the same frequency as frequency for selecting the scanning line in sequence. For example, a case of using the switch of the structure shown in FIG. 3 will be watched. It is possible to select each pixel row and carry out the setting operation of the current source circuit with the same frequency as frequency for selecting the scanning line G and the deletion use signal line RG in sequence.

But, there is a case that it is difficult to sufficiently carry out the setting operation of the current source circuit in the selection period of one row length. In that moment, it is fine if the setting operation of the current source circuit is slowly carried out, by using the selection period of a plurality of rows. To carry out the setting operation of the current source circuit slowly means to carry out an operation for storing predetermined electric charges slowly by taking long time into the current source capacitance which the current source circuit has.

As just described, since each row is selected by using the selection period of a plurality of rows, and by using the same frequency as frequency for selecting the deletion use signal line RG etc. in the reset period, the rows are to be selected at intervals. Thus, in order to carry out the setting operations of the pixels of all rows, there is a necessity to carry out the setting operations in a plurality of the non display periods.

Figure 14A:
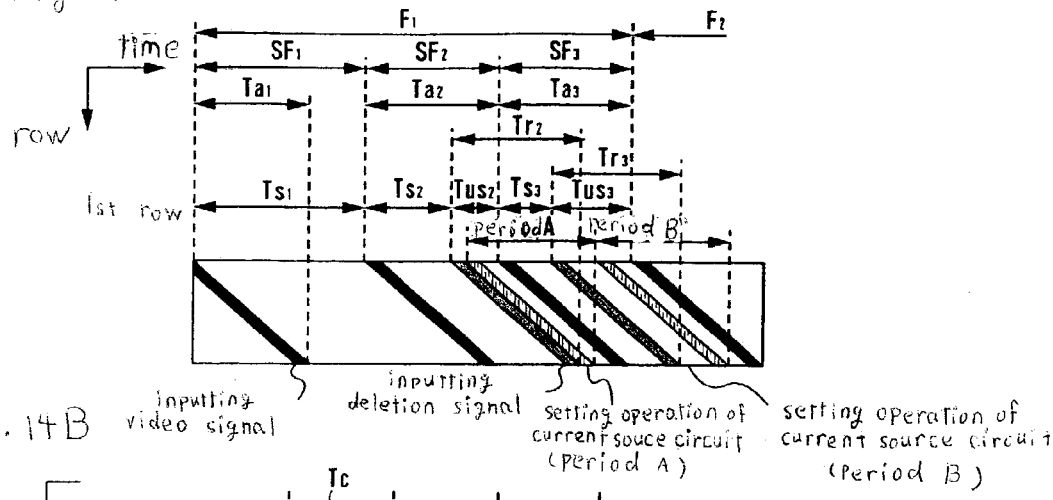
FIG. 14A and FIG. 14B are views showing a driving method of the display apparatus of the invention.
Figure 14B:
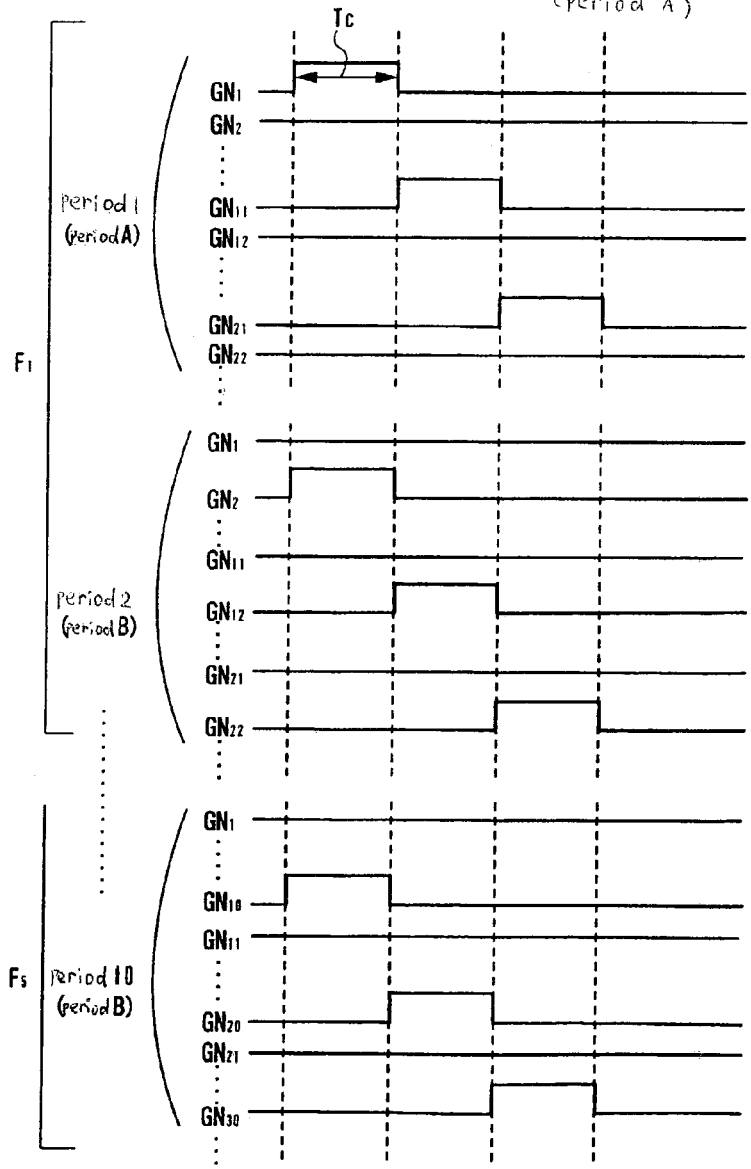

Then, a structure and a driving method of a display apparatus on the occasion of using the above-described techniques will be described. Firstly, a driving method in case that the setting operation of the pixel of one row is carried out by using the same length period as the period in which a plurality of the scanning lines are selected will be described. FIG. 14A and FIG. 14B are used for the description. In the figure, as an example, shown is a timing chart for carrying out the setting operation of the pixel of one row during a period in which ten scanning lines are selected.

FIG. 14A shows an operation of each row in each frame period. In addition, the same reference numerals and signs are given to the same portions as the timing chart shown in FIG. 4 in the embodiment 2, and the description thereof will be omitted. Here, shown is a case that one frame period is divided into three sub frame periods $SF_2$ and $SF_3$. In addition, it is configured that the non display period Tus is disposed in the sub frame periods $SF_1$ to $SF_3$, respectively. In the non display period Tus, the setting operation of the pixel is carried out (in the figure, the period A and the period B).

Then, the operation in the period A and the period B will be described in detail. FIG. 14B is used for the description. In addition, in the figure, a period in which the setting operation of the pixel is carried out is shown by the period in which the signal line GN is selected. In general, the signal line GB of the pixel of i (i is a natural number)-th row is shown by $Gn_i$. Firstly, in a period A of a first frame period $F_1$, $GN_1$, $GN_{11}$, $GN_{21}$, . . . are selected at intervals. By this means, carried out is the setting operation of the pixels of a first row, an eleventh row, a twenty first row, . . . (period 1). Then, in a period B of the first frame period $F_1$, $GN_2$, $GN_{12}$, $GN_{22}$, . . . are selected. By this means, carried out is the setting operation of the pixels of a second row, a twelfth row, a twenty second row, . . . (period 2). By repeating the above-described operations during 5 frame periods, the setting operations of all pixels are ordinarily carried out.

Here, a period which can be used for the setting operation of the pixel of one row is represented by Tc. in case of using the above-described driving method, it is possible to set Tc at ten times of the selection period of the scanning line G. By this means, it is possible to lengthen time which is used for the setting operation per one pixel. Also, it is possible to carry out the setting operation of the pixel efficiently and accurately.

In addition, in case that the ordinary setting operation is not enough, it is fine to carry out the setting operation of the pixel gradually by repeating the above-described operation a plurality of times.

Figure 15B:
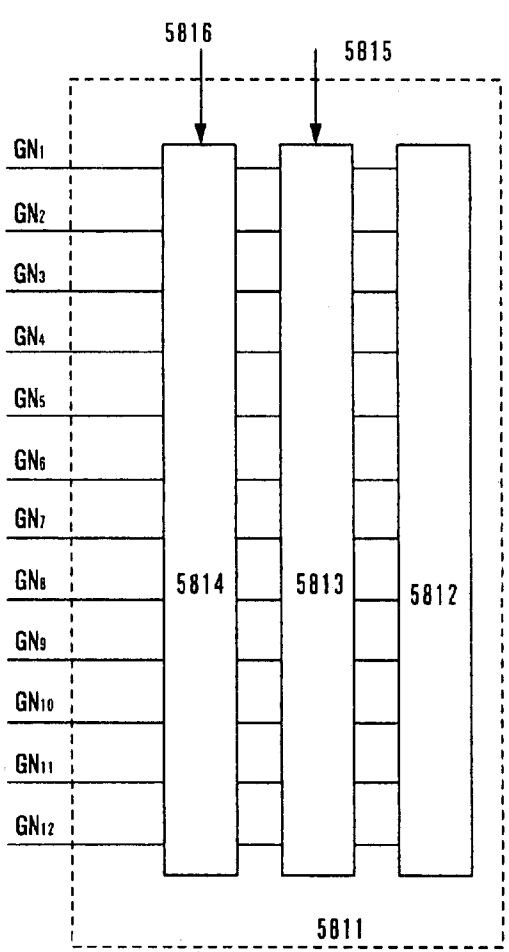
FIG. 15A and FIG. 15B are views showing structures of a drive circuit of the display apparatus of the invention.
Figure 15A:
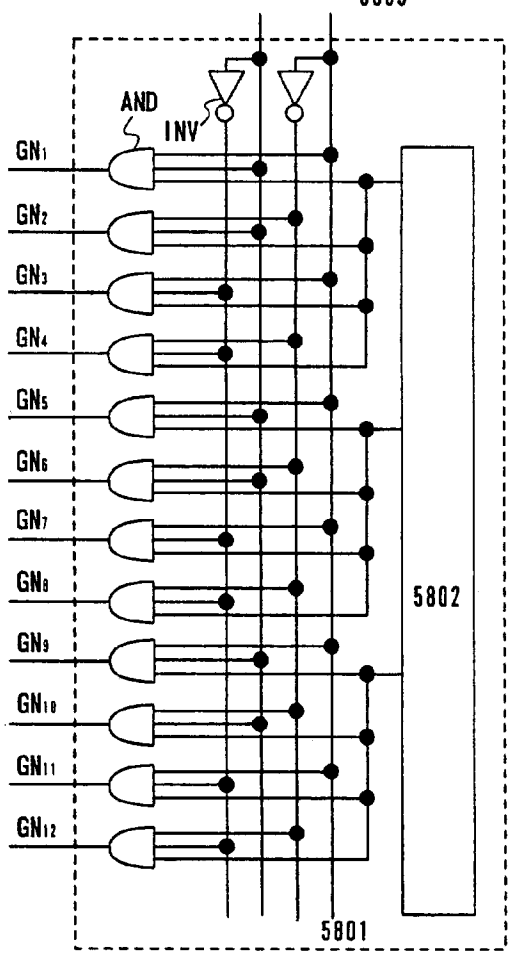

Then, a structure of a drive circuit on the occasion of using the above-described driving method will be described by use of FIG. 15A and FIG. 15B. In addition, FIG. 15A and FIG. 15B show a drive circuit which inputs a signal to the signal line GN. However, the same is applied to a signal which is inputted to other signal lines that the current source circuit has. Two structural examples of the drive circuit for carrying out the setting operation of the pixel will be cited.

A first example is the drive circuit of such a structure that an output of a shift register is switched by a switching signal to be outputted to the signal line GN. An example of this structure of the drive circuit (setting operation use drive circuit) is shown in FIG. 15A. A setting operation use drive circuit 5801 is configured by a shift register 5802, an AND circuit, an inverter circuit (INV) and so on. In addition, here shown is an example of the drive circuit of such a structure that one signal line GN is selected during a period which is four times of a pulse output period of the shift register 5802.

An operation of the setting operation use drive circuit 5801 will be described. The output of the shift register 5802 is selected by a switching signal 5803 and outputted to the signal line GN through the AND circuit.

A second example is the drive circuit of such a structure that a signal for selecting a specific row is latched by an output of a shift register. An example of the drive circuit of this structure (setting operation use drive circuit) is shown in FIG. 15B. A setting operation use drive circuit 5811 has a shift register 5812, a latch 1 circuit 5813, and a latch 2 circuit 5814.

An operation of the setting operation use drive circuit 5811 will be described. By an output of the shift register 5812, the latch 1 circuit 5813 holds a row selection signal 5815 in sequence. Here, the row selection signal 5815 is a signal for selecting an arbitrary output signal out of the output of the shift register 5812. The signal held in the latch 1 circuit 5813 is transferred to the latch 2 circuit 5814 by a latch signal 5816. By this means, a signal is inputted to a specific signal line GN.

In addition, even in the display period, in case of the current mirror type current source circuit, the setting operation can be carried out. Also, in the same transistor type current source circuit and the multi-gate type current source circuit, may be used such a drive method that the display period is once interrupted to thereby carry out the setting operation of the current source circuit, and after that, the display period is resumed.

It is possible to realize this embodiment by being freely combined with the embodiment 1 and the embodiment 2.

Embodiment 4

In this embodiment, a structure and an operation of each pixel will be described. In addition, a case that each pixel has two pairs of a switch part and a current source circuit is taken as an example. And, a case that structures of two current source circuits of the two pairs are selected from and combined with structures of the five current source circuits shown in the embodiment 3 will be described as an example.

A first combination example will be shown. In the first combination example, each of two current source circuits (a first current source circuit and a second current source circuit) that the pixel has is the current source circuit of the second structure shown in FIG. 12A. In addition, since a structure of these current source circuits is the same as in the embodiment 3, detail description will be omitted.

Figure 16:
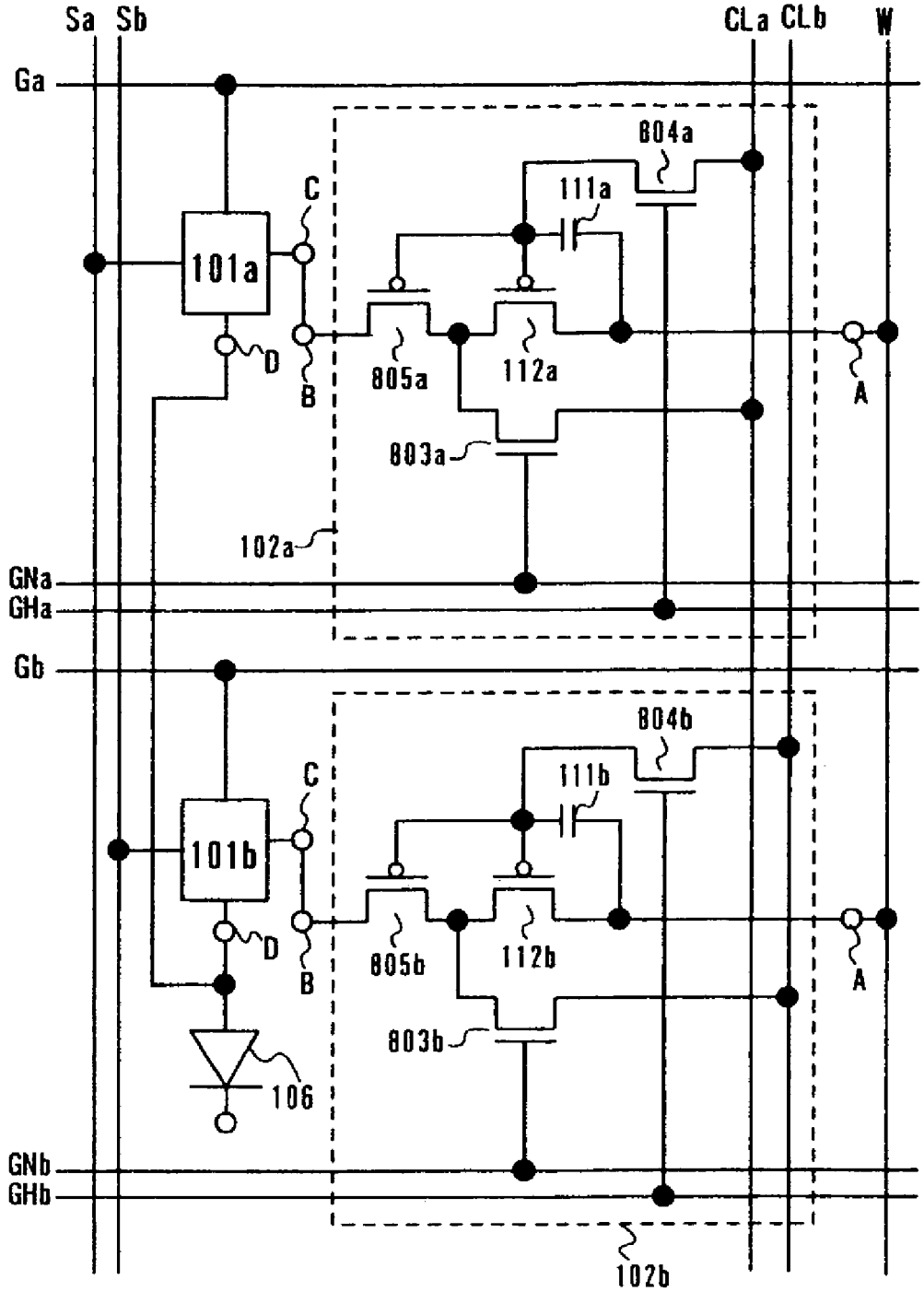
FIG. 16 is a view showing a structure of the pixel of the display apparatus of the invention.

FIG. 16 shows the structure of the pixel of the first combination example. In addition, in FIG. 16, the same reference numerals and signs are given to the same portions as in FIGS. 10A–E. In addition, a portion which corresponds to the first current source circuit is shown by adding a after the reference numerals of FIG. 12A, and a portion which corresponds to the second current source circuit is shown by adding b after the reference numerals of FIG. 12A. Also, description of a structure of the switch parts (a first switch part and a second switch part) of the two pairs of a switch part and a current source circuit that the pixel has will be omitted here by referring to the embodiment 2.

Figure 17B:
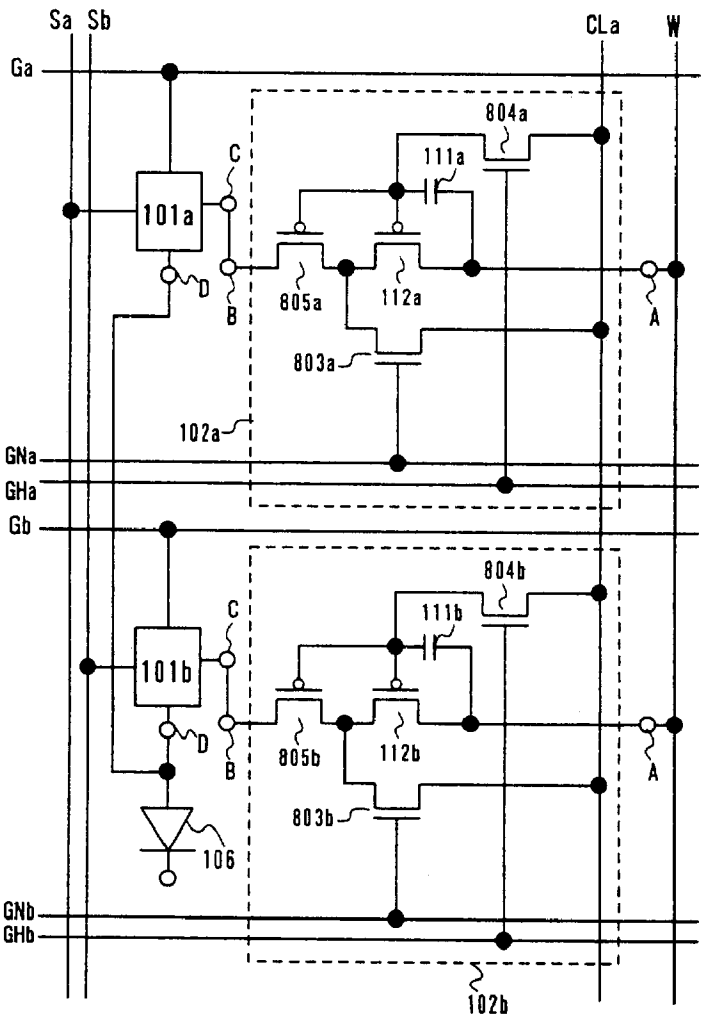
FIG. 17A and FIG. 17B are views showing structures of the pixel of the display apparatus of the invention.
Figure 17A:
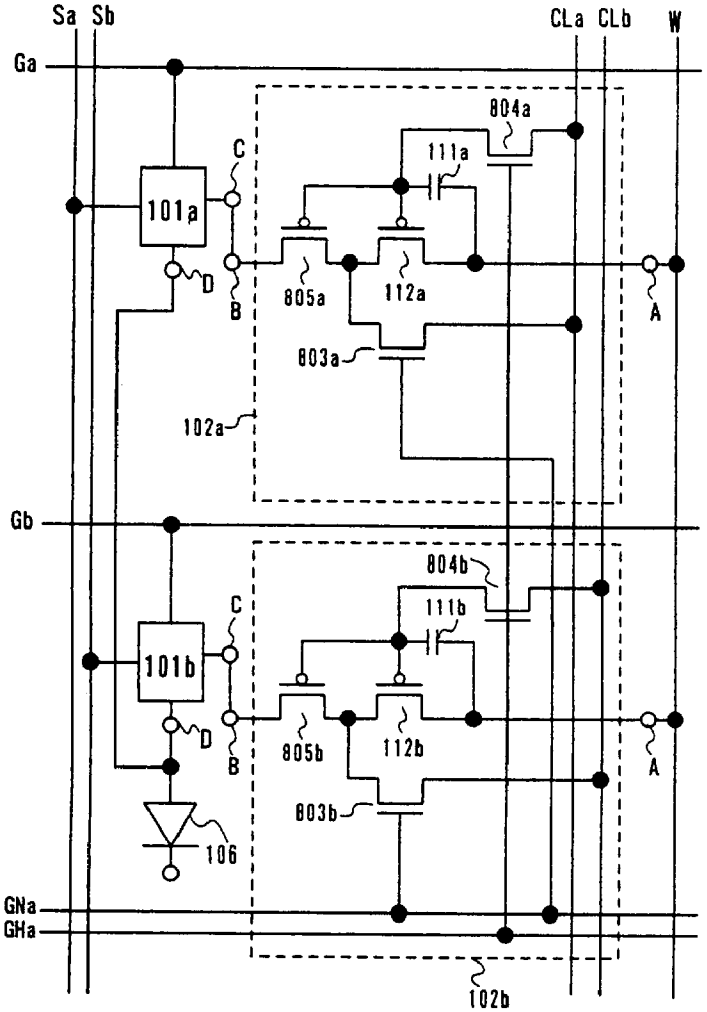

Here, the first current source circuit 102*a* and the second current source circuit 102*b* can share wirings and elements. And signal lines can be shared. For example, a signal line GNa and a signal line GNb can be shared. Also, a signal line GHa and a signal line GHb can be shared. Furthermore, a signal line GSa and a signal line GSb can be shared. This structure is shown in FIG. 17A. Also, a current line CLa and a current line CLb can be shared. This structure is shown in FIG. 17B. In addition, structures of FIG. 17A and FIG. 17B can be freely combined.

A way of setting of each current source circuit 102*a* and 102*b* is the same as in the embodiment 3. The current source circuits 102*a* and 102*b* are the multi-gate type current source circuit. Thus, it is desirable that its setting operation is carried out in synchronous with the operation of the switch part.

It is possible to realize this embodiment by being freely combined with the embodiment 1 to the embodiment 3.

Embodiment 5

In this embodiment, a description is made of the constitution and the operation of each pixel. Incidentally, the case where each pixel has two pairs of switch part and current source circuit is made an example. And, constitutions of the two current source circuits in these two pairs are explained with a case where some of the five constitutions of the current source circuit shown in the embodiment 3 are selected and combined being made an example.

Incidentally, a description is made of the 2nd combination example different from the 1st combination example shown in the embodiment 4. In the 2nd combination example, of the two current source circuits possessed by the pixel, the one (1st current source circuit) is the current source circuit of the 4th constitution shown in FIG. 12A. The other current source circuit (2nd current source circuit) is the current source circuit of the 1st constitution shown in FIG. 9A. Incidentally, since the constitutions of these current source circuits are similar to the embodiment 3, their detailed explanations are omitted.

Figure 18:
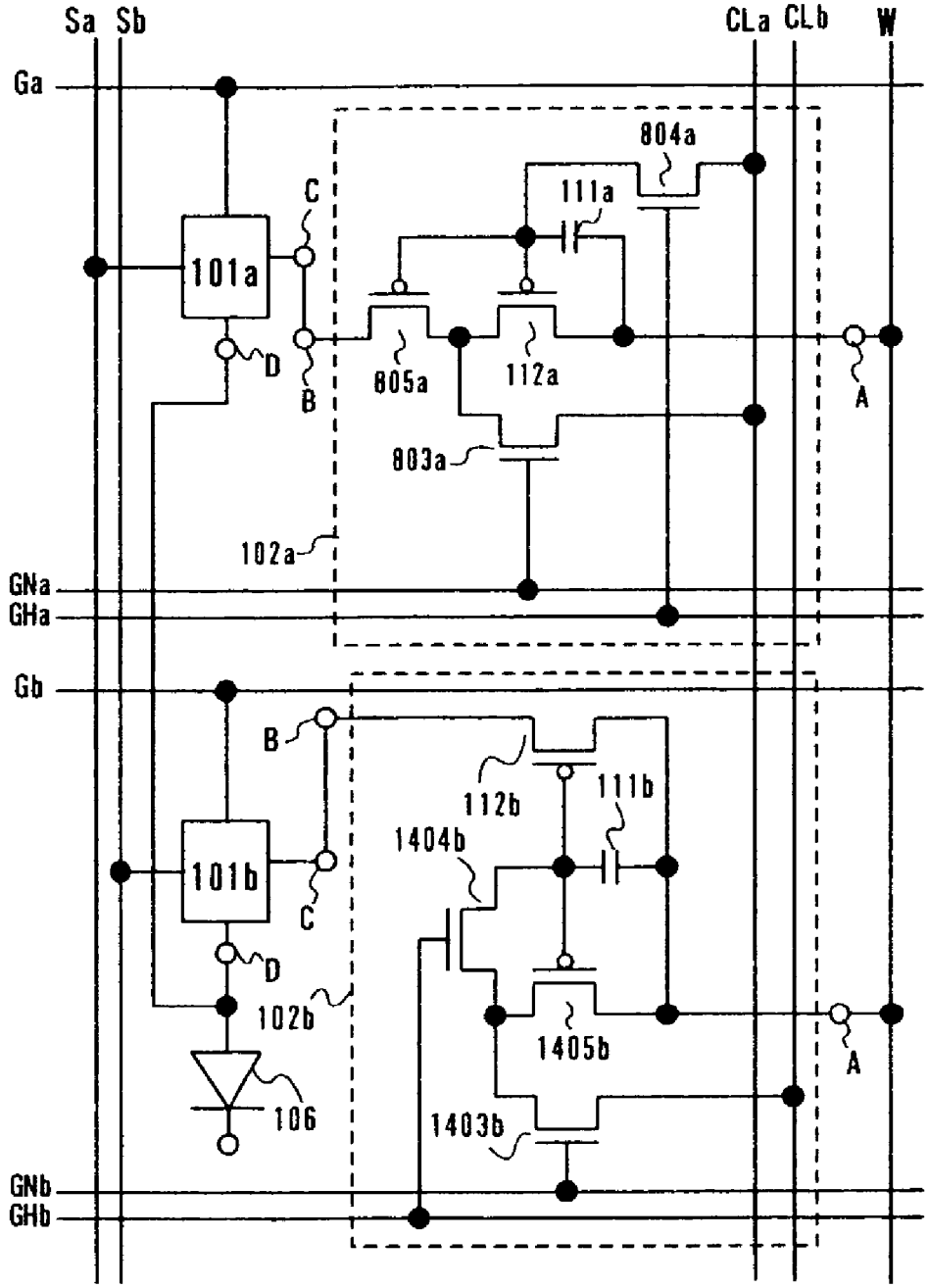
FIG. 18 is a view showing a structure of the pixel of the display apparatus of the invention.

The constitution of the pixel of the 2nd combination example is shown in FIG. 18. Incidentally, in FIG. 18, the same portion as FIG. 12A and FIG. 9A is denoted using the same sign. Incidentally, a portion corresponding to the 1st current source circuit is denoted with "a" added to the sign in FIG. 12A. Further, a portion corresponding to the 2nd current source circuit is denoted with "b" added to the sign in FIG. 9A. Further, as to the constitutions of the switch parts (1st switch part and 2nd switch part) of the two pairs of switch part and current source circuit possessed by each pixel, the embodiment 2 is referred, and here their explanations are omitted.

Figure 19B:
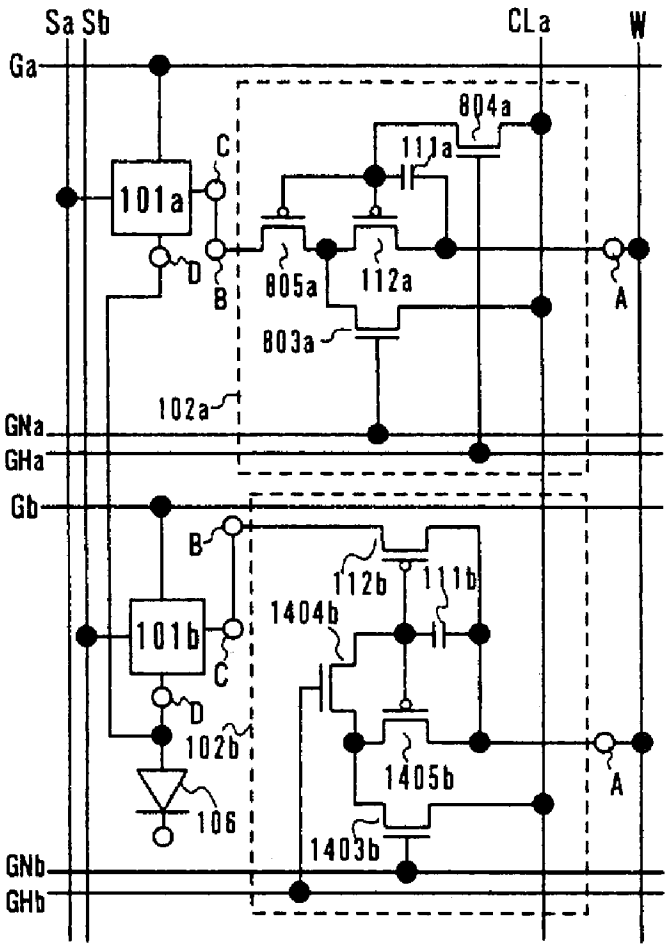
FIG. 19A and FIG. 19B are views showing structures of the pixel of the display apparatus of the invention.
Figure 19A:
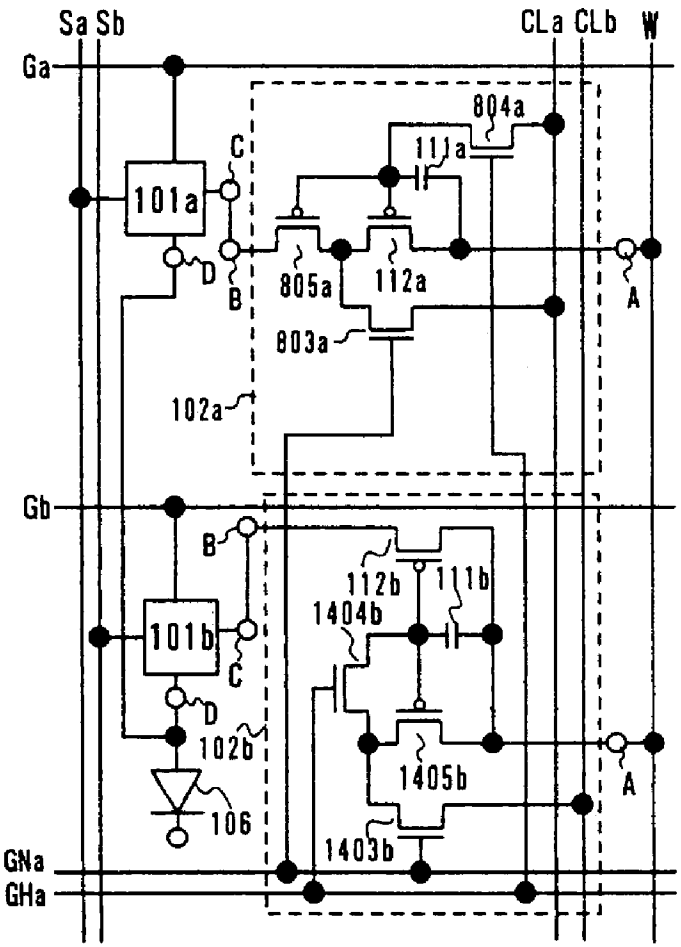
Figure 40:
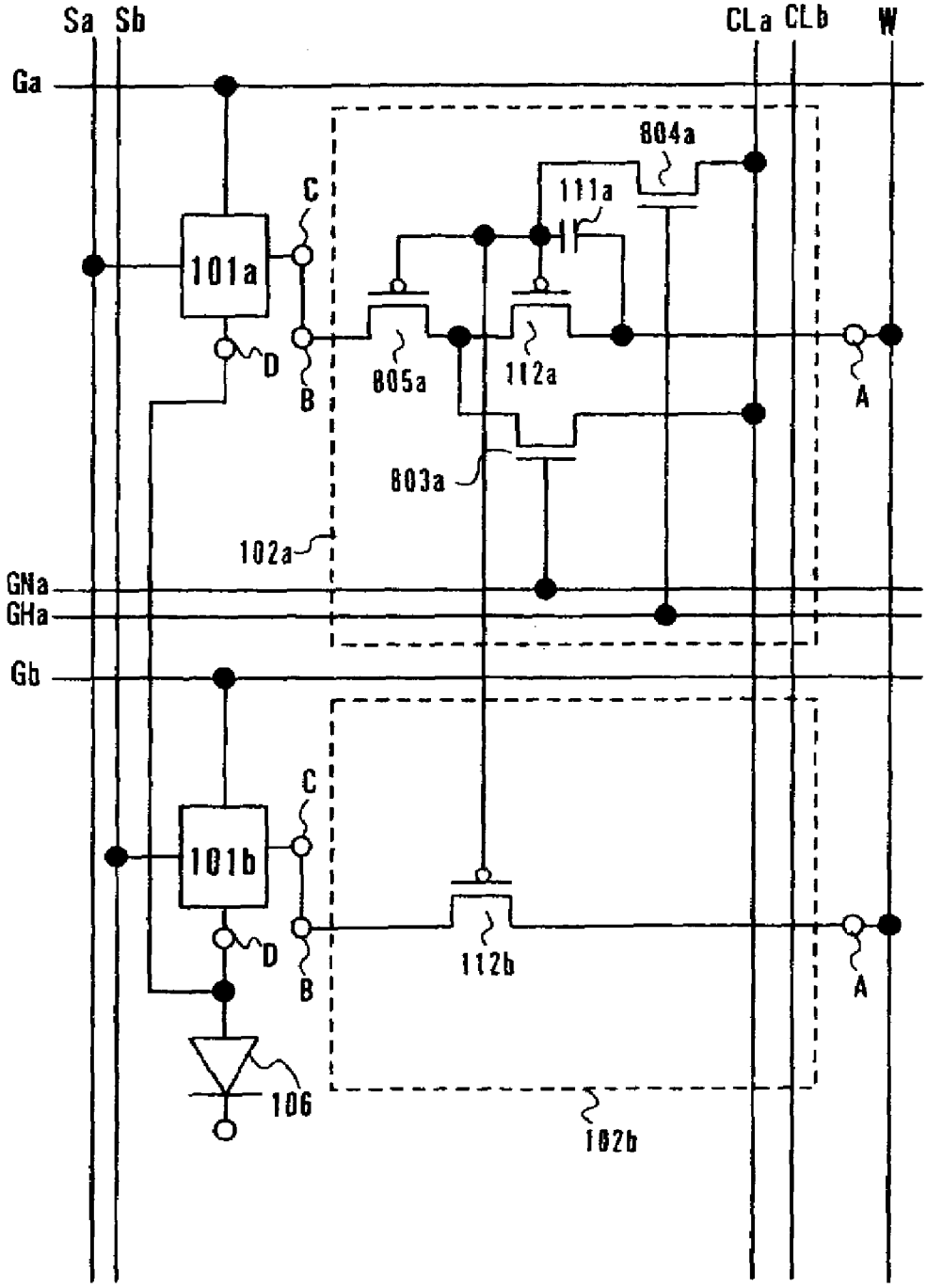
FIG. 40 is a view showing a structure of the pixel of the display apparatus of the invention.

Here, it is possible to hold the wiring and the element in common by the 1st current source circuit 102*a* and the 2nd current source circuit 102*b*. It is also possible to hold the current transistor 1405*b* in common between the different pixels. Further, it is possible to hold the current source capacity in common. This constitution is shown in FIG. 40. Further, it is possible to hold the signal wire in common. For example, it is possible to hold the signal wire GNa and the signal wire GNb in common. Further, it is possible to hold the signal wire GHa and the signal wire GHb in common. This constitution is shown in FIG. 19A. Or, it is possible to hold the current wire CLa and the current wire CLb in common. This constitution is shown in FIG. 19B. Incidentally, the constitutions of FIG. 40, FIG. 19A and FIG. 19B can be freely combined.

A method of respectively setting the current source circuits 102*a* and 102*b* is similar to the embodiment 3. The current source circuit 102*a* is the multi-gate type current source circuit. Therefore, it is desirable that its setting operation is performed synchronized with an operation of the switch part. On the other hand, the current source circuit 102*b* is the current mirror type current source circuit. Therefore, its setting operation can be performed without synchronized with the operation of the switch part.

In the pixel constitution of this embodiment, in case where the current values of the currents outputted respectively by the multi-gate type current source circuit and the current mirror type current source circuit of each pixel are made different, it is desirable to set the current value of the output current of the multi-gate current source circuit larger in comparison with the current value of the output current of the current mirror type current source circuit. Reason thereof is explained below.

As explained in the embodiment 3, the transistor to which the control current is inputted and a part of the transistor outputting the current to the light emitting element are held in common in the multi-gate type current source circuit, but these transistors are separate in the current mirror type current source circuit. For this reason, rather the current mirror type current source circuit can input the control current of the larger current value with respect to the current value of the output current than the multi-gate type current source circuit. By using the control current of the larger current value, the setting operation of the current source circuit can be performed rapidly and accurately because it is not easily influenced by a noise and the like. For this reason, in case where the output current of the same current value is set for instance, the setting operation of the current source circuit becomes slower rather in the multi-gate type current source circuit than the current mirror type current source circuit. Accordingly, as to the multi-gate type current source circuit, it is desirable to perform the setting operation of the current source circuit rapidly and accurately by making the current value of the output current larger than the current mirror type current source circuit to thereby make the current value of the control current larger.

Further, as explained in the embodiment 3, in the current mirror type current source circuit, the dispersion of the output current is larger in comparison with the multi-gate type current source circuit. As to the output current of the current source circuit, the larger its current value is, the more appears an influence of the dispersion. For this reason, in case where the output current of the same current value is set for instance, the dispersion of the output current becomes larger rather in the current mirror type current source circuit than the multi-gate type current source circuit. Accordingly, as to the current mirror type current source circuit, it is desirable to reduce the dispersion of the output current by making the current value of the output current smaller than the multi-gate type current source circuit.

By the above, in the pixel constitution of this embodiment, in case where the current values of the currents respectively outputted by the multi-gate type current source circuit and the current mirror type current source circuit of each pixel are made different, it is desirable to set the current value of the output current of the multi-gate type current source circuit larger in comparison with the current value of the output current of the current mirror type current source circuit.

Further, in case where the pixel constitution of FIG. 40 is used, it is desirable to set the output current of the current source circuit 102*a* larger than the output current of the current source circuit 102*b*. In this manner, by making the output current of the current source circuit 102*a* performing the setting operation larger, the setting operation can be performed rapidly. Further, as to the current source circuit 102*b* in which the drain current of the transistor 112*b* different from the transistor, to which the control current is inputted, is made into the output current, the influence of the dispersion can be reduced by setting the output current small.

It is possible to perform this embodiment by being freely combined with the embodiments 1 to the embodiment 3.

Embodiment 6

In this embodiment, a description is made of the constitution and the operation of each pixel. Incidentally, the case where each pixel has two pairs of switch part and current source circuit is made an example. And, constitutions of the two current source circuits in these two pairs are explained with a case where some of the five constitutions of the current source circuit shown in the embodiment 3 are selected and combined being made an example.

Incidentally, a description is made of the 3rd combination example different from the 1st combination example and the 2nd combination example shown in the embodiment 4 and the embodiment 5. In the 3rd combination example, among the two current source circuits possessed by the pixel, one (1st current source circuit) is the current source circuit of the 4th constitution shown in FIG. 12A. Another one current source circuit (2nd current source circuit) is the current source circuit of the 3rd constitution shown in FIG. 11A. Incidentally, since the constitutions of these current source circuits are similar to the embodiment 3, their detailed explanations are omitted.

Figure 20:
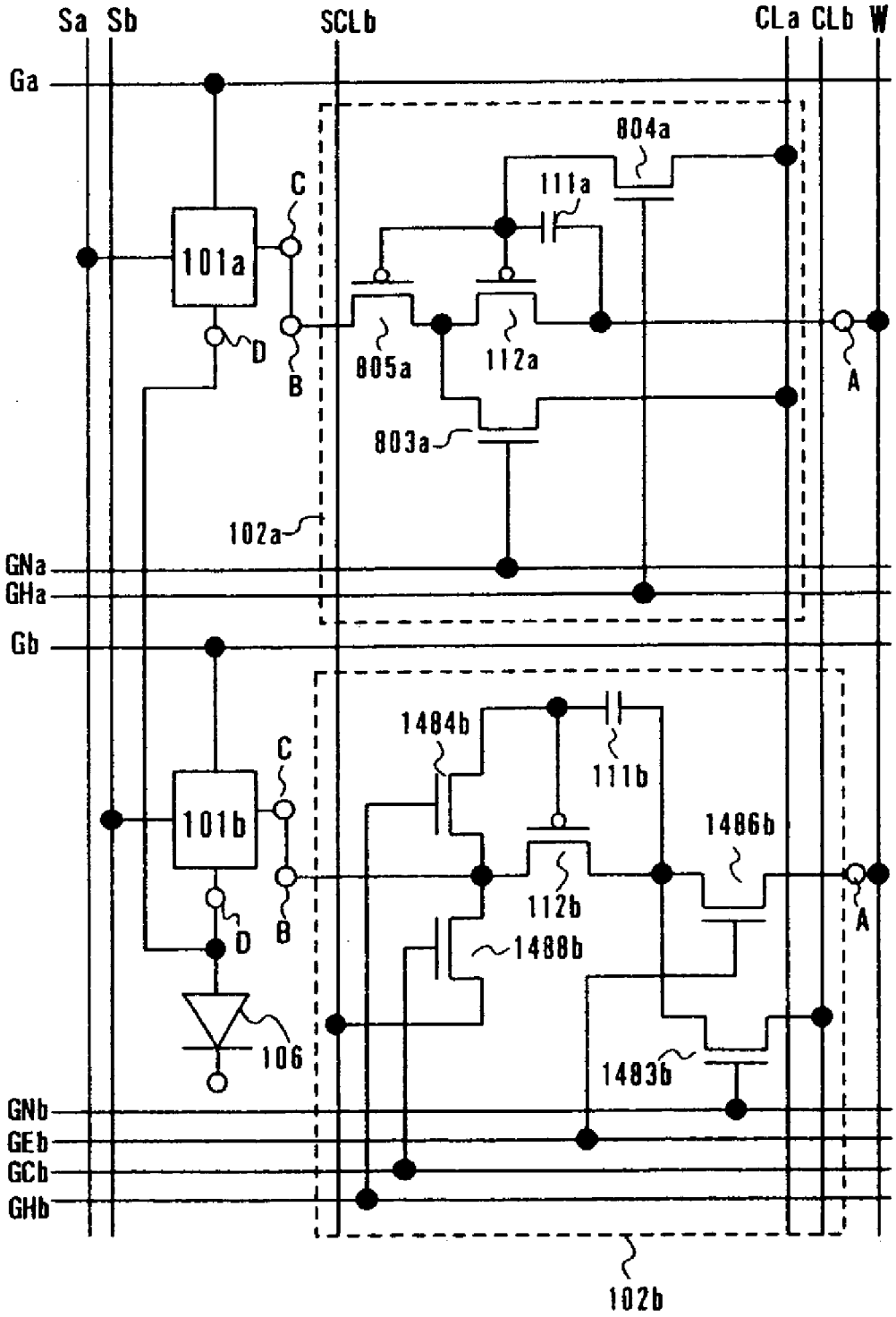
FIG. 20 is a view showing a structure of the pixel of the display apparatus of the invention.

The constitution of the pixel of the 3rd combination example is shown in FIG. 20. Incidentally, in FIG. 20, the portion as FIG. 12A and FIG. 11A is denoted using the same sign. Incidentally, a portion corresponding to the 1st current source circuit is denoted with "a" added to the sign in FIG. 12A. Further, a portion corresponding to the 2nd current source circuit is denoted with "b" added to the sign in FIG. 11A. Further, as to the constitutions of the switch parts (1st switch part and 2nd switch part) of the two pairs of switch part and current source circuit possessed by each pixel, the embodiment 2 is referred, and here their explanations are omitted.

Figure 21A:
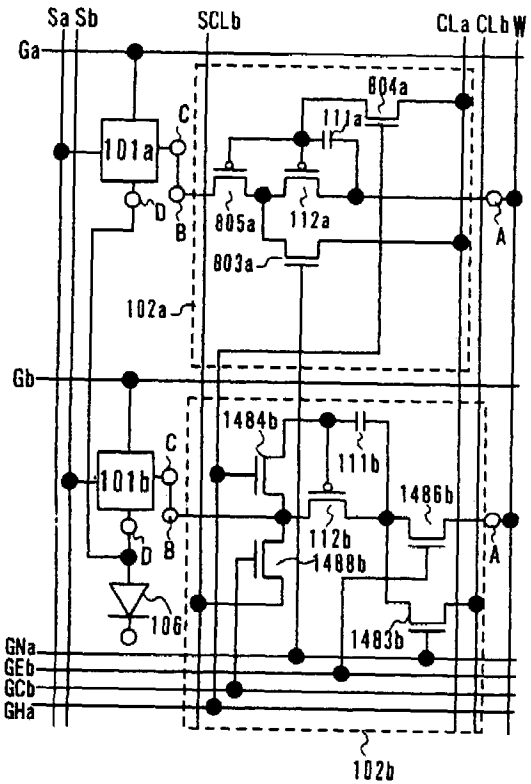
FIGS. 21A–21C are views showing structures of the pixel of the display apparatus of the invention.
Figure 21B:
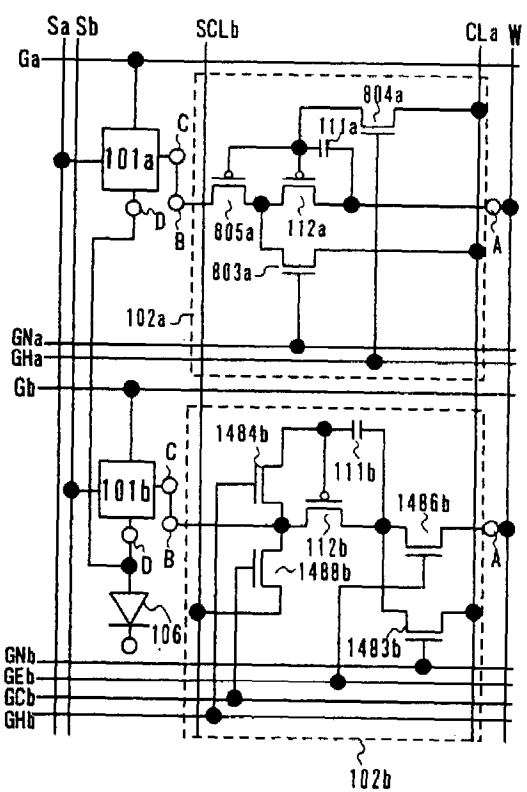
Figure 21C:
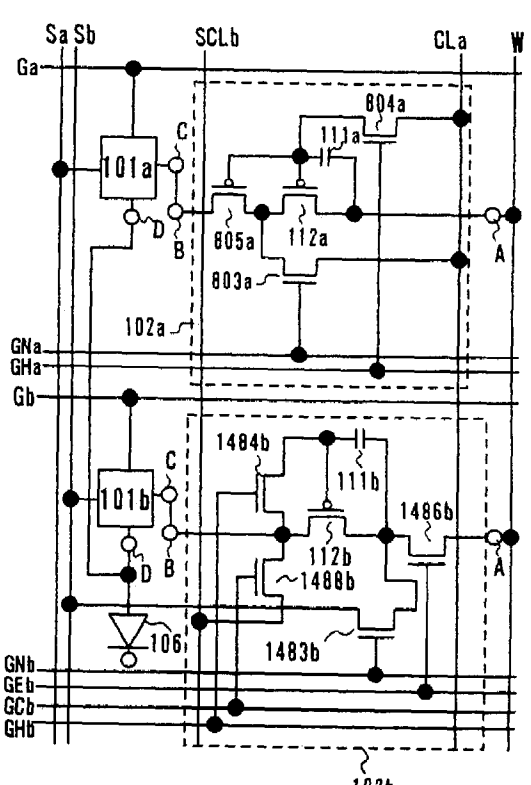

Here, it is possible to hold the wiring and the element in common by the 1st current source circuit 102*a* and the 2nd current source circuit 102*b*. For example, it is possible to hold the current source capacity in common. This constitution becomes the same as FIG. 40. It is possible to hold the signal wire in common. For example, it is possible to hold the signal wire GNa and the signal wire GNb in common. Further, it is possible to hold the signal wire GHa and the signal wire GHb in common. This constitution is shown in FIG. 21A. Or, it is possible to hold the current wire CLa and the current wire CLb in common. This constitution is shown in FIG. 21B. Or, it is possible to use the signal wire Sb in place of the current wire CLb. This constitution is shown in FIG. 21C. Incidentally, the constitutions of FIG. 40 and FIG. 21A–FIG. 21C can be freely combined.

A method of respectively setting the current source circuits 102*a* and 102*b* is similar to the embodiment 3. The current source circuit 102*a* is the multi-gate type current source circuit. Therefore, it is desirable that its setting operation is performed synchronized with an operation of the switch part. Further, the current source circuit 102*b* is the same transistor type current source circuit. Therefore, it is desirable that its setting operation is performed synchronized with the operation of the switch part.

In the pixel constitution of this embodiment, in case where the current values of the currents outputted respectively by the same transistor type current source circuit and the multi-gate type current source circuit of each pixel are made different, it is desirable to set the current value of the output current of the same transistor type current source circuit larger in comparison with the current value of the output current of the multi-gate type current source circuit. Reason thereof is explained below.

As explained in the embodiment 3, in the same transistor type current source circuit it is necessary to input the control current whose current value is equal to the output current, but in the multi-gate current source circuit, it is possible to input the control current of the larger current value with respect to the current value of the output current. By using the control current of the larger current value, the setting operation of the current source circuit can be performed rapidly and accurately because it is not easily influenced by a noise and the like. For this reason, in case where the output current of the same current value is set for instance, the setting operation of the current source circuit becomes slower rather in the same transistor type current source circuit than the multi-gate type current source circuit. Accordingly, as to the same transistor type current source circuit, it is desirable to perform the setting operation of the current source circuit rapidly and accurately by making the current value of the output current larger than the multi-gate type current source circuit to thereby make the current value of the control current larger.

Further, as explained in the embodiment 3, in the multi-stage type current source circuit, the dispersion of the output current is larger in comparison with the same transistor type current source circuit. As to the output current of the current source circuit, the larger its current value is, the more appears the influence of the dispersion. For this reason, in case where the output current of the same current value is set for instance, the dispersion of the output current becomes larger rather in the multi-gate type current source circuit than the same transistor type current source circuit. Accordingly, as to the multi-gate type current source circuit, it is desirable to reduce the dispersion of the output current by making the current value of the output current smaller than the same transistor type current source circuit.

By the above, in the pixel constitution of this embodiment, in case where the current values of the currents respectively outputted by the same transistor type current source circuit and the multi-gate type current source circuit of each pixel are made different, it is desirable to set the current value of the output current of the same transistor type current source circuit larger in comparison with the current value of the output current of the multi-gate type current source circuit.

It is possible to perform this embodiment by being freely combined with the embodiment 1 to the embodiment 3.

Embodiment 7

In this embodiment, a structure and an operation of each pixel will be described. In addition, a case that each pixel has two pairs of a switch part and a current source circuit is taken as an example. And, a case that structures of two current source circuits of two pairs are selected from and combined with structures of the five current source circuits shown in the embodiment 3 will be described as an example.

In addition, a fourth combination example, which is different from the first combination example to the third combination example shown in the embodiment 4 to the embodiment 6, will be described. In the fourth combination example, one (a first current source circuit) of two current source circuits that the pixel has is the current source structure of the fourth structure shown in FIG. 12A. The other current source circuit (a second current source circuit) is the current source circuit of the second structure shown in FIG. 10A. In addition, since a structure of these current source circuits is the same as in the embodiment 3, detail description will be omitted.

Figure 22:
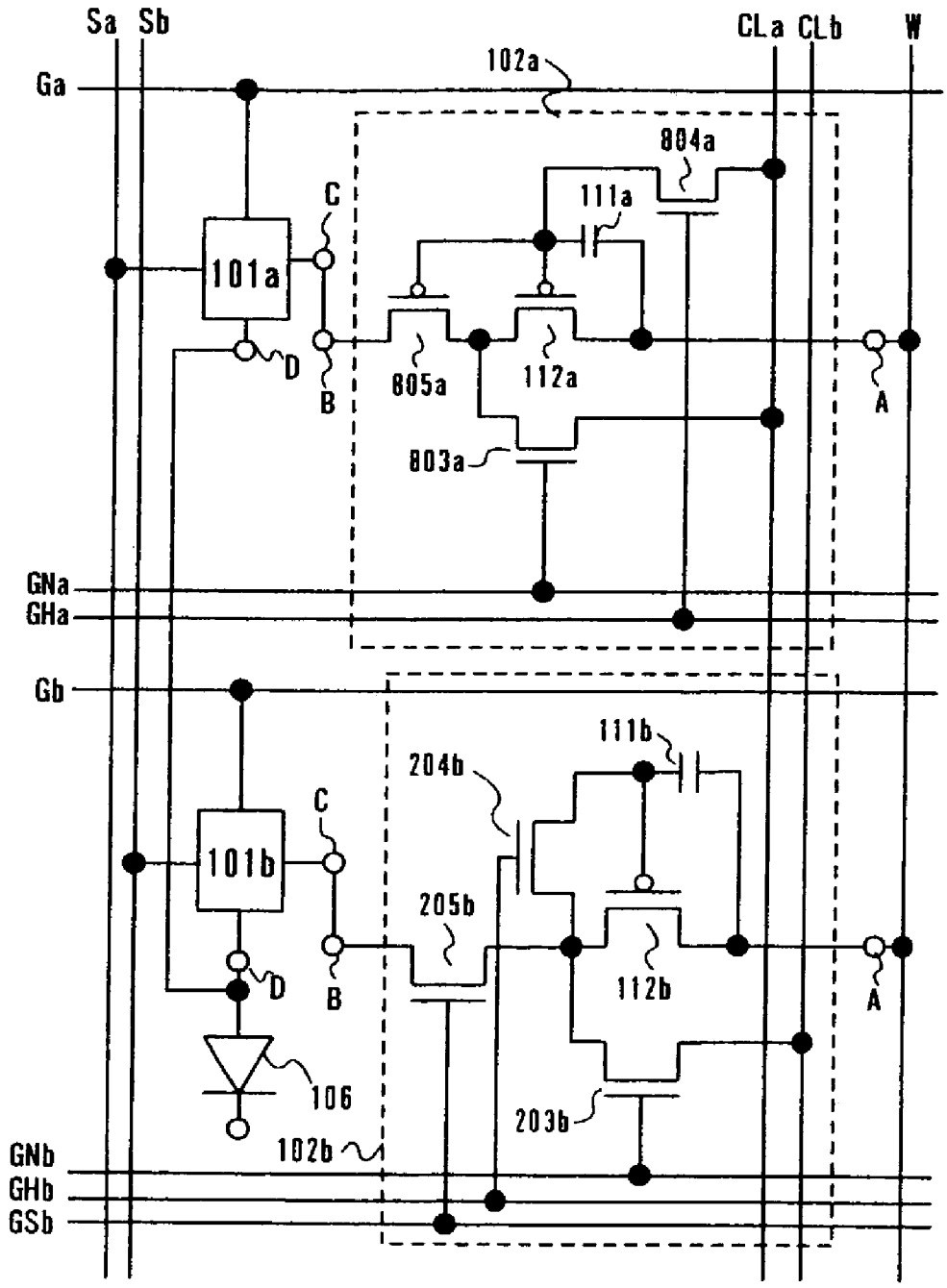
FIG. 22 is a view showing a structure of the pixel of the display apparatus of the invention.

FIG. 22 shows the structure of the pixel of the fourth combination example. In addition, in FIG. 22, the same reference numerals and signs are given to the same portions as in FIG. 10A and FIG. 12A. In addition, a portion which corresponds to the first current source circuit is shown by adding a after the reference numerals of FIG. 12A, and a portion which corresponds to the second current source circuit is shown by adding b after the reference numerals of FIG. 10A. Also, description of a structure of the switch parts (a first switch part and a second switch part) of the two pairs of a switch part and a current source circuit that each pixel has will be omitted here by referring to the embodiment 2.

Figure 23C:
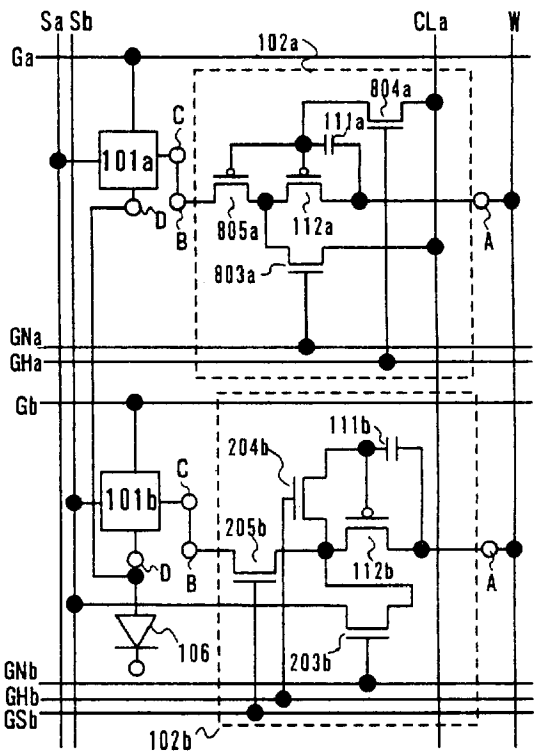
FIGS. 23A–23C are views showing structures of the pixel of the display apparatus of the invention.
Figure 23B:
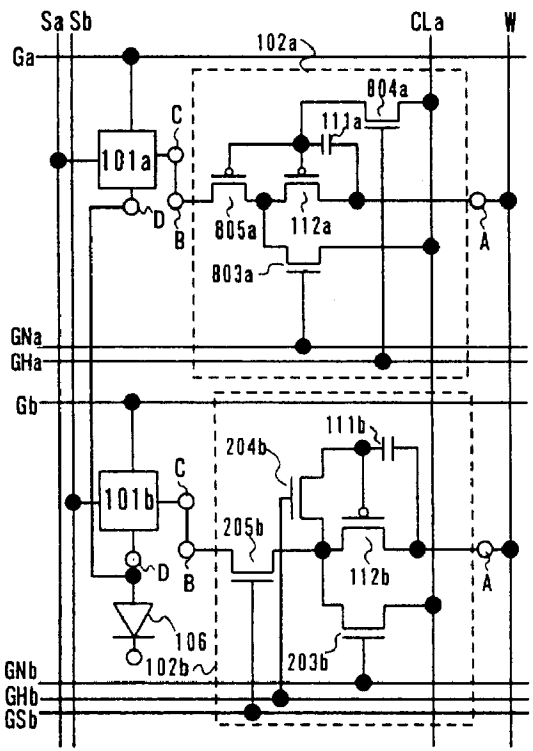
Figure 23A:
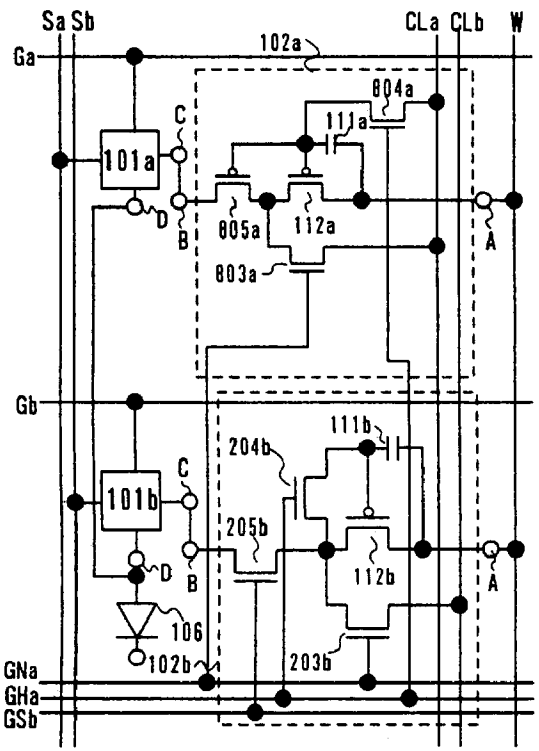

Here, the first current source circuit 102*a* and the second current source circuit 102*b* can share wirings and elements. And signal lines can be shared. For example, a signal line GNa and a signal line GNb can be shared. Also, a signal like GHa and a signal line GHb can be shared. This structure is shown in FIG. 23A. Also, a current line CLa and a current line CLb can be shared. This structure is shown in FIG. 23B. Also, in lieu of the current line CLb, a signal line Sb can be used. This structure is shown in FIG. 23C. In addition, structures of FIGS. 23A to 23C can be freely combined.

A way of setting of each current source circuit 102*a* and 102*b* is the same as in the embodiment 3. The current source circuit 102*a* is the multi-gate type current source circuit. Thus, it is desirable that its setting operation is carried out in synchronous with the operation of the switch part. Also, the current source circuit 102*b* is the same transistor type current source circuit. Thus, it is desirable that its setting operation is carried out in synchronous with the operation of the switch part.

In a pixel structure of this embodiment, in case that current values of currents which are outputted by the same transistor type current source circuit and the multi-gate type current source circuit of each pixel are made to differ, it is desirable that an output current of the same transistor type current source circuit is set larger as compared to a current value of an output current of the multi-gate type current source circuit. A reason thereof is the same as in the embodiment 6, the description will be omitted.

It is possible to realize this embodiment by being freely combined with the embodiment 1 to the embodiment 3.

Embodiment 8

In this embodiment, a structure and an operation of each pixel will be described. In addition, a case that each pixel has two pairs of a switch part and a current source circuit is taken as an example. And, a case that structures of two current source circuits of two pairs are selected from and combined with structures of the five current source circuits shown in the embodiment 3 will be described as an example.

In addition, a fifth combination example, which is different from the first combination example to the fourth combination example shown in the embodiment 4 to the embodiment 7, will be described. In the fifth combination example, one (a first current source circuit) of two current source circuits that the pixel has is the current source structure of the fourth structure shown in FIG. 12A. The other current source circuit (a second current source circuit) is the current source circuit of the fifth structure shown in FIG. 13A. In addition, since a structure of these current source circuits is the same as in the embodiment 3, detail description will be omitted.

Figure 24:
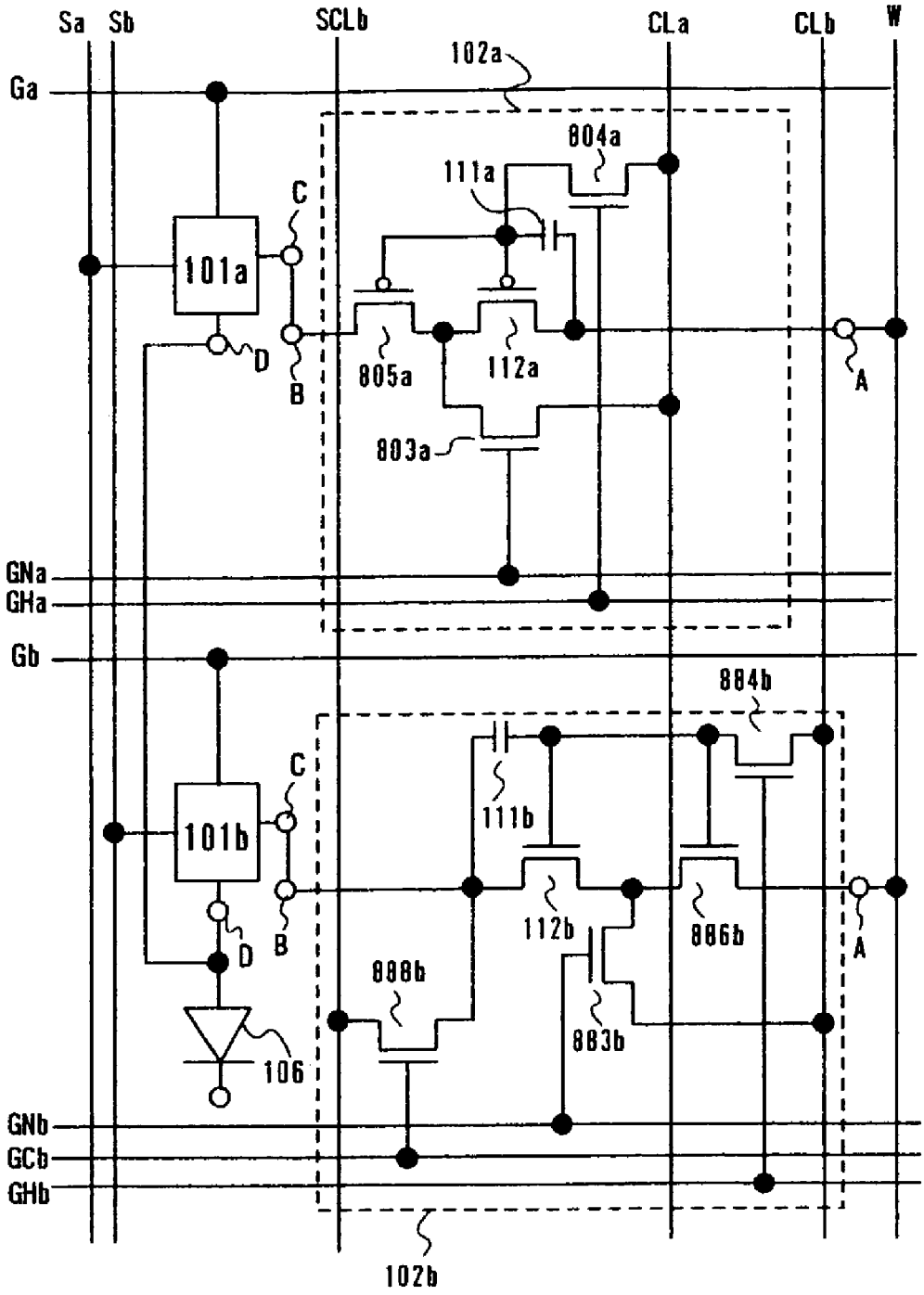
FIG. 24 is a view showing a structure of the pixel of the display apparatus of the invention.

FIG. 24 shows the structure of the pixel of the fifth combination example. In addition, in FIG. 24, the same reference numerals and signs are given to the same portions as in FIG. 12A and FIG. 13A. In addition, a portion which corresponds to the first current source circuit is shown by adding a after the reference numerals of FIG. 12A, and a portion which corresponds to the second current source circuit is shown by adding b after the reference numerals of FIG. 13A. Also, description of a structure of the switch parts (a first switch part and a second switch part) of the two pairs of a switch part and a current source circuit that each pixel has will be omitted here by referring to the embodiment 2.

Figure 25B:
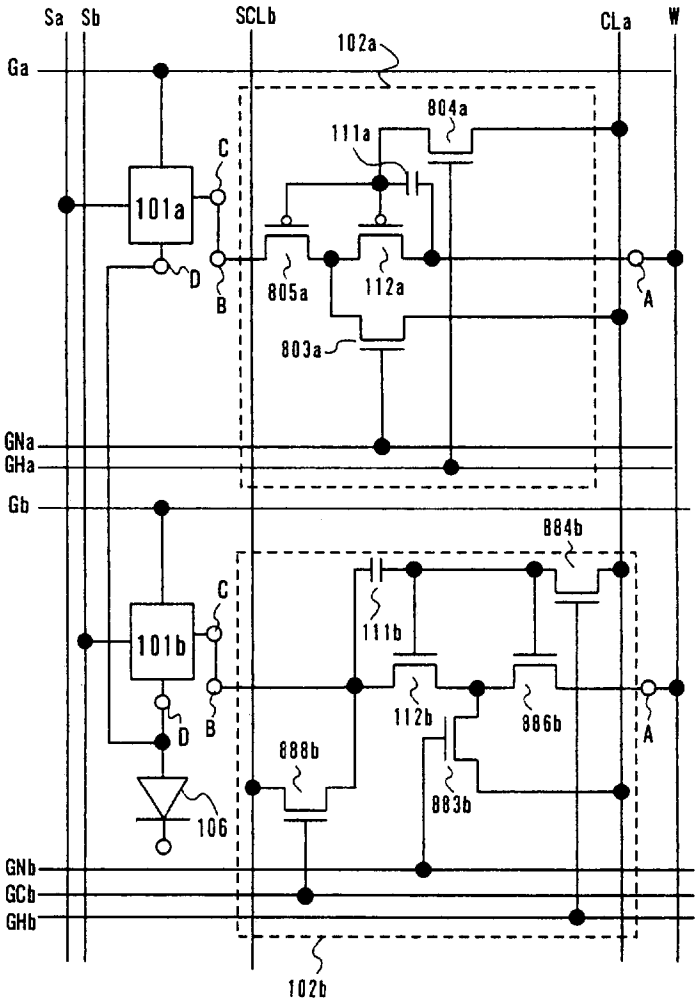
FIG. 25A and FIG. 25B are views showing structures of the pixel of the display apparatus of the invention.
Figure 25A:
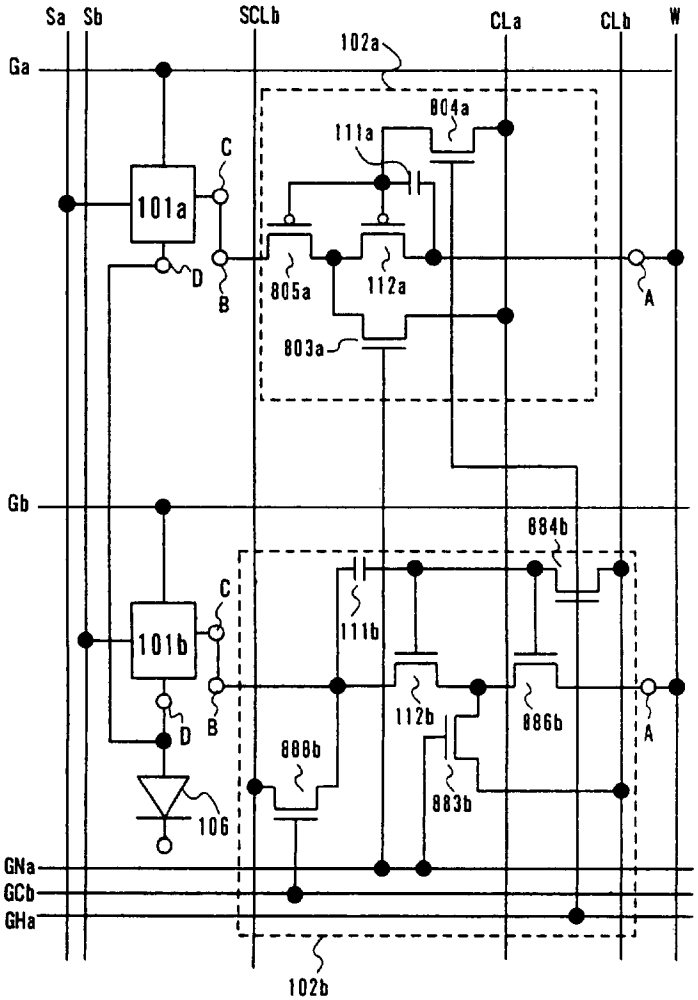
Figure 26:
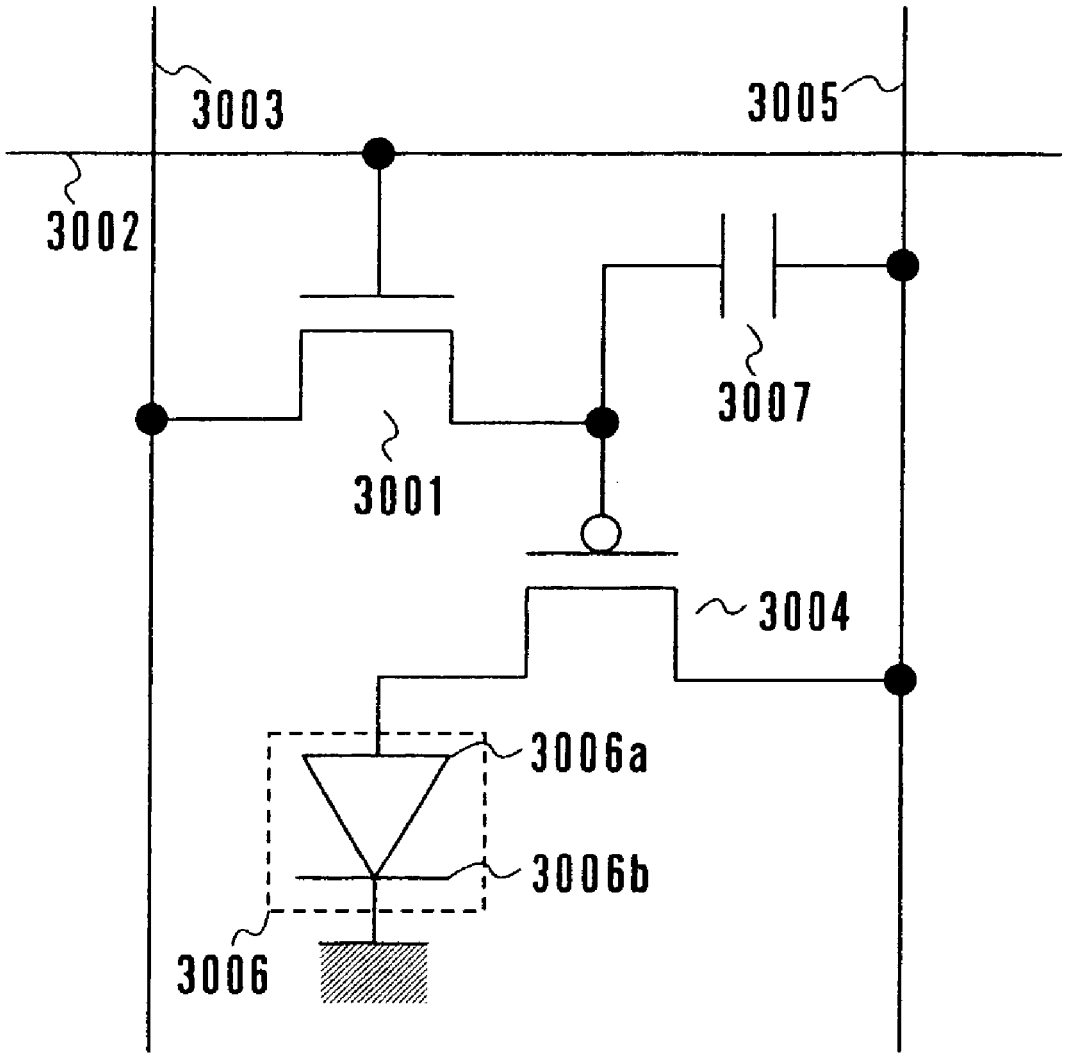
FIG. 26 is a view showing a structure of a pixel of a conventional display apparatus.
Figure 27B:
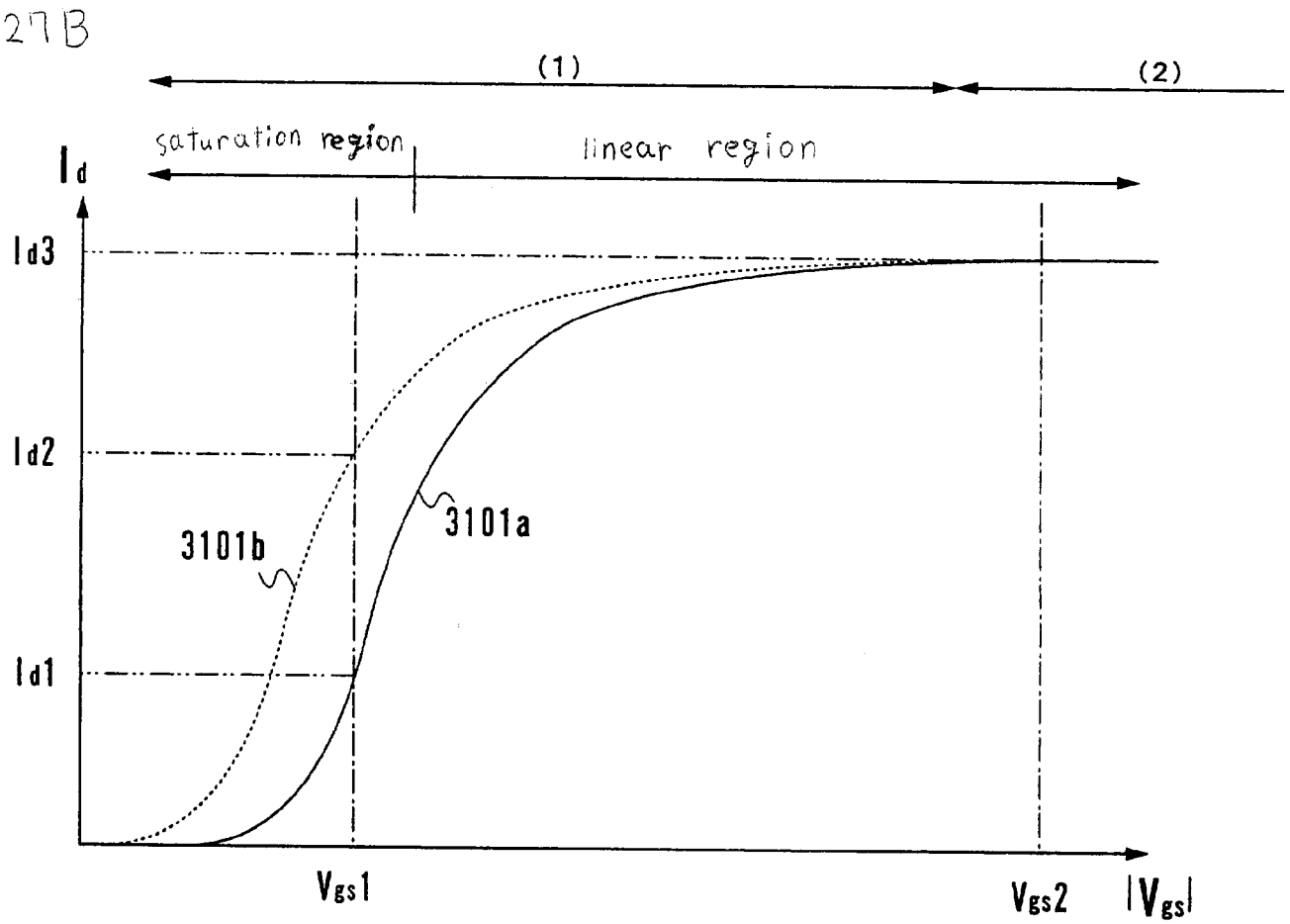
Fig.27B PRIOR ART
FIG. 27A and FIG. 27B are views showing an operation region of a drive TFT of the conventional display apparatus.
Figure 27A:
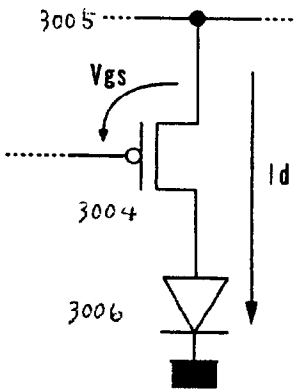
Figure 28:
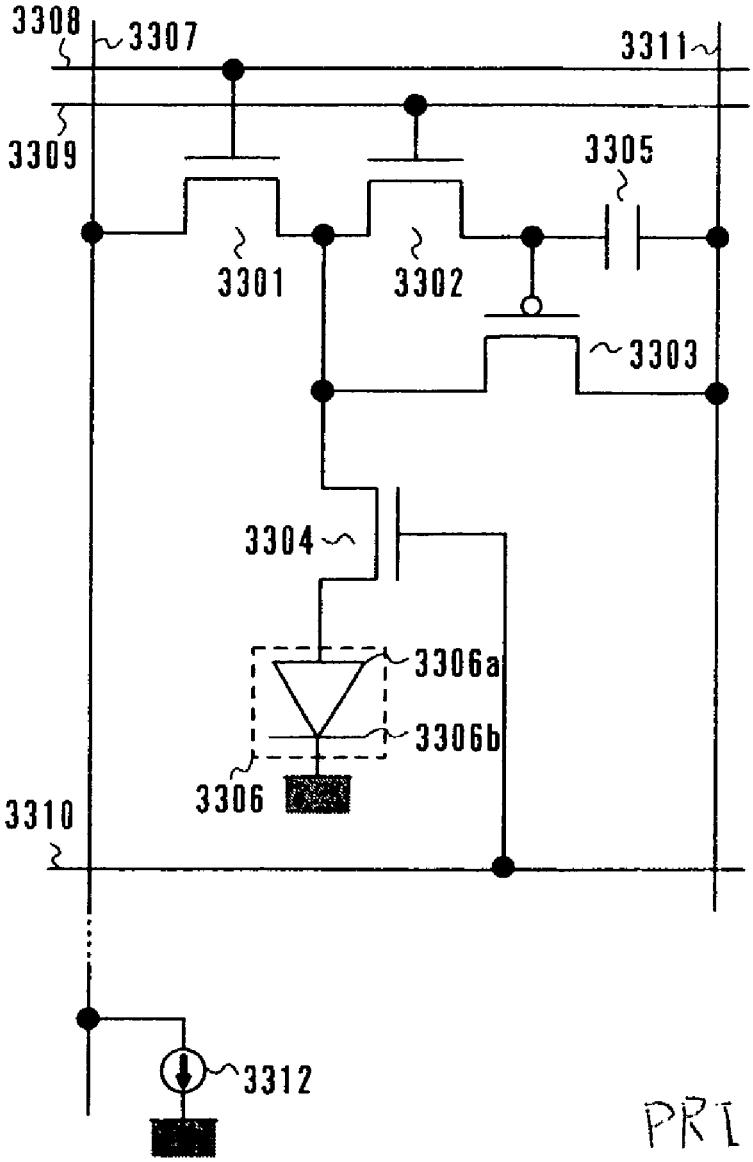
FIG. 28 is a view showing a structure of a pixel of the conventional display apparatus.
Figure 30A:
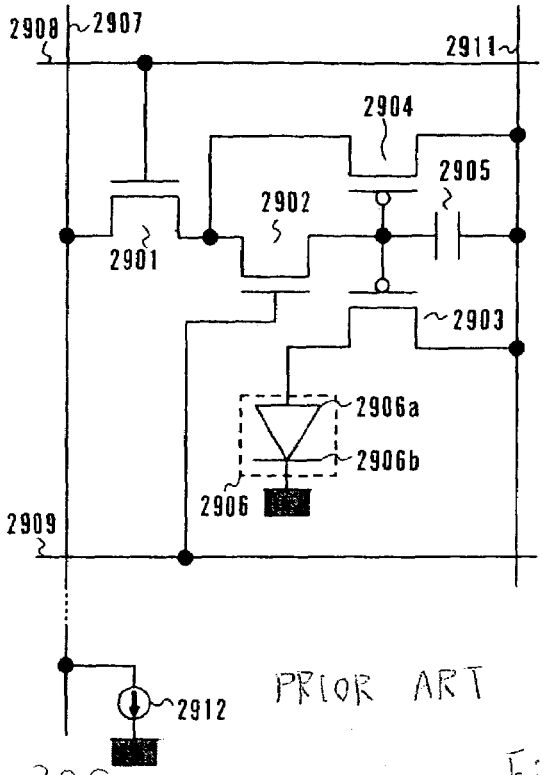
FIGS. 30A–30D are views showing the structure and the operation of the pixel of the conventional display apparatus.
Figure 30B:
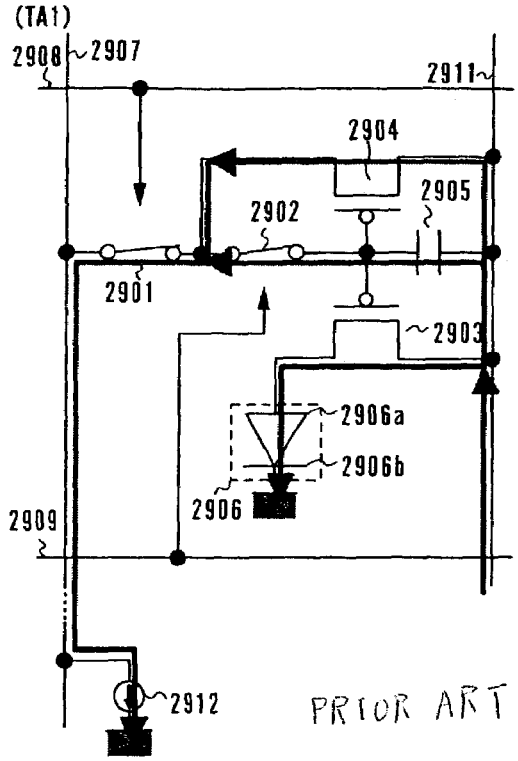
PRIOR ART Fig. 30B
Figure 30C:
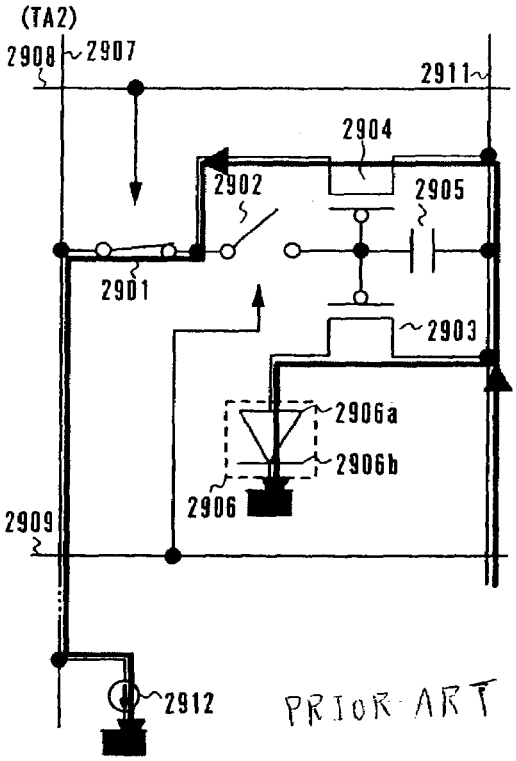
PRIOR ART Fig. 30C
Figure 30D:
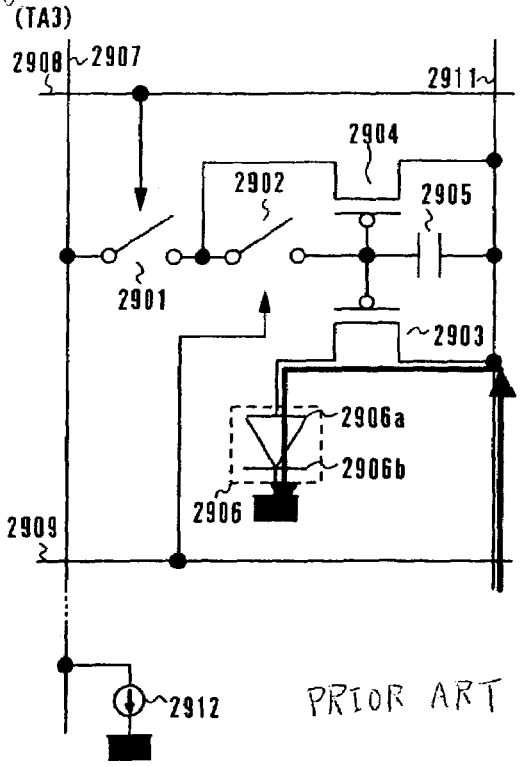
PRIOR ART Fig. 30D
Figures 31A, 31B:
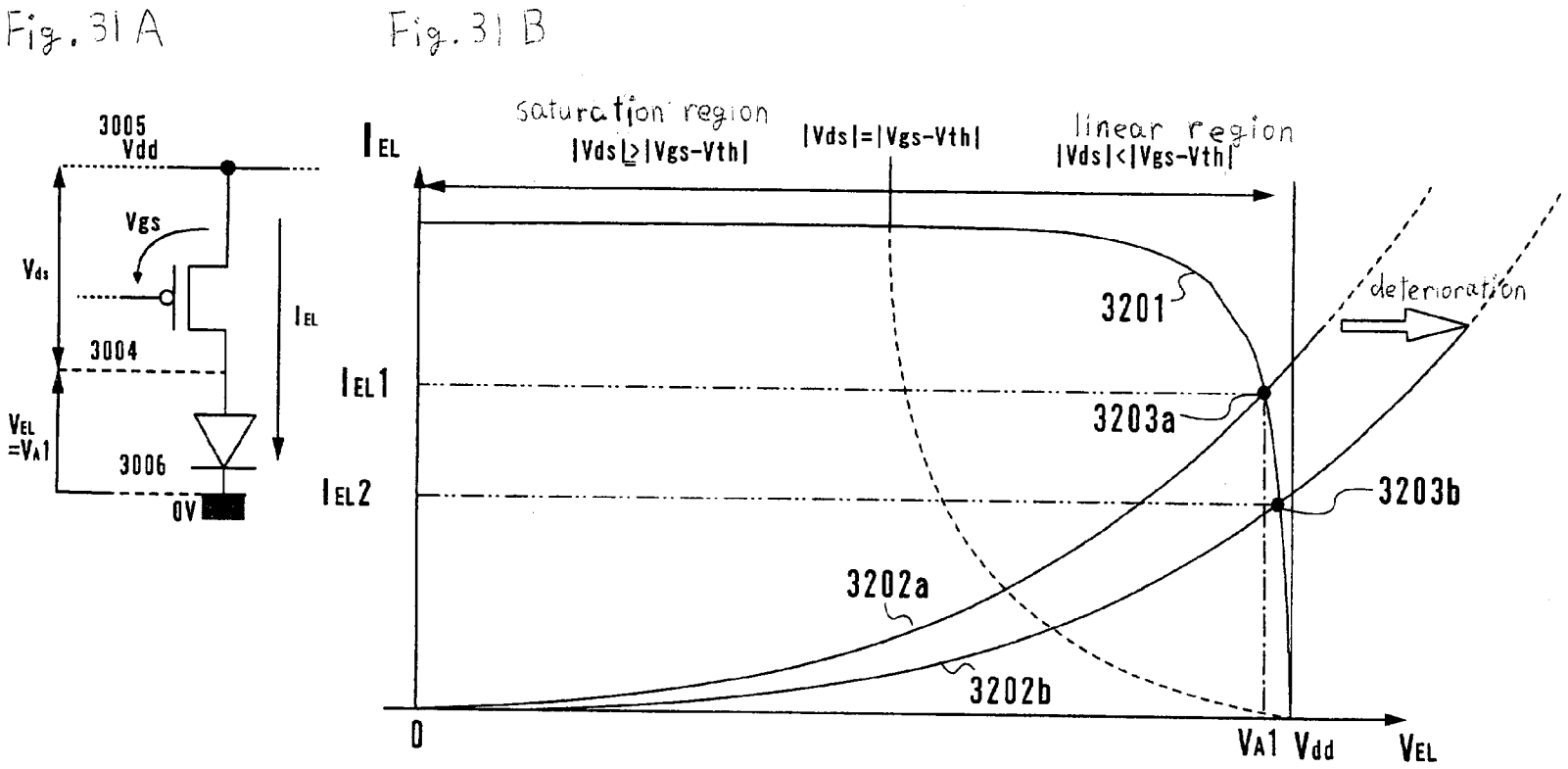
Fig. 31B PRIOR ART
FIG. 31A and FIG. 31B are views showing the operation region of the drive TFT of the conventional display apparatus.

Here, the first current source circuit 102*a* and the second current source circuit 102*b* can share wirings and elements. Signal lines can be shared. For example, a signal line GNa and a signal line GNb can be shared. Also, a signal like GHa and a signal line GHb can be shared. This structure is shown in FIG. 25A. Also, a current line CLa and a current line CLb can be shared. This structure is shown in FIG. 25B. In addition, structures of FIGS. 25A to 25B can be freely combined.

A way of setting of each current source circuit 102*a* and 102*b* is the same as in the embodiment 3. The current source circuit 102*a* is the multi-gate type current source circuit. Thus, it is desirable that its setting operation is carried out in synchronous with the operation of the switch part. Also, the current source circuit 102*b* is the multi-gate type current source circuit. Thus, it is desirable that its setting operation is carried out in synchronous with the operation of the switch part.

It is possible to realize this embodiment by being freely combined with the embodiment 1 to the embodiment 3.

Embodiment 9

In this embodiment, shown are four concrete examples in case that, in the pixel structure of the invention, gray scale is expressed by being combined with the temporal gray scale system. In addition, since a basic explanation relating to the temporal gray scale system is carried out in the embodiment 2, the explanation will be omitted here. In this embodiment, a case of expressing 64 gray scale will be shown as an example.

A first example is shown. By appropriately determining the output currents of a plurality of the current source circuits that each pixel has, the current value (1) of the current flowing through the light emitting element is changed with a ratio of 1:2. In this moment, one frame period is divided into two sub frame periods, and a ratio of a length (T) of the display period of each sub frame period is set to become 1:4:16. By this means, as shown in a table 1, by the combination of the current (represented by a current I) flowing through the light emitting element and the length (represented by a period T) of the display period, it is possible to express 64 gray scale.

TABLE 1

| | T | | |
|---|---|---|---|
| I | 1 | 4 | 16 |
| 1 | 1 | 4 | 16 |
| 2 | 2 | 8 | 32 |

A second example is shown. By appropriately determining the output currents of a plurality of the current source circuits that each pixel has, the current value (I) of the current flowing through the light emitting element is changed with a ratio of 1:4. In this moment, one frame period is divided into two sub frame periods, and a ratio of a length (T) of the display period of each sub frame period is set to become 1:2:16. By this means, as shown in a table 2, by the combination of the current I flowing through the light emitting element and the period T, it is possible to express 64 gray scale.

TABLE 2

| | T | | |
|---|---|---|---|
| I | 1 | 2 | 16 |
| 1 | 1 | 2 | 16 |
| 4 | 4 | 8 | 32 |

A third example is shown. By appropriately determining the output currents of a plurality of pairs of source circuits that each pixel has, the current value (I) of the current flowing through the light emitting element is changed with a ratio of 1:2:4. In this moment, one frame period is divided into three sub frame periods, and a ratio of a length (T) of the display period of each sub frame period is set to become 1:8. By this means, as shown in a table 3, by the combination of the current I flowing through the light emitting element and the period T, it is possible to express 64 gray scale.

TABLE 3

| | T | |
|---|---|---|
| I | 1 | 8 |
| 1 | 1 | 8 |
| 2 | 2 | 16 |
| 4 | 4 | 32 |

A fourth example is shown. By appropriately determining the output currents of a plurality of the current source circuits that each pixel has, the current value (I) of the current flowing through the light emitting element is changed with a ratio of 1:4:16. In this moment, one frame period is divided into three sub frame periods, and a ratio of a length (T) of the display period of each sub frame period is set to become 1:2. By this means, as shown in a table 4, by the combination of the current I flowing through the light emitting element and the period T, it is possible to express 64 gray scale.

TABLE 4

| | T | |
|---|---|---|
| I | 1 | 2 |
| 1 | 1 | 2 |
| 4 | 4 | 8 |
| 16 | 16 | 32 |

In addition, it is possible to realize this embodiment by being freely combined with the embodiment 1 to the embodiment 8.

Embodiment 10

In the embodiment 1 to the embodiment 9, shown was the structure in which each pixel has a plurality of the current source circuits and the switch parts. However, it may be a structure that each pixel has one pair of the current source circuit and the switch part.

Figure 42:
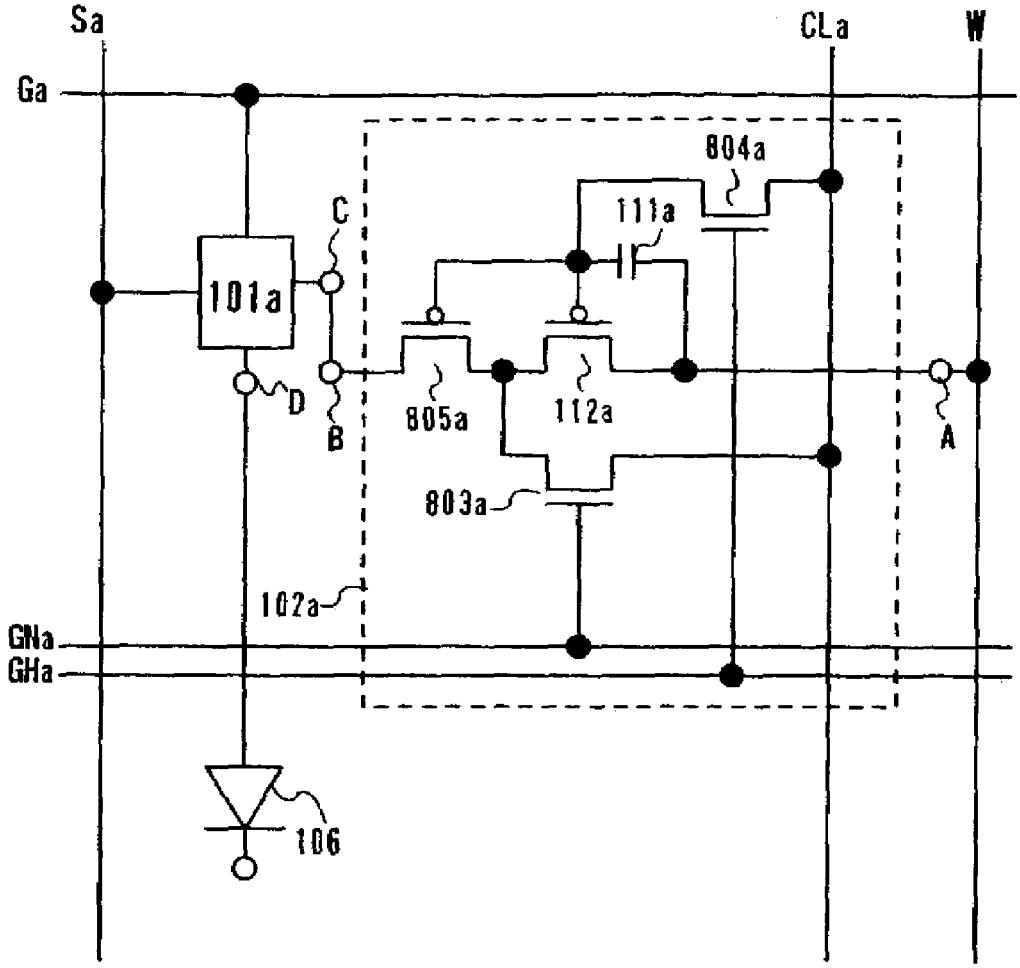
FIG. 42 is a view showing a structure of the pixel of the display apparatus of the invention.

For example, a structure of a pixel that has only one pair of a current source circuit of the fourth structure and a switch part is shown in FIG. 42.

In case that there is one pair of a switch part and a current source circuit in each pixel, it is possible to express 2 gray scale. In addition, by combined with other gray scale display method, it is possible to realize multiple gray scale. For example, it is possible to carry out gray scale display by combined with the temporal gray scale system.

It is possible to realize this embodiment by being freely combined with the embodiment 1 to the embodiment 9.

Embodiment 11

It may be a structure that each pixel has three and more current source circuits. For example, in the first combination example to the fifth combination example shown in the embodiment 4 to the embodiment 8, it is possible to add an arbitrary circuit to the current source circuits of the five structures shown in the embodiment 3.

It is possible to realize this embodiment by being freely combined with the embodiment 1 to the embodiment 10.

Embodiment 12

In this embodiment, a structure of a drive circuit which inputs the control signal to each pixel in the display apparatus of the invention will be described.

If varied is the control current which is inputted to each pixel, the current value of the current that the current source circuit of each pixel outputs will be also varied. On that account, there occurs a necessity of a drive circuit of a structure that approximately a constant control current is outputted to each current line. An example of such drive circuit will be hereinafter shown.

For example, it is possible to use a signal line drive circuit of a structure shown in patent application Ser. No. 2001-333462, patent application Ser. No. 2001-333466, patent application Ser. No. 2001-333470, patent application Ser. No. 2001-335917 or patent application Ser. No. 2001-335918. In short, by setting the output current of the signal line drive circuit at the control current, it is possible to input it to each pixel.

In the display apparatus of the invention, by applying the above-described signal line drive circuit, it is possible to input approximately a constant control current to each pixel. By this means, it is possible to further reduce variation of luminance of an image.

It is possible to realize this embodiment by being freely combined with the embodiment 1 to the embodiment 11.

Embodiment 13

In this embodiment, a display system to which the invention is applied will be described.

Here, the display system includes a memory which stores video signals which are inputted to the display apparatus, a circuit which outputs a control signal (a clock pulse, a start pulse, etc.) which is inputted to each drive circuit of the display apparatus, a controller which controls them, and so on.

Figure 41:
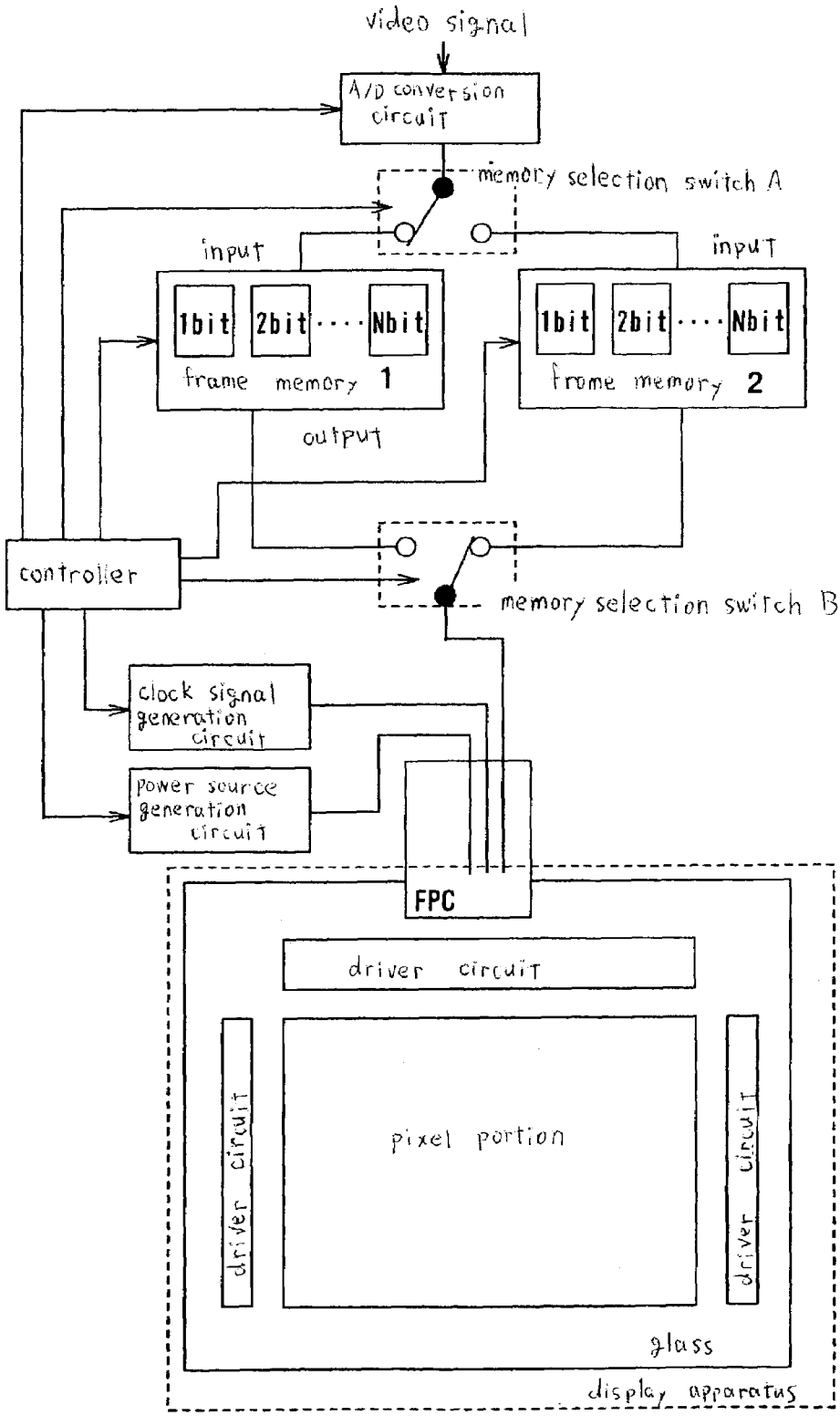
FIG. 41 is a schematic diagram showing a structure of a display system of the invention.

An example of the display system is shown in FIG. 41. The display system has, besides the display apparatus, an A/D conversion circuit, a memory selection switch A, a memory selection switch B, a frame memory 1, a frame memory 2, a controller, a clock signal generation circuit, and a power source generation circuit.

An operation of the display system will be described. The A/D conversion circuit converts the video signal which was inputted to the display system into a digital video signal. The frame memory A or the frame memory B stores the digital video signal. Here, by separately using the frame memory A or the frame memory B with respect to each period (with respect to one frame period, with respect to each sub frame period), it is possible to take an extra room in writing a signal to the memory and in reading out a signal from the memory. The separated use of the frame memory A and the frame memory B can be realized by switching the memory selection switch A and the memory selection switch B by the controller. Also, the clock generation circuit generates a clock signal etc. by a signal from the controller. The power source generation circuit generates a predetermined power source signal from the controller. The signal which was read out from the memory, the clock signal, the power source and so on are inputted to the display apparatus through FPC.

In addition, the display system to which the invention was applied is not limited to the structure shown in FIG. 41. In a display system of well known every structure, it is possible to apply the invention to it.

It is possible to realize this embodiment by being freely combined with the embodiment 1 to the embodiment 12.

Embodiment 14

The invention can be applied to various electronic apparatuses. In short, it is possible to apply the structural components of the invention to a portion which the various electronic apparatuses have and which carries out image display.

An one example of the electronic apparatus of the invention, cited are a video camera, a digital camera, a goggle type display (a head mount display), a navigation system, an audio reproduction apparatus (a car audio set, an audio component set and so on), a notebook type personal computer, a game machine, a portable information terminal (a mobile computer, a portable telephone, a portable type game machine or an electronic book, and so on), an image reproduction apparatus having a recording medium (to be more precise, an apparatus which reproduces a recording medium such as DVD etc., and has a display which can display its image), and so on.

In addition, it is possible to apply the invention to various electronic apparatuses but not limit to the above-described electronic apparatus.

It is possible to realize this embodiment by being freely combined with the embodiment 1 to the embodiment 13.

Embodiment 15

In the display apparatus of the invention, the current source transistor operates in the saturation region. Then, in this embodiment, an optimum scope of a channel length of the current source transistor by which power consumption of the display apparatus can be suppressed, and yet, linearity of the operation of the current source transistor in the saturation region can be maintained will be described.

The current source transistor, which the display apparatus of the invention has, operates in the saturation region, and its drain current Id is represented by the following formula 1. In addition, it is assumed that Vgs is a gate voltage, and μ is mobility, and $C_o$ is a gate capacitance per unit area, and W is a channel width, and L is a channel length, and Vth is a threshold value, and the drain current is Id.

$$Id=\mu CoW/L(Vgs-Vth)^2/2 \quad (1)$$

From the formula 1, it is understood that, in case that values of μ, Vth, and W are fixed, Id is determied by values of L and Vgs, without depending upon a value of Vds.

Meanwhile, power consumption is comparable to product of a current and a voltage. Also, since Id is proportion to luminance of the light emitting element, when the luminance is determined, the value of Id is fixed. Thus, in case that reduction of power consumption is taken into consideration, it is understood that |Vgs| is desired to be lower, and therefore, L is desired to be of a smaller value.

However, when the value of L gets smaller, the linearity of the saturation region is getting not to be maintained gradually due to Early effect or Kink effect. In short, the operation of the current source transistor is getting not to follow the above-described formula 1, and the value of Id is getting gradually to depend upon Vds. Since the value of Vds is increased based upon decrease of $V_{EL}$ due to deterioration of the light emitting element, as a chain thereof, the value of Id becomes apt to be swayed by the deterioration of the light emitting element.

In short, it is not desirable that the value of L is too small, taking the linearity of the saturation region into consideration, but if too large, it is not possible to suppress the power consumption. It is most desirable that the value of L is made to be small within a scope that the linearity of the saturation region can be maintained.

Figure 44:
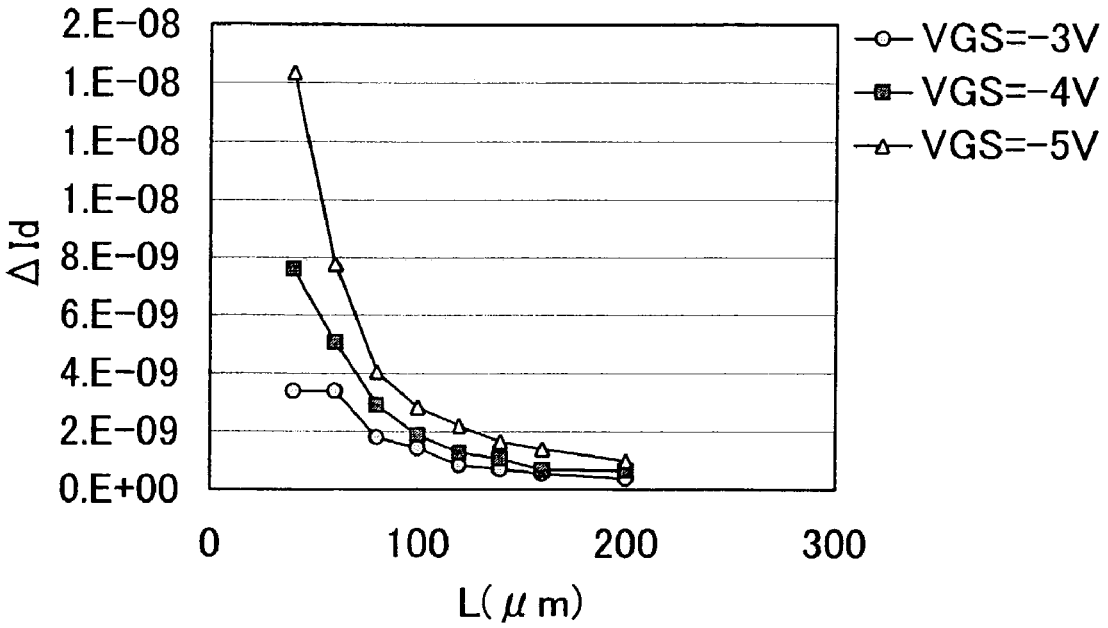
FIG. 44 is a graph showing a relation of a channel length L and ΔId.

FIG. 44 shows a relation of L and ΔId in a P channel type TFT at the time of W=4 μm and Vds=10 v. ΔId is a value which differentiates Id by L, and comparable to an inclination of Id to L. Thus, the smaller the value of ΔId is, it means that the linearity of Id in the saturation region is maintained. And, as shown in FIG. 42, it is understood that, as L is enlarged, the value of ΔId is getting drastically smaller from an area that L is approximately 100 μm. Thus, in order to maintain the linearity of the saturation region, it is understood that L is desirable to be the value of approximately 100 μm and more than that.

And, taking the power consumption into consideration, since it is desirable that L is smaller, in order to satisfy both conditions, it is most desirable that L is 100±10 μm. In short, by setting the scope of L at 90 μm≦L≦110 μm, the power consumption of the display apparatus having the current source transistor can be suppressed, and yet, the linearity of the current source transistor in the saturation region can be maintained.

It is possible to realize this embodiment by being freely combined with the embodiment 1 to the embodiment 14.

Embodiment 16

In this embodiment, shown is a structural example of the pixel using a driving method for further reducing the luminance variation which was described above, i.e., a driving method for separately using a plurality of the current source circuits which were set at the same output current on the occasion of expressing the same gray scale.

The pixel shown in this embodiment is of a structure which has a plurality of current source circuits, and in which a switch part making pairs with a plurality of the current source circuits is shared. One digital video signal is inputted to each pixel, and image display is carried out by selectively using a plurality of the current source circuits. By this means, it is possible to reduce the number of elements that each pixel has, and to enlarge an open area ratio. In addition, a plurality of the current source circuits which shared the switch part are set in such a manner that they output the same constant current each other. And, on the occasion of expressing the same gray scale, the current source circuits which output the same constant current are separately used. By this means, even if the output currents of the current source circuits are tentatively varied, the current flowing through the light emitting element is temporarily averaged. On that account, it is possible to visually reduce the variation of the luminance due to variation of the output currents of the current source circuits between respective pixels.

Figure 43B:
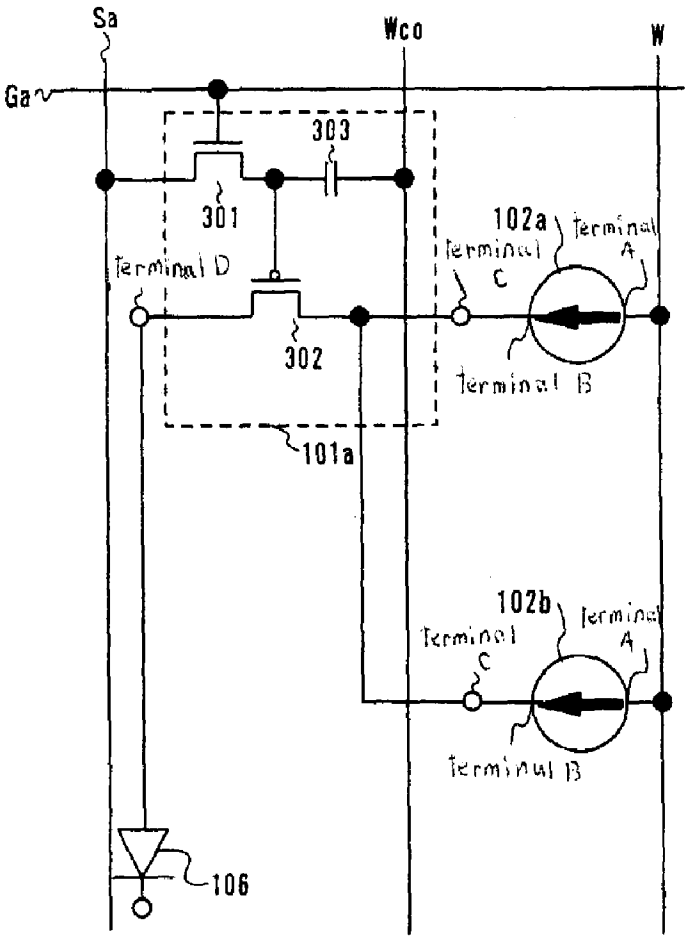
FIG. 43A and FIG. 43B are views showing structures of the pixel of the display apparatus of the invention.
Figure 43A:
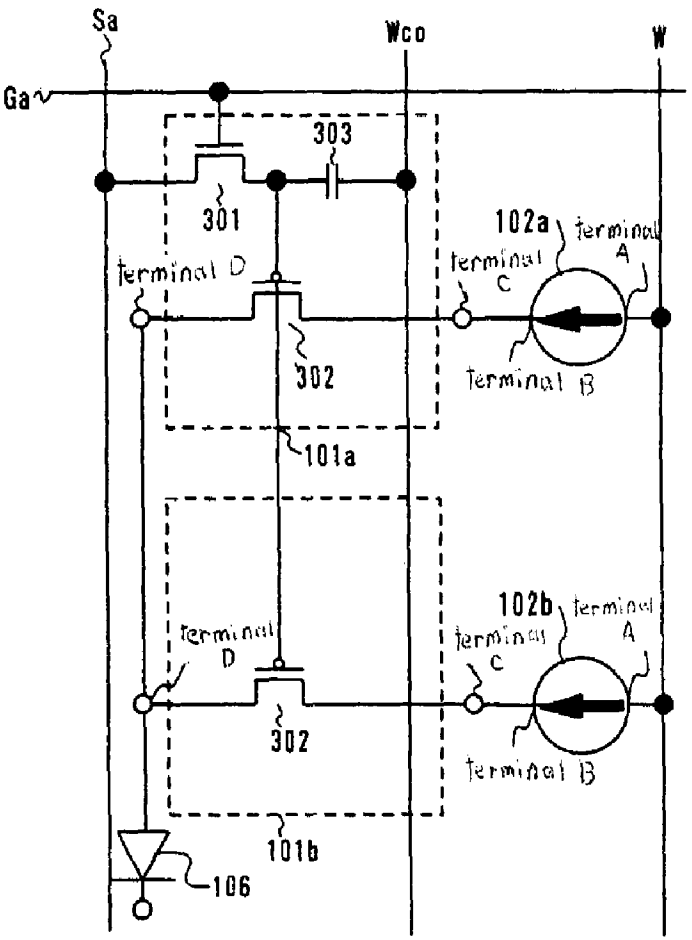

FIG. 43A and FIG. 43B show the structures of the pixel in this embodiment. In addition, the same reference numerals and signs are given to the same portions as in FIGS. 7A–C and FIGS. 8A–C.

FIG. 43A is of a structure that, in the switch parts 101*a* and 101*b* corresponding to the current source circuits 102*a* and 102*b*, the selection transistor 301 is shared. Also, FIG. 43B is of a structure that, in the switch parts 101*a* and 101*b* corresponding to the current source circuits, the selection transistor 301 and the drive transistor 302 are shared. In addition, although not shown in FIG. 43A and FIG. 43B, the deletion transistor 304 which was shown in the embodiment 2 may be disposed. A way of a connection of the deletion transistor 304 in the pixel can be made to be the same as in the embodiment 2.

As the current source circuits 102*a* and 102*b*, the current source circuits of the first structure to the fifth structure shown in the embodiment 3 can be freely applied. But, in the structure that the switch part making a pair with a plurality of the current source circuits is shared as in this embodiment, it is necessary for the current source circuits 102*a* and 102*b* themselves to have a function for selecting the conductive state or the non conductive state between the terminal A and the terminal B. A reason thereof is that, it is not possible to select the current source circuit which supplies a current to the light emitting element, out of a plurality of the current source circuits 102*a* and 102*b*, by one switch part which was disposed to a plurality of the current source circuits.

For example, in the embodiment 3, as to the current source circuits of the second structure to the fifth structure shown in FIGS. 10A–E, 11 A–E, 12A–F, 13 A–F and so on, the current source circuit 102 itself has the function for selecting the conductive state or the non conductive state between the terminal A and the terminal B. That is, in the current source circuit of such structure, on the occasion of the setting operation of the current source circuit, it is possible to turn in the non conductive state between the terminal A and the terminal B, and on the occasion of carrying out the image display, it is possible to turn in the conductive state between the terminal A and the terminal B. On one hand, in the embodiment 3, as to the current source circuit of the first structure shown in FIGS. 9A–C etc., the current source circuit 102 itself does not have the function for selecting the conductive state or the non conductive state between the terminal A and the terminal B. That is, in the current source circuit of such structure, on the occasion of the setting operation of the current source circuit and on the occasion of carrying out the image display, it is in the conductive state between the terminal A and the terminal B. Thus, in case that the current source circuit as shown in FIGS. 9A–C is used as the current source circuit of the pixel of this embodiment as shown in FIG. 43A and FIG. 43B, there is a necessity to dispose a unit for controlling the conductive and non conductive states between the terminal A and the terminal B of the respective current source circuits by a signal which is different from the digital video signal.

In the pixel of the structure of this embodiment, during a period that the setting operation of one current source circuit out of a plurality of the current source circuits which shared the switch part is carried out, it is possible to carry out the display operation by using another current source circuit. On that account, in the pixel structure of this embodiment, even if used is the current source circuit of the second structure to the fifth structure which can not carry out the setting operation of the current source circuit and the current output at the same time, it is possible to carry out the setting operation of the current source circuit and the display operation at the same time.

It is possible to realize this embodiment by being freely combined with the embodiment 1 to the embodiment 15.

In the display apparatus of the invention, since the current flowing through the light emitting element can be maintained to be the predetermined constant current on the occasion of carrying out the image display, it is possible to have it emitted light with constant luminance regardless of the change of the current characteristic due to deterioration etc. of the light emitting element. Also, by selecting the on state or the off state of the switch part by the digital video signal, the light emission state or the non light emission state of each pixel is selected. On that account, it is possible to speed up writing of the video signal to the pixel. Furthermore, in the pixel in which the non light emission state was selected by the video signal, since the current which is inputted to the light emitting element is completely blocked by the switch part, it is possible to realize accurate gray scale expression.

In the conventional current writing type analog system pixel structure, there was the necessity to lessen the current which is inputted to the pixel according to the luminance. On that account, there was the problem that the influence of noise is large. On one hand, in the pixel structure of the display apparatus of the invention, if the current value of the constant current flowing through the current source circuit is set larger to some extend, it is possible to reduce the influence of noise.

Also, it is possible to have the light emitting element emitted light with constant luminance regardless of change of the current characteristic due to deterioration etc., and a speed of writing a signal to each pixel is fast, and it is possible to express accurate gray scale, and it is possible to provide the display apparatus with low cost and smaller size and the driving method thereof.

What is claimed is:

1. A display device including pixels each having plural current source circuits to each of which a constant control current is supplied and in each of which a constant current corresponding to the control current is made into an output current, and plural switch parts each selecting an input of the output current from each of the plural current source circuits to a light emitting element by a digital picture signal, wherein the plural current source circuits are provided in each of the pixels, and wherein each of the plural current source circuits comprises:

a first transistor and a second transistor connected in series with the first transistor, first means for selectively inputting the control current as a drain current of the first transistor, second means for holding a gate voltage of the first transistor, third means for selecting a connection between a gate and a drain of the first transistor, and fourth means for making a drain current of the second transistor, in which a part of the held gate voltage of the first transistor is made into a gate voltage, into the output current.

2. A display device according to claim 1, wherein a current value of the output current of each of the plural current source circuits is set to a mutually different value.

3. A display device according to claim 1, wherein a current value of the control current inputted to each of the plural current source circuits is set to a mutually different value.

4. An electronic apparatus having the display device according to claim 1, wherein the electronic apparatus is selected from the group consisting of a video camera, a digital camera, a goggle type display, a navigation system, an audio reproduction apparatus, a notebook type personal computer, a game machine, and a portable information terminal.

5. A display device including pixels each having plural current source circuits to each of which a constant control current is supplied and in each of which a constant current corresponding to the control current is made into an output current, and plural switch parts each selecting an input of the output current from each of the plural current source circuits to a light emitting element by a digital picture signal, wherein the plural current source circuits are provided in each of the pixels, and wherein each of the plural current source circuits comprises:

a first transistor and a second transistor connected in series with the first transistor, first means for selectively inputting the control current as a drain current of the first transistor, second means for holding a gate voltage of the first transistor, third means for selecting a connection between a gate and a drain of the first transistor, and fourth means for making a drain current of the second transistor, in which a part of the held gate voltage of the first transistor is made into a gate voltage, into the output current, and wherein another one of the plural current source circuits comprises:

a third transistor and a fourth transistor, fifth means for selectively inputting the control current as a drain current of the third transistor, sixth means for holding a gate voltage of the third transistor, seventh means for selecting a connection between a gate and a drain of the third transistor, and eighth means for making a drain current of the fourth transistor, in which the held gate voltage of the third transistor is made into a gate voltage, into the output current.

6. A display device according to claim 5, wherein a current value of the output current of each of the plural current source circuits is set to a mutually different value.

7. A display device according to claim 5, wherein a current value of the control current inputted to each of the plural current source circuits is set to a mutually different value.

8. An electronic apparatus having the display according to claim 5, wherein the electronic apparatus is selected from the group consisting of a video camera, a digital camera, a goggle type display, a navigation system, an audio reproduction apparatus, a notebook type personal computer, a game machine, and a portable information terminal.

9. A display device comprising pixels, each of the pixels comprising:

a first current source circuit configured to receive a first constant control current and output a constant first current corresponding to the first control current as a first output current;

a first switch part configured to select an input of the first output current from the first current source circuit to a light emitting element by a first digital picture signal, the first switch being connected to the first current source circuit;

a second current source circuit configured to receive a constant second control current and output a second constant current corresponding to the second control current as a second output current; and a second switch part configured to select an input of the second output current from the second current source circuit to the light emitting element by a second digital picture signal, the second switch being connected to the second current source circuit, wherein the first current source circuit comprises:

a first transistor; and a second transistor connected in series with the first transistor;

a third transistor configured to selectively input the first control current as a drain current of the first transistor;

a capacitor configured to hold a gate voltage of the first transistor; and a fourth transistor configured to select a connection between a gate and a drain of the first transistor, wherein the second transistor is configured to make a drain current of the second transistor, to which a part of the held gate voltage of the first transistor is applied as a gate voltage, into the first output current.

10. A display device according to claim 9, wherein a first current value of the first output current of the first current source circuit and a second current value of the second output current of the second current source circuit are set to mutually different values.

11. A display device according to claim 9, wherein a first current value of the first control current inputted to the first current source circuit and a second current value of the second control current inputted to the second current source circuit are set to mutually different values.

12. A display device comprising pixels, each of the pixels comprising:

a first current cource circuit configured to receive a first constant current and output a constant first current corresponding to the first control current as a first output current;

a first switch part configured to select an input of the first output current from the first current source circuit to a light emitting element by a first digital picture signal, the first switch being connected to the first current source circuit;

a second current source circuit configured to receive a constant second control current and output a second constant current corresponding to the second control current as a second output current; and a second switch part configured to select an input of the second output current from the second current source circuit to the light emitting element by a second digital picture signal, the second switch being connected to the second current source circuit, wherein the first current source circuit comprises:

a first transistor; and a second transistor connected in series with the first transistor;

a third transistor configured to selectively input the first control current as a drain current of the first transistor;

a first capacitor configured to hold a gate voltage of the first transistor; and a fourth transistor configured to select a connection between a gate and a drain of the first transistor, a gate electrode of the second transistor being connected to a gate electrode of the first transistor;

wherein the second transistor is configured to make a drain current of the second transistor, to which a part of the held gate voltage of the first transistor is applied as a gate voltage, into the first output current, wherein the second current source circuit comprises:

a fifth transistor;

a sixth transistor;

a seventh transistor and an eighth transistor configured to selectively input the second control current as a drain current of the fifth transistor; and a second capacitor configured to hold a gate voltage of the fifth transistor;

wherein the eighth transistor is configured to select a connection between a gate and a drain of the fifth transistor, and wherein the sixth transistor is configured to make a drain current of the sixth transistor, to which the held gate voltage of the fifth transistor is applied as a gate voltage, into the second output current.

13. A display device according to claim 12, wherein a first current value of the first output current of the first current source circuit and a second current value of the second output current of the second current source circuit are set to mutually different values.

14. A display device according to claim 12, wherein a first current value of the first control current inputted to the first current source circuit and a second current value of the second control current inputted to the second current source circuit are set to mutually different values.

15. A display device according to claim 12, wherein the sixth transistor is configured to make the drain current of the sixth transistor into the second output current with the seventh transistor.

16. A navigation system comprisign a display device:

wherein the display device comprises pixels; and wherein each of the pixels comprises a field emission element, a current source circuit configured to receive a control signal and output a constant current corresponding to the control signal as an output current, and a switch part configured to select an input of the output current from the current source circuit to the field emission element.

17. A navigation system according to claim 16, wherein the current source circuit and the switch part are serially connected.

18. A navigation system comprising a display device:

wherein the display device comprises pixels; and wherein each of the pixels comprises a field emission element, a current source circuit configured to receive a current signal and output a constant current corresponding to the current signal as an output current, and a switch part configured to select an input of the output current from the current source circuit to the field emission element.

19. A navigation system according to claim 18, wherein the current source circuit and the switch part are serially connected.

20. A navigation system comprising a display device:

wherein the display device comprises pixels; and wherein each of the pixels comprises a field emission element, a current source circuit configured to receive a voltage signal and output a constant current corresponding to the voltage signal as an output current, and a switch part configured to select an input of the output current from the current source circuit to the field emission element.

21. A navigation system according to claim 20, wherein the current source circuit and the switch part are serially connected.

* * * * *